US009475332B2

(12) United States Patent
Aoi

(10) Patent No.: US 9,475,332 B2
(45) Date of Patent: Oct. 25, 2016

(54) BINDING MACHINE AND CUTTING BLADE USED FOR BINDING MACHINE

(75) Inventor: Hirokazu Aoi, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 794 days.

(21) Appl. No.: 13/814,400

(22) PCT Filed: Jul. 8, 2011

(86) PCT No.: PCT/JP2011/065655

§ 371 (c)(1),
(2), (4) Date: Mar. 4, 2013

(87) PCT Pub. No.: WO2012/017778

PCT Pub. Date: Feb. 9, 2012

(65) Prior Publication Data

US 2013/0156529 A1 Jun. 20, 2013

(30) Foreign Application Priority Data

Aug. 6, 2010 (JP) ..... 2010-177190
Mar. 1, 2011 (JP) ..... 2011-044482

(51) Int. Cl.
*B42B 5/00* (2006.01)
*B31F 5/02* (2006.01)
(Continued)

(52) U.S. Cl.
CPC ..... *B42B 5/00* (2013.01); *B26D 1/0006* (2013.01); *B26F 1/02* (2013.01); *B31F 5/027* (2013.01);
(Continued)

(58) Field of Classification Search
CPC ..... B31F 5/00; B31F 5/02; B31F 5/025; B31F 5/027; B31F 5/022; B42B 5/00; B42B 5/02; B42B 5/04; B42B 5/08; B43F 3/00; B43F 3/02; B43F 3/003; B42F 3/00; B42F 3/02; B42F 3/003; Y10T 83/9314; Y10T 83/9411; B26D 1/0006; B26D 2001/006; B26D 2001/0053; B26F 1/02
USPC ..... 493/350, 351, 356, 390, 194, 234, 199; 270/58.07, 58.08
See application file for complete search history.

(56) References Cited

U.S. PATENT DOCUMENTS 1,055,680 A * 3/1913 Stacy ..... B31D 1/023 493/351
1,130,589 A * 3/1915 Gage ..... B31D 1/023 493/351
(Continued)

FOREIGN PATENT DOCUMENTS

CN 1100369 A 3/1995
GB 2252525 A 8/1992
(Continued)

OTHER PUBLICATIONS

Definition of "edge" accessed at http://www.merriam-webster.com/dictionary/edge on Mar. 1, 2016.*
(Continued)

*Primary Examiner* — Stephen Choi
*Assistant Examiner* — Evan MacFarlane
(74) *Attorney, Agent, or Firm* — Peter J. Meza; Hogan Lovells US LLP

(57) ABSTRACT

A punching blade can form a cut-and-raised piece provided with a wide width portion in a distal-end region, a cutting blade is provided with a first blade having a window with which the cut-and-raised piece is engaged and forming a first slit and a second blade for forming a second slit extending in a direction of a punched hole from the midstream of the first slit. It is also configured such that an edge from the wide width portion of the cut-and-raised piece to the base end can be engaged with the second slit.

13 Claims, 38 Drawing Sheets

(51) Int. Cl.

| | |
|---|---|
| ***B26D 1/00*** | (2006.01) |
| ***B26F 1/02*** | (2006.01) |
| ***B42B 5/08*** | (2006.01) |
| ***B42F 3/00*** | (2006.01) |

(52) U.S. Cl.
CPC . *B42B 5/08* (2013.01); *B42F 3/00* (2013.01); *B26D 2001/006* (2013.01); *B26D 2001/0053* (2013.01); *Y10T 83/9314* (2015.04)

(56) References Cited

U.S. PATENT DOCUMENTS

| | | | | | |
|---|---|---|---|---|---|
| 1,148,672 | A * | 8/1915 | Gessler | B31D 1/023 | 493/351 |
| 1,229,213 | A * | 6/1917 | Bernard | B31D 1/023 | 30/363 |
| 1,324,103 | A * | 12/1919 | Cone | B31F 5/027 | 281/21.1 |
| 3,577,575 | A * | 5/1971 | Taniguchi | B31F 5/027 | 29/564 |
| 5,024,643 | A * | 6/1991 | Kastner | B31F 5/027 | 493/351 |
| 5,899,841 | A * | 5/1999 | Berger | B31F 5/027 | 493/351 |
| 8,075,236 | B2 * | 12/2011 | Penne | B26F 1/22 | 412/6 |

FOREIGN PATENT DOCUMENTS

| | | |
|---|---|---|
| JP | 8-300847 A | 11/1996 |
| JP | 2003-103958 | 4/2003 |
| JP | 2004-122329 | 4/2004 |
| JP | 2010-228451 | 10/2010 |
| WO | 2010055784 A1 | 5/2010 |

OTHER PUBLICATIONS

JP International Search Report with English Translation, Application No. PCT/JP2011/065655, mailing date Oct. 11, 2011, pp. 4.
European extended search report for Application No. 11814408.8-1704/2602122 PCT JP2011065655, dated Dec. 17, 2013, 7 pgs.

* cited by examiner

BINDING MACHINE AND CUTTING BLADE USED FOR BINDING MACHINE

RELATED APPLICATION

The present application relates to and claims the benefit of priority to Patent Application No. PCT/JP2011/065655 filed 2011 Jul. 8, which is hereby incorporated by reference in its entirety for all purposes as if fully set forth herein.

TECHNICAL FIELD

The present invention is related particularly to a binding machine of a type not using metal needles in binding machines which bind end portions of a plurality of stacked sheets integrally and to a cutting blade used in this binding machine.

BACKGROUND ART

A binding machine has been known that is provided with a punching blade for punching a punched hole while forming a cut-and-raised piece in each of a plurality of sheets, a cutting blade provided adjacently to this punching blade and punching a cut hole for locking the distal end side of the cut-and-raised piece, a base portion for holding the punching blade and the cutting blade, and a punch stand disposed through a gap for sheet insertion on this base portion. By performing a punching operation so that the punching blade and the cutting blade held on the base portion penetrate the sheet inserted in the gap for sheet insertion and protrude to the punch stand side, a punched hole and a cut hole are formed in the sheet, and by performing a withdrawing operation so that the cutting blade and the punching blade are returned to the base portion side in a state where the distal end side of the cut-and-raised piece cut and raised from the punched hole to the punch stand side is engaged with the cutting blade, the cut-and-raised piece is penetrated into the cut hole so as to bind the sheets (See Patent Literature 1, for example).

However, in such binding machines, a cut-and-raised piece having a substantially constant width corresponding to a width dimension of the cut hole from the base end to the distal end and a semicircular distal end is engaged with the linear cut hole formed in the sheet. That is, the plurality of sheets bound by this binding machine are maintained in a joined state in which the cut-and-raised piece folds from the front surface side into the back surface side when the cut-and-raised piece penetrates the cut hole. Thus, if a force is applied in a direction to separate each of the bound sheets, the linear cut hole is largely opened in the vertical direction, and the state where the cut-and-raised piece is folded might be released relatively easily, resulting in the engagement between the cut-and-raised piece and the cut hole becoming disengaged, and the joined state is released. Particularly, on a sheet with small friction resistance, the above-described joined state can be easily released, and thus some measure is in demand.

CITATION LIST

Patent Literature

Patent Literature 1: Japanese Unexamined Patent Application Publication No. H8-300847

SUMMARY OF THE INVENTION

Technical Problem

The present invention has an object to provide a binding machine that can make the joined state between the cut-and-raised piece and the cut hole more reliable and a cutting blade used in this binding machine.

Solution to Problem

In order to solve the above-described problems, the present invention employs the following configuration. That is, the binding machine according to the present invention is provided with a punching blade for punching a punched hole while forming a cut-and-raised piece in a plurality of sheets, a cutting blade provided adjacently to this punching blade and punching a cut hole for locking the distal end side of the cut-and-raised piece, a base portion for holding the punching blade and the cutting blade, and a punch stand disposed on this base portion through a gap for sheet insertion. By performing a punching operation so that the punching blade and the cutting blade held on the base portion penetrate the sheet inserted in the gap for sheet insertion and protrude to the punch stand side, a punched hole and a cut hole are formed in the sheet, and by performing a withdrawing operation so that the cutting blade and the punching blade are returned to the base portion side in a state while the distal end side of the cut-and-raised piece cut and raised from the punched hole to the punch stand side is engaged with the cutting blade, the cut-and-raised piece penetrates the cut hole and the sheets are bound. The punching blade can form a cut-and-raised piece provided with a wide width portion in a distal-end region, the cutting blade is provided with a first blade having a window with which the cut-and-raised piece is engaged and forming a first slit and a second blade for forming a second slit extending in a direction of the punched hole from the midstream of the first slit. It is also configured such that an edge from the wide width portion of the cut-and-raised piece to the base end can be engaged with the second slit.

Here, the term "sheet" may be anything as long as it has a sheet shape and includes those made of plastic and metal other than those made of paper.

With such configuration, the cut-and-raised piece is engaged not only with the first slit but also with the second slit and thus, the joined state between the cut-and-raised piece and the cut hole can be made more reliable.

As a specific mode for realizing the above-described configuration, a mode can be cited in which a shape and a dimension of the punching blade, a shape and a dimension of the cutting blade, and relative positions of the punching blade and the cutting blade are set so that the wide width portion is located on the side farther away from the punched hole than the distal end of the second slit.

As another mode, a mode can be cited in which the shape and the dimension of the punching blade, the shape and the dimension of the cutting blade, and the relative positions of the punching blade and the cutting blade are set so that an outer end of the wide width portion is located on the outer side of the second slit.

The shape and the dimension of the punching blade, the shape and the dimension of the cutting blade, and the relative positions of the punching blade and the cutting blade are preferably set so that the wide width portion is located closer to the punched hole side than the first slit.

If the window is formed of a reduced width portion provided with the second blade for forming the second slit at least on one of side edges and an enlarged width portion provided adjacently to this reduced width portion, the shape and the dimension of the punching blade, the shape and the dimension of the cutting blade, and the relative positions of the punching blade and the cutting blade are preferably set so that a width dimension of the wide width portion is smaller than an inner dimension of the enlarged width portion.

The window is preferably provided with a projection for pushing the cut-and-raised piece into the cut hole in order to easily push in the cut-and-raised piece into the cut hole when the cut-and-raised piece and the cut hole are to be engaged with each other.

As a suitable cutting blade used in the binding machine as above, a cutting blade in which a second blade is formed on both side edges of the window can be cited.

A more specific mode of the cutting blade is a cutting blade in which the second blade is integrally cut and raised from the window.

Advantageous Effects of Invention

According to the present invention, the binding machine in which the joined state between the cut-and-raised piece and the cut hole can be made more reliable and the cutting blade used in this binding machine can be provided.

DESCRIPTION OF EMBODIMENTS

First Embodiment

A first embodiment of the present invention will be described below by referring to FIGS. 1 to 31.

This binding machine 1 is, as illustrated in FIGS. 1 to 17, configured to be able to make a booklet B by forming a punched hole P1 and a cut hole P2 in a plurality of sheets P and by inserting a cut-and-raised piece P5 cut and raised from the punched hole P1 through the cut hole P2 so as to mutually bind the plurality of sheets P.

<Booklet>

Figure 4:
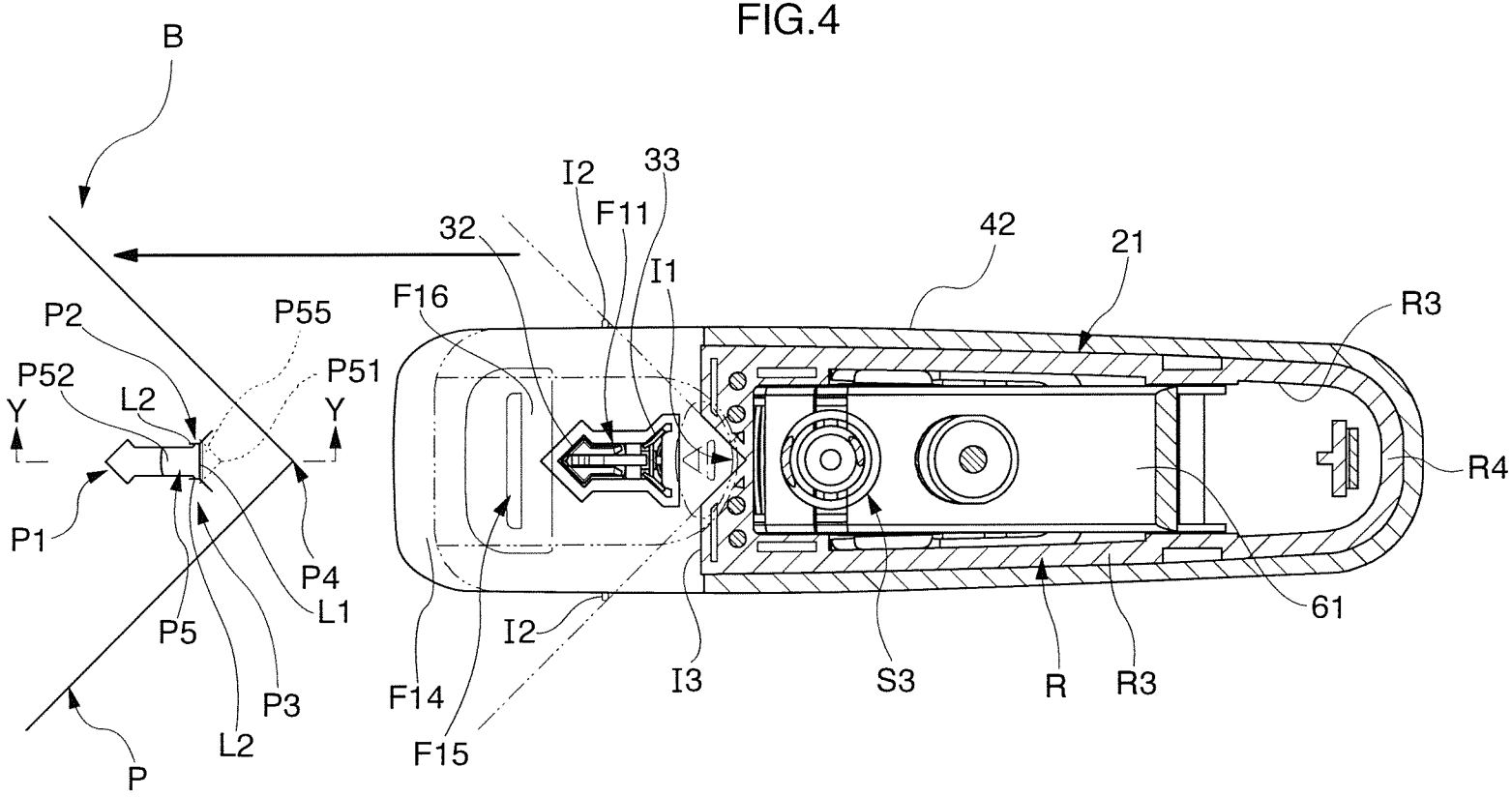
FIG. 4 is a sectional view taken along the line X-X in FIG. 2.
Figure 5:
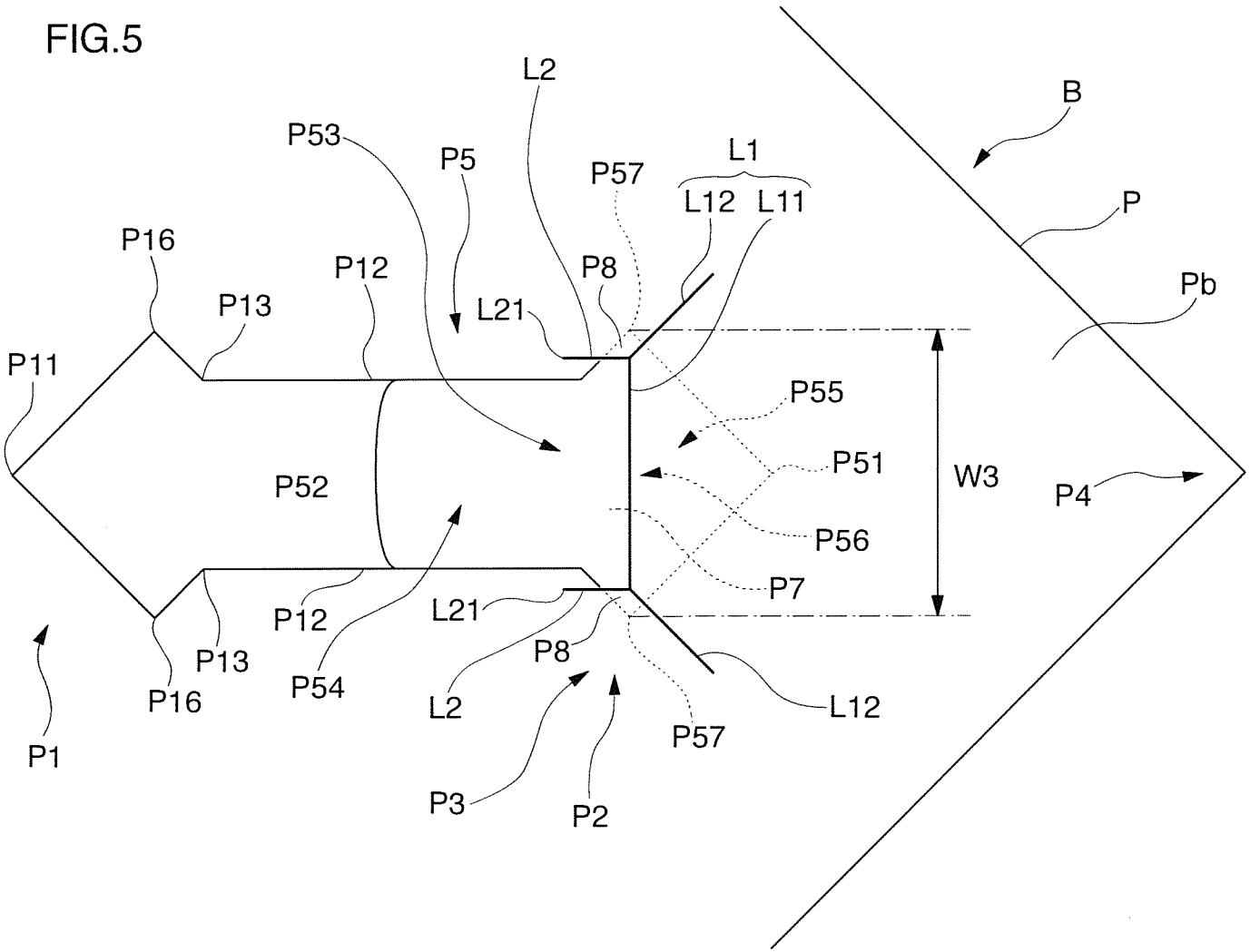
FIG. 5 is an enlarged plan view of a corner portion of a sheet using the binding machine of the embodiment.
Figure 6:
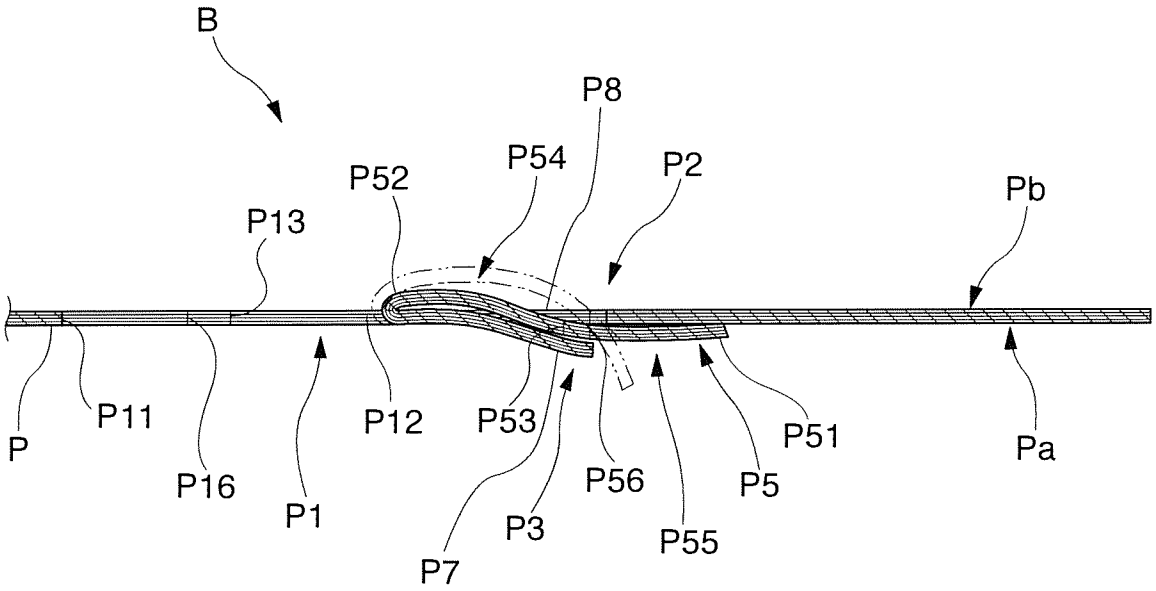
FIG. 6 is a sectional view taken along the line Y-Y in FIG. 4.

This booklet B is, as illustrated in FIGS. 4 to 6, formed by bundling a plurality of sheets P, and the sheets P are joined to each other at one joined portion P3 set at a corner portion P4. This joined portion P3 is composed of the punched hole P1 formed in each of the sheets P by a punching blade 32 penetrated from the one surface Pa side of the sheet P, the cut hole P2 for raising formed in each of the sheets P adjacently to this punched hole P1, and a cut-and-raised piece P5 cut and raised from the punched hole P1 to the other surface Pb side of the sheet P. Then, by penetrating the distal end P51 side of the cut-and-raised piece P5 through the cut hole P2 and guiding it to the one surface Pa side of the sheet P, the corner portions P4 of the plurality of sheets P are joined to each other.

<Cut-and-Raised Piece>

The cut-and-raised piece P5 has, as illustrated in FIGS. 4 to 6, a shape with the distal end side expanded or specifically an arrow shape as a whole and is provided with a base end region P54 on a base end P52 side sandwiching a boundary portion P53 and a distal end region P55 on the distal end P51 side. The base end region P54 has a substantially rectangular shape and has the same width dimension set from the base end P52 to the boundary portion P53 of the cut-and-raised piece P5. That is, the side edges forming the right and left pair of the base end region P54 are in parallel with each other. The distal end region P55 is formed integrally from the boundary portion P53 side of the base end region P54 and has a polygonal shape with the sharp distal end P51. This distal end region P55 is provided with a wide width portion P56 having a width dimension W3 larger than the boundary portion P53 and the distal end P51 from the boundary portion P53 to the distal end P51 of the cut-and-raised piece P5. In other words, the distal end region P55 is provided with a distal-end corner portion at the distal end edge provided at the center part in the width direction of this cut-and-raised piece P5 and also provided with side-edge corner portions forming a pair on the both right and left side edges of the wide width portion P56. The "corner portion" here is not limited to a square one but also includes a round one.

<Punched Hole>

The punched hole P1 has, as illustrated in FIGS. 4 to 6, a size and a shape corresponding to the cut-and-raised piece P5, and immediately after the punching by the punching blade 32, it has a slit shape corresponding to the shape of the punching blade 32 and after the cut-and-raised piece P5 is cut and raised, it is a space having an arrow shape corresponding to the shape of the cut-and-raised piece P5. In more detail, this punched hole P1 is provided with a distal end region slit corresponding to the distal end region P55 of the cut-and-raised piece P5 and base end region slits forming a pair corresponding to the base end region P54 of the cut-and-raised piece P5 formed continuously to this distal end region slit.

<Cut Hole>

On the other hand, the cut hole P2 is composed of, as illustrated in FIGS. 4 to 6, a first slit L1 for mainly engaging the cut-and-raised piece P5 and second slits L2 forming a pair in the right and left direction bent and extending in a direction of the punched hole P1 from the middle of this first slit L1. The first slit L1 is provided with a linear main slit L11 and a sub slit L12 bent and extending from the both ends of this main slit L11 in another direction, that is, a direction opposite to the second slit L2. The second slit L2 extends from a boundary portion between the main slit L1 and the sub slit L12. In this cut hole P2, the first slit L11 and the second slit L2 form a certain angle, and in this embodiment, an angle between the main slit L11 of the first slit L1 and the second slit L2 is set at approximately 90 degrees and an angle between the sub slit L12 of the first slit L1 and the second slit L2 is set at approximately 135 degrees. In this embodiment, the length of the first slit L1 is set longer than the length of the second slit L2, and the lengths of the second slits L2 forming a pair are set substantially equal. Moreover, the second slits L2 forming a pair are formed by being spaced apart from each other by a width dimension W2 substantially equal to or slightly larger than the width dimension of the base end region P54 of the cut-and-raised piece P5.

In the periphery of the cut hole P2 of the sheet P, as illustrated in FIGS. 5 and 6, cantilever pieces P7 and P8 are formed by the first slit L1 and the second slit L2. The cantilever piece P7 formed by the main slit L11 of the first slit L1 and the second slit L2 has a rectangular shape, and the free end side is made displaceable in the vertical direction using the punched hole P1 side as the base end. Moreover, the cantilever piece P8 formed by the sub slit L12 of the first slit L1 and the second slit L2 has a triangular shape, and the free end side is made displaceable in the vertical direction using a portion connecting the outer end of the first slit L1 and the distal end of the second slit L2 as the base end.

In a state where the cut-and-raised piece P5 is penetrated through the cut hole P2 and the sheets P are bound, as illustrated in FIGS. 5 and 6, the distal end P51 side of the cut-and-raised piece P5 is engaged with the first slit L1 and also, the edge from the wide width portion P56 of the cut-and-raised piece P5 to the base end P52 is engaged with the second slit L2. More specifically, regarding the first slit L1, engagement is made so that the distal end P51 of the cut-and-raised piece P5 is located on the one surface Pa side and the base end P52 of the cut-and-raised piece P5 and the boundary portion P53 are located on the other surface Pb side. Moreover, regarding the second slit L2, engagement is made so that an outer end P57 of the wide width portion P56 of the cut-and-raised piece P5 is located on the one surface Pa and the base end P52 of the cut-and-raised piece P5 and the boundary portion P53 are located on the other surface Pb side. In other words, in the edge from the wide width portion P56 of the cut-and-raised piece P5 to the base end P52, the outer end P57 side of the wide width portion P56 is located on the lower surface side of the cantilever piece P8 and the boundary portion P53 is located on the upper surface side of the cantilever piece P7.

Moreover, the wide width portion P56 is located on the side farther away from the punched hole P1 than a distal end L21 of the second slit L2 and its width dimension W3 is smaller than an inner dimension W1 of a window D3 which will be described later. Furthermore, the outer end P57 of the wide width portion P56 is located on the outer side of the second slit L2.

The binding machine 1 used when the sheets P are to be bound as above will be described by referring to FIGS. 1 to 13.

<Binding Machine>

This binding machine 1 is provided with, as illustrated in FIGS. 1 to 13, the punching blade 32 for punching the punched hole P1 while forming the cut-and-raised piece P5 in the plurality of sheets P, a cutting blade 33 provided adjacently to this punching blade 32 and punching the cut hole P2 for locking the distal end P51 side of the cut-and-raised piece P5, a base portion 2 for holding the punching blade 32 and the cutting blade 33, and a punch stand 4 disposed on this base portion 2 through a gap 35 for sheet insertion. By performing a punching operation so that the punching blade 32 and the cutting blade 33 held on the base portion 2 penetrate the sheets P inserted in the gap 35 for sheet insertion and protrude to the punch stand 4 side, the punched hole P1 and the cut hole P2 are formed in the sheets P, and by performing a withdrawing operation so that the cutting blade 33 and the punching blade 32 are returned to the base portion 2 side in a state where the distal end P51 side of the cut-and-raised piece P5 cut and raised from the punched hole P1 to the punch stand 4 side is engaged with the cutting blade 33, the cut-and-raised piece P5 is penetrated into the cut hole P2 and the sheets P are bound. In other words, this binding machine 1 makes the booklet B by joining the plurality of sheets P and is provided with the punching blade 32 and the cutting blade 33 for forming the punched hole P1 and the cut hole P2 by temporarily moving upward which is the projection side from a standby position (N), the base portion 2 for accommodating the punching blade 32 and the cutting blade 33 at the standby position (N), a slide member 31 capable of holding the punching blade 32 and the cutting blade 33 and elevating in the vertical direction which is a projecting/sinking direction with respect to the base portion 2, and the punch stand 4 disposed through the gap 35 for inserting the sheet P on the upward surface F14 side which is the outer surface side of this base portion 2. An operation lever 5 is rotatably attached to the base portion 2, and inside this base portion 2, a link mechanism 6 connected to the operation lever 5 is accommodated.

<Base Portion>

The base portion 2 is, as illustrated in FIGS. 1, 2, 12, and 13, composed of a base frame 21 provided with the slide member 31 and the link mechanism 6 disposed therein and a base cover 22 externally fitted in the lower side of the base frame 21.

Figure 1:
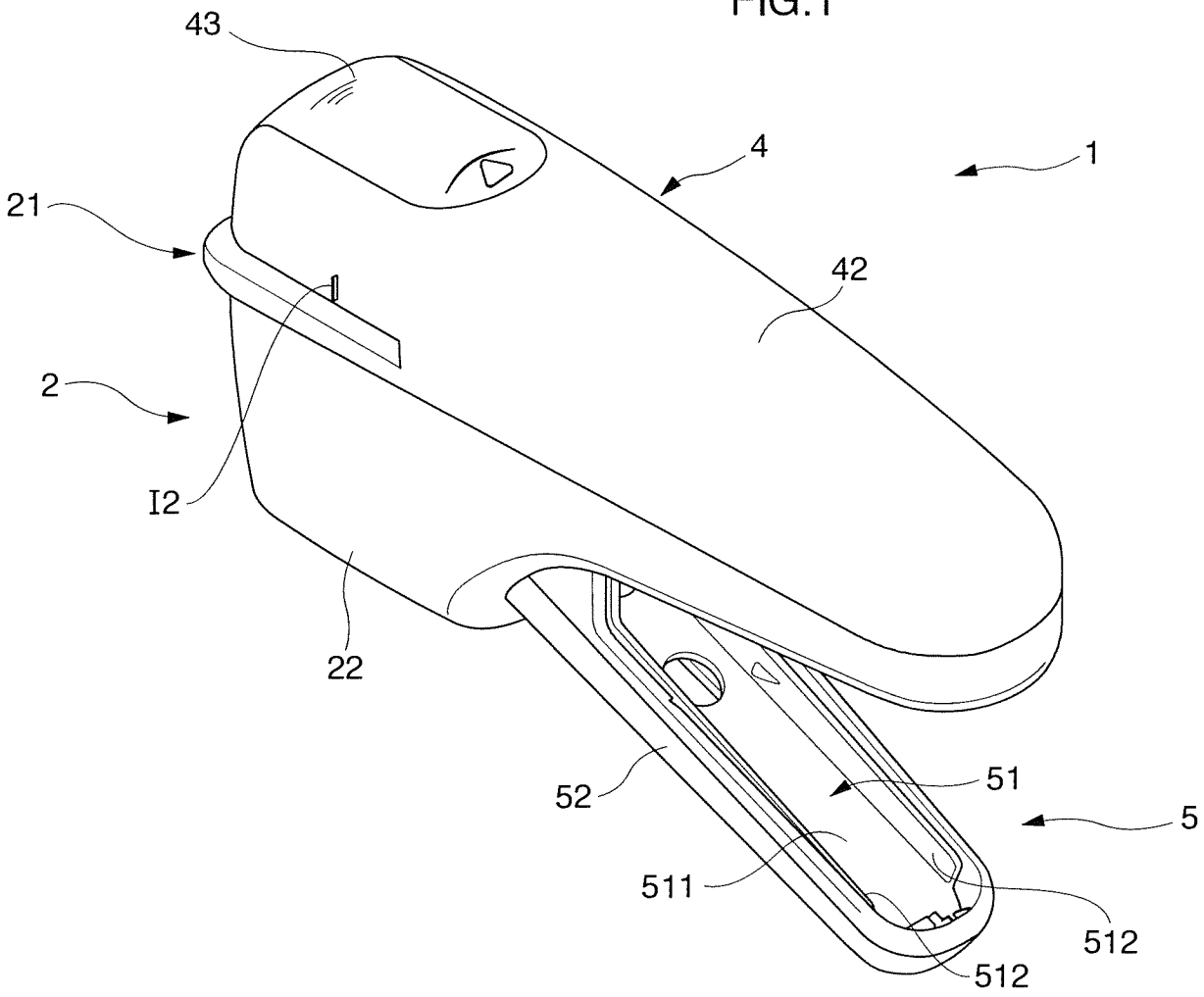
FIG. 1 is an entire perspective view of a binding machine illustrating a first embodiment of the present invention.
Figure 2:
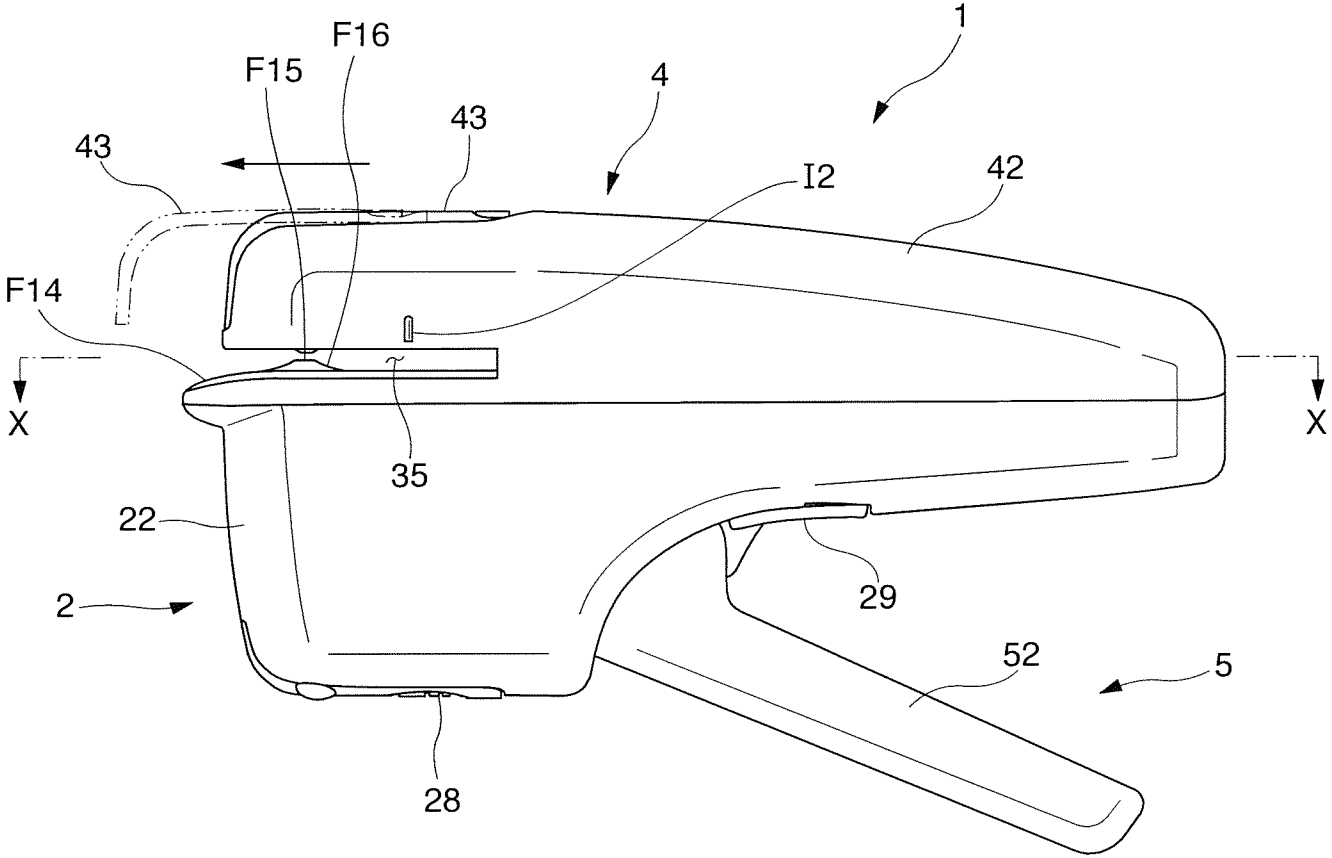
FIG. 2 is a side view of the binding machine of the embodiment.
Figure 12:
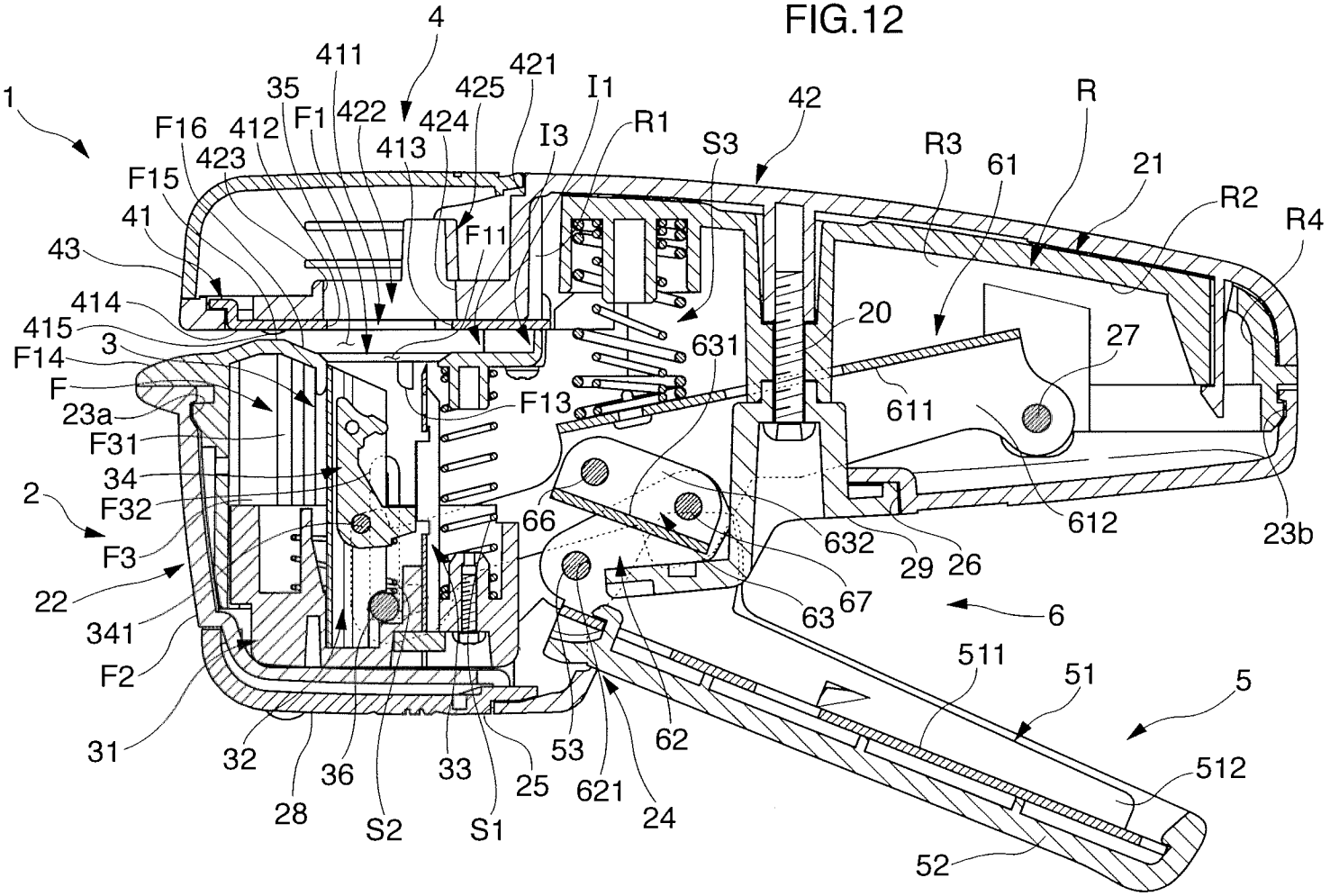
FIG. 12 is a sectional view taken along the line Z-Z in FIG. 3 in a state where an operation lever is not operated.
Figure 13:
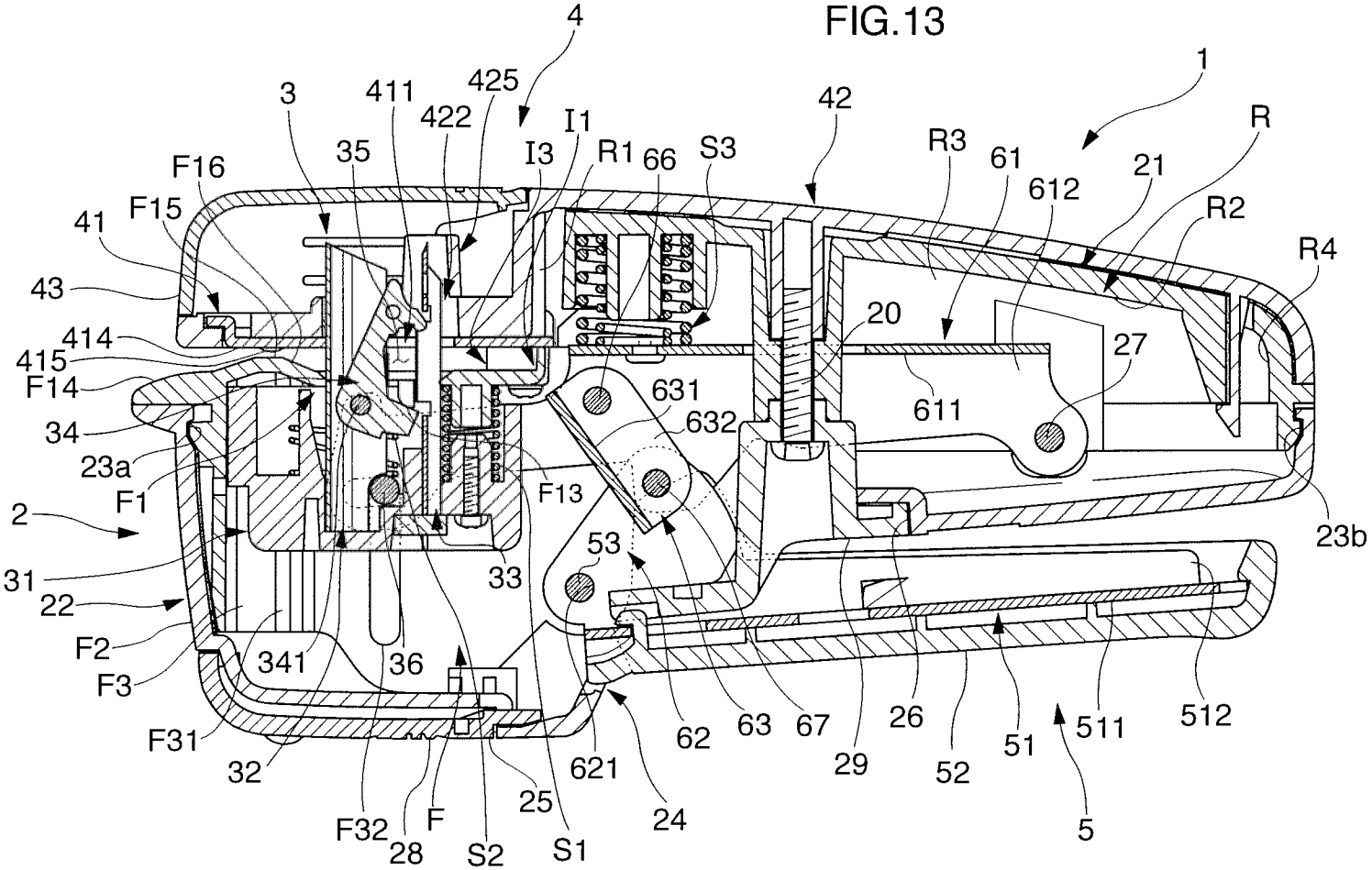
FIG. 13 is the sectional view taken along the line Z-Z in FIG. 3 in a state where an operation lever is operated.

The base frame 21 is composed of, as illustrated in FIGS. 1, 12, and 13, a front housing F forming the upward surface F14 of the base portion 2 and a rear housing R located above the operation lever 5 and forming a handle portion on which the hand is placed when the operation lever 5 is to be operated, integrally molded from a synthetic resin.

The front housing F is composed of, as illustrated in FIGS. 12 and 13, a top wall F1, a front wall F2 suspended from the front edge of this top wall F1, and right and left side walls F3 suspended from both right and left side edges of the top wall F1 and is provided with a space for accommodating a blade unit 3 therein. The top wall F1 has an opening F11 through which the punching blade 32 and the cutting blade 33 pass. On the lower surface side of this top wall F1, a bearing portion, not shown, for receiving a shaft 341 of an inner cam 34 which is provided in the vicinity of the edge of the opening F11 and will be described later and a locking wall F13 provided adjacently to this bearing portion and locking an arm 344 of the inner cam 34 are provided. The upward surface F14 which is an upper surface of this top wall F1 and a downward surface 414 of the punch stand 4 forms the gap 35 into which the sheet P is inserted. In this embodiment, a raised portion F15 for pressuring the joined portion P13 from the lower side is provided on a portion located closer to the sheet insertion side than the opening F11 of the upward surface F14 of the top wall F1. This raised portion F15 is formed integrally with the base frame 21 and is provided with an inclined surface F16 for guiding the cut-and-raised piece P5 when the sheet P inserted in the gap 35 is to be withdrawn. A rail groove F31 for guiding the slide member 31 in the vertical direction is provided in the side wall F3, and a long hole F32 for guiding a drive shaft 36 in the vertical direction is provided at the center. On this side wall F3, the operation lever 5 is attached rotatably in the vertical direction through a lower support shaft 53. Moreover, the gap 35 for sheet insertion into which the sheet P is to be inserted is formed between the upper surface of the top wall F1 of this front housing F and a punch plate 41 which will be described later.

The rear housing R has a shape suitable for the hand to be placed on as illustrated in FIGS. 4, 12, and 13 and is composed of a front wall R1 rising from the rear end of the top wall F1 of the front housing F, a top wall R2 extending rearward from the upper end of this front wall R1, right and left side walls R3 suspended from both right and left side ends of this top wall R2, and a rear wall R4 suspended from the rear end of the top wall R2 and is provided with a space for accommodating the link mechanism 6 therein. On the side wall R3, a first link member 61 is rotatably attached through an upper support shaft 27.

The base cover 22 is, as illustrated in FIGS. 1, 2, 12, and 13, to be externally fitted with the lower side of the base frame 21, and the base cover 22 and the base frame 21 are engaged with each other through engagement pawls 23*a* and 23*b* provided on a front end portion and a rear end portion, respectively. This base cover 22 is provided with a slide cover mounting portion 25 on the front side, a cap mounting portion 26 at the center and a window 24 for avoiding interference with the operation lever 5 is provided adjacently to this cap mounting portion 26. On the slide cover mounting portion 25, a slide cover 28 capable of being opened/closed is attached so as to remove paper powders collecting in the front housing F to the outside. Moreover, on the cap mounting portion 26, a cap 29 for mounting the base cover 22 on the base frame 21 is mounted. That is, by screwing a screw 20 penetrated in this cap 29 with a screw portion, not shown, provided on a top case 42, the top case 42 and the base cover 22 are detachably attached to the base frame 21.

In the base frame 21 configured as above, the blade unit 3 having the punching blade 32 and the cutting blade 33 is accommodated.

<Blade Unit>

The blade unit 3 is provided with, as illustrated in FIGS. 7, 8, 12, and 13, the slide member 31 capable of elevation while being guided by a rail groove F31 of the base frame 21 and maintaining a vertical attitude, the punching blade 32 mounted on this slide member 31, the cutting blade 33 disposed adjacently to this punching blade 32, the inner cam 34 disposed inside the punching blade 32 and pivotally supported on the slide member 31 rotatably through the shaft 341 between an initial attitude (S) accommodated in the punching blade 32 and a rotated attitude (K) protruding outside the punching blade 32, and a coil spring S2 rotating and biasing the inner cam 34 in a direction to self-returning to the initial attitude (S).

The slide member 31 has, as illustrated in FIGS. 7, 8, 12, and 13, a block shape provided with a protrusion 311 engaged with the rail groove F31 of the base frame 21 slidably in the vertical direction and is connected to the link mechanism 6 through the drive shaft 36. That is, this drive shaft 36 is engaged with a long hole 614 provided at the distal end of the first link member 61 of the link mechanism 6. The slide member 31 has a box shape which is open upward so that lower half portions of the punching blade 32 and the cutting blade 33 can be accommodated therein.

<Cutting Blade of Blade Unit>

Figure 9:
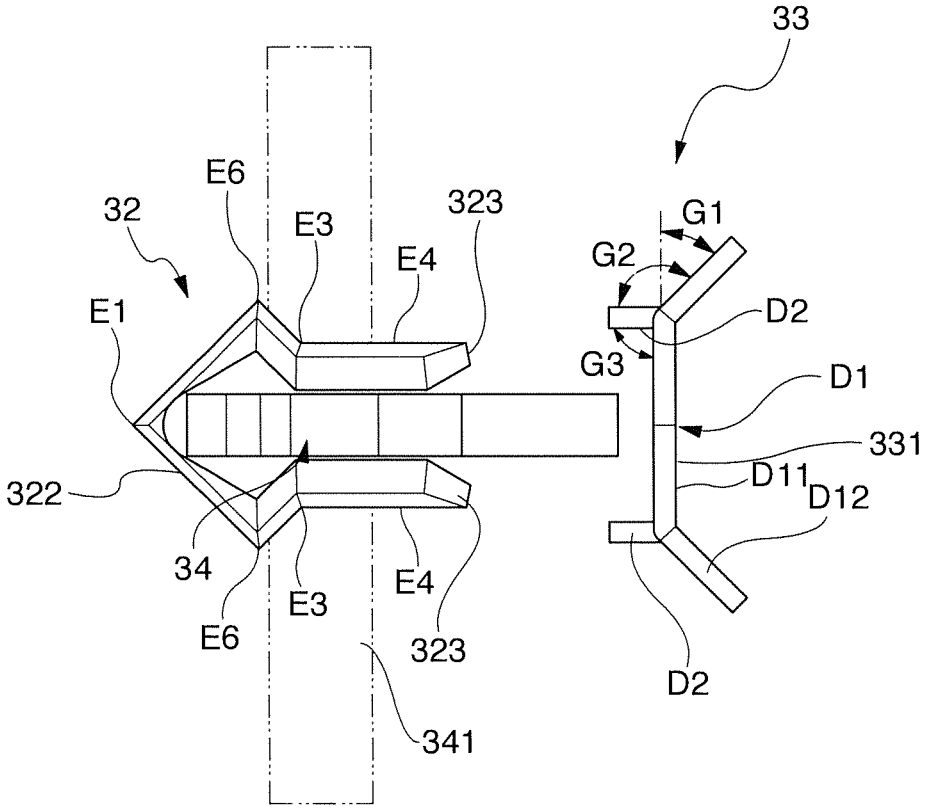
FIG. 9 is a plan view illustrating an essential part of the embodiment.
Figure 10:
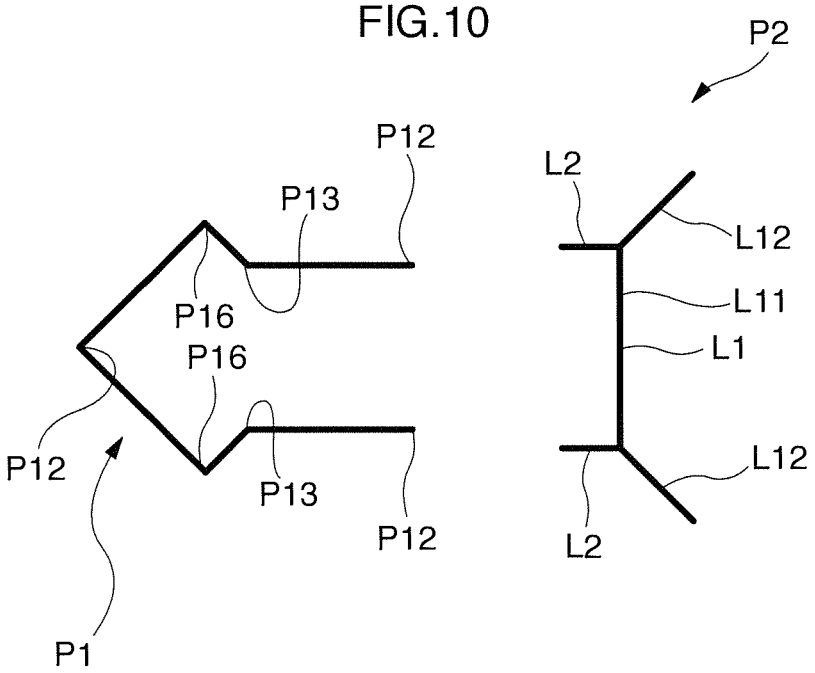
FIG. 10 is a plan view schematically illustrating a punched hole and a cut hole of the embodiment.

The cutting blade 33 is provided with a blade body 331 having a blade edge for forming the cut hole P2 having a clog shape as illustrated in FIG. 10. Specifically, the cutting blade 33 having this blade body 331 is, as illustrated in FIGS. 7 to 9 and FIGS. 11 to 13, created by applying punching and bending to a single sheet metal material and is provided with a first blade D1 for forming the first slit L1 and a second blade D2 for forming the second slit L2 extending from the middle of the first slit L1 in the direction of the punched hole P1. Moreover, in this embodiment, the first blade D1 is provided with the window D3 through which the cut-and-raised piece P5 punched from the sheet P is passed and with which the cut-and-raised piece P5 is engaged. In this embodiment, the first blade D1 is provided with a main blade D11 for forming the linear main slit L11 and a sub blade D12 for forming the sub slit L12 bent and extending in another direction from the both ends of this main slit L11, that is, a direction corresponding to this cutting blade 33 opposite to the side where the punching blade 32 is arranged.

The main blade D11 of the first blade D1 is divided into a lower blade portion D4 and an upper blade portion D5 having the blade main body 331 through the window D3 for receiving the inner cam 34, and the lower blade portion D4 and the upper blade portion D5 are structurally connected by the sub blade D12. In this embodiment, the sub blade D12 has its base end edge integrally continuing through the main blade D, and the second blade D2 is continuously formed at a portion corresponding to the window D3 at the base end edge of this sub blade D12. That is, this second blade D2 is cut and raised integrally from the window D3 by bending the sheet metal material at the bending line portion D6.

<Window of Cutting Blade>

Figure 7:
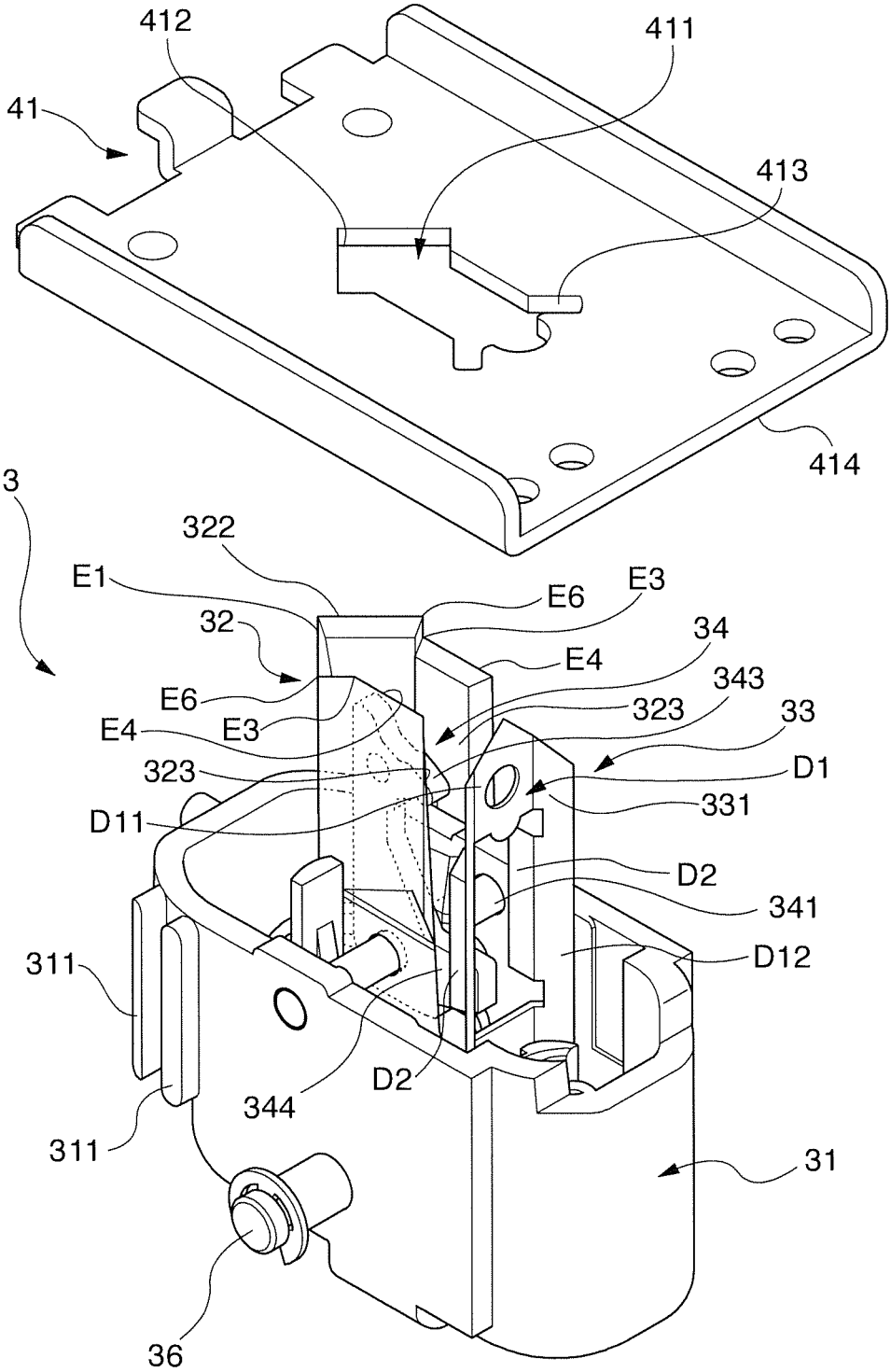
FIG. 7 is an exploded perspective view illustrating an essential part of the embodiment.
Figure 8:
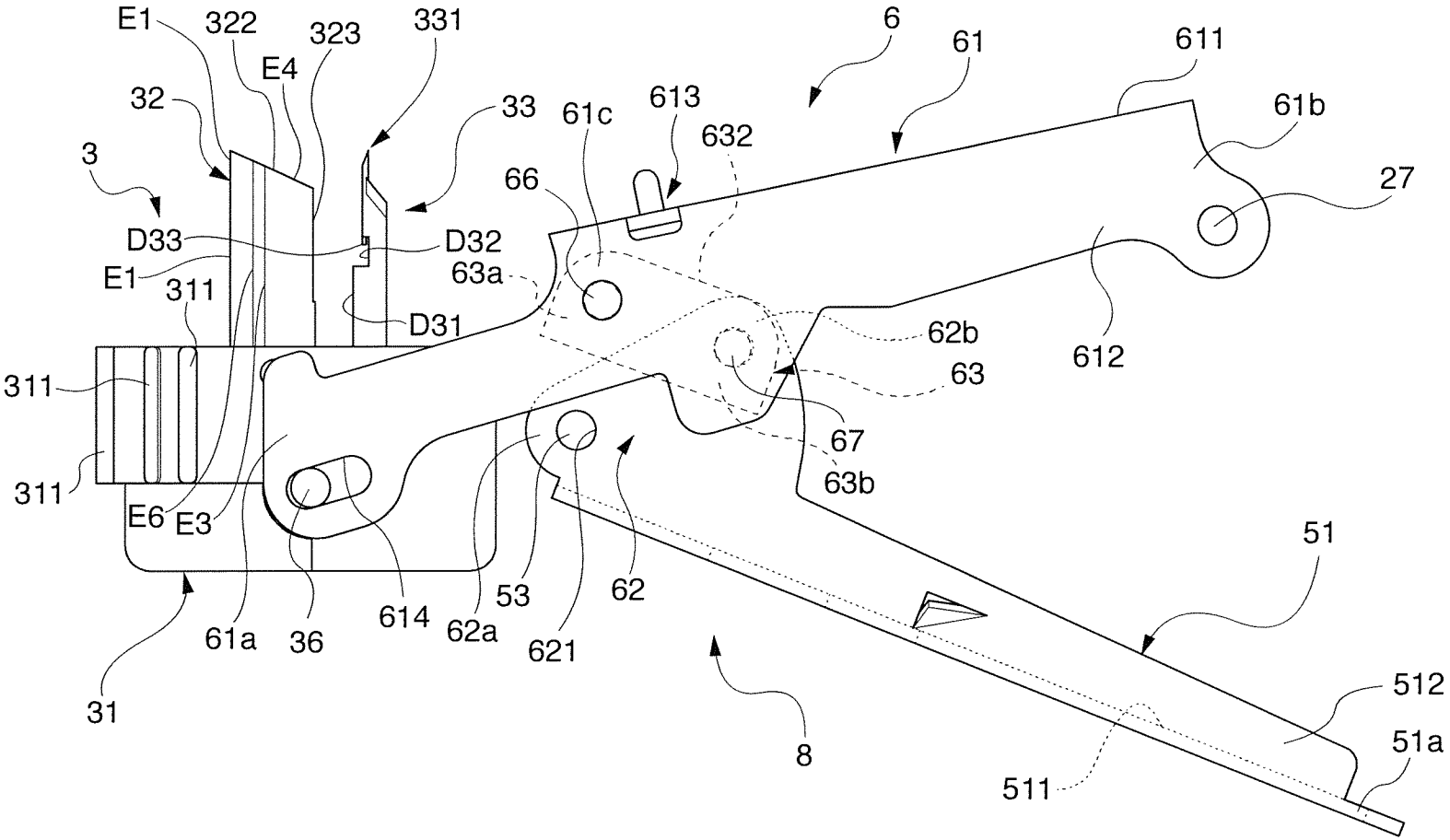
FIG. 8 is a side view illustrating a blade driving mechanism of the embodiment.
Figure 11:
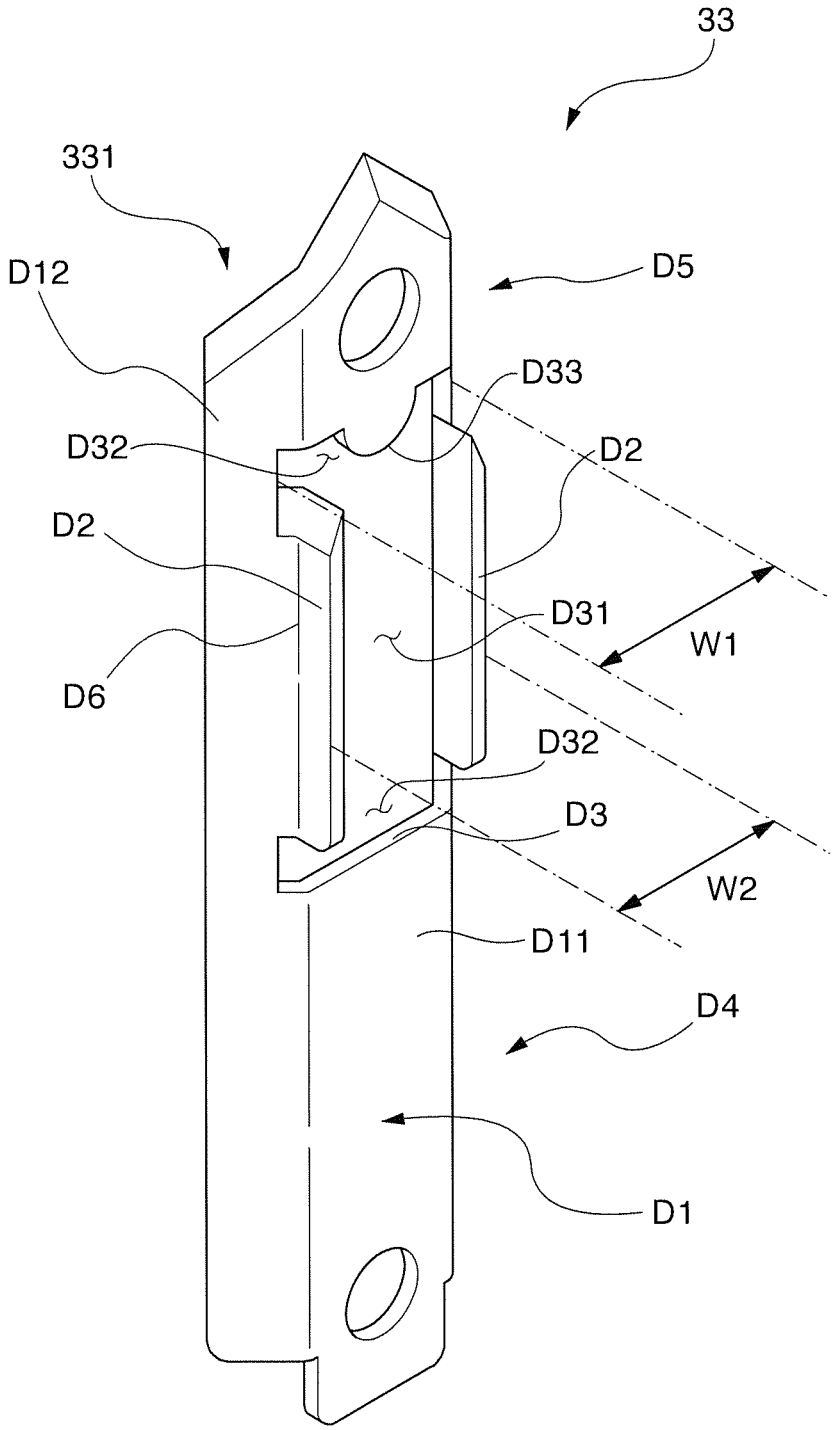
FIG. 11 is a perspective view illustrating a cutting blade of the embodiment.

The window D3 is formed of, as illustrated in FIGS. 7, 8, and 11, a reduced width portion D31 provided with the second blade D2 for forming the second slit L2 on the both right and left side edges and an enlarged width portion D32 provided adjacently to this reduced width portion D31. In this embodiment, the enlarged width portion D32 is provided on the both upper and lower sides sandwiching the reduced width portion D31, that is, on the distal end side and the base end side of the cutting blade 33 and has a structure in which the second blade D2 is not provided on the side edges thereof. Moreover, on the upper edge of the frame forming this window D3, a projection D33 for pushing the cut-and-raised piece P5 into the cut hole P2 is provided. This projection D33 has a semicircular shape and is formed integrally from the upper edge of the window D3.

The dimension of this window D3 has, as illustrated in FIGS. 5 and 11, the following relationship with the dimension of the cut-and-raised piece P5. That is, the outer dimension W2 of the reduced width portion D31 of the window D3 in this embodiment is set smaller than the width dimension W3 of the enlarged width portion P56 of the cut-and-raised piece P5, and the inner dimension W1 of the enlarged width portion D32 of the window D3 is set larger than the width dimension W3 of the enlarged width portion P56 of the cut-and-raised piece P5.

Figure 36:
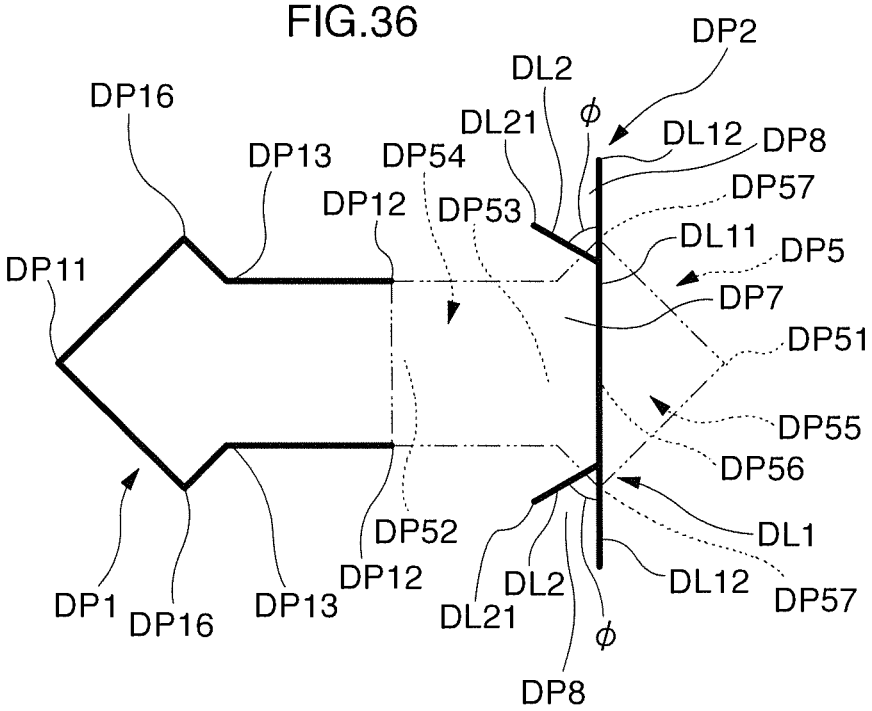
FIG. 36 is a plan view schematically illustrating the punched hole, the cut hole, and a cut-and-raised piece of another embodiment of the present invention.

The second blade D2 is subjected to, as illustrated in FIGS. 7, 9, and 11, preliminary cutting-and-raising work so as to form an angle G2 less than 180 degrees with respect to the sub blade D12 before cutting-and-raising work. As a result, the sub blade D12 is bent by an angle G1 somewhat smaller than a right angle, and a cut-and-raised angle G3 of the second blade D2 with respect to the main blade D is set to approximately 90 degrees in the end, but it may be such as what is illustrated in FIG. 36 which will be described later.

The blade main body 331 of this cutting blade 33, that is, each of the blade formed on the first blade D1 and the blade formed on the second blade D2 has a single-edged structure having a cutting edge on one side in the thickness direction of the material.

<Punching Blade of Blade Unit>

The punching blade 32 can, as illustrated in FIGS. 7 to 9, 12, and 13, form the cut-and-raised piece P5 provided with the wide width portion P56 on the distal end region P55 and is supported by the slide member 31 of the blade unit 3 through the shaft 341 provided in the intermediate portion. This punching blade 32 is formed by applying punching and bending work to a single sheet metal material and is provided with blade main bodies 322 and 323 for punching the punched hole P1 in the distal end edge and the side end edge thereof, and the shaft 341 is supported by the slide member 31 of the blade unit 3. That is, the punching blade 32 has the blade main body 322 provided on the distal end edge having a shape corresponding to the punched hole P1 and the blade main body 323 provided on the side end edge forming the base end of the punched hole P1.

The blade main body 322 is provided with a distal end region forming portion for forming the distal end region P55 of the cut-and-raised piece P5 and a base end region forming portion E4 for forming the base end region P54 of the cut-and-raised piece P5 formed continuously to this distal end region forming portion. The distal end region forming portion is for forming a distal end region slit of the punched hole P1. In other words, the distal end region forming portion is provided with a bent portion E1 at a spot corresponding to the distal end corner portion of the cut-and-raised piece P5 and bent portions E6 forming a pair at spots corresponding to side edge corner portions of the wide width portion P56 of the cut-and-raised piece P5. Each of the base end region forming portions E4 has linear shape, and a separation distance between the base end region forming portions E4 forming a pair is kept constant. That is, these base end region forming portions E4 are in parallel with each other. At the distal end in the projecting/sinking direction of the blade main body 322, a blade edge forming an arrow shape on a plan view for punching and forming the shape of the punched hole P1 is provided. In more detail, this blade main body 322 is provided with the substantially parallel base end region forming portions E4 for forming the base end region P54 of the cut-and-raised piece P5, a boundary portion forming portion E3 continuing to this base end region forming portion E4 and provided with a corner portion forming the boundary portion P53 of the cut-and-raised piece P5, and the distal end region forming portion having the bent portions E6 each being provided with a corner portion for forming the wide width portion P56 in the distal end region P55 of the cut-and-raised piece P5 and a bent portion E1 provided with a corner portion for forming the distal end P51 of the cut-and-raised piece P5. This blade main body 322 has a blade edge continuing in a penetrating direction into the sheet P in the base end region forming portion E4, the boundary portion forming portion E3, and the distal end region forming portion. In a space surrounded by these blade edges, that is, in the internal space of the punching blade 32, the inner cam 34 for inserting the cut-and-raised piece P5 into the window D3 provided in the cutting blade 33 is provided.

<Inner Cam of Blade Unit>

The inner cam 34 is provided with, as illustrated in FIGS. 7, 9, 12, and 13, the shaft 341 at the base end and a pushing-out portion 343 for inserting the cut-and-raised piece P5 into the window D3 provided in the cutting blade 33 at the distal end, and the shaft 341 is supported by the punching blade 32 and the slide member 31. On the base end of the inner cam 34, the arm 344 for rotating the inner cam 34 is projected. This inner cam 34 is set so that the upper surface of the arm 344 is brought into contact with the lower edge of the locking wall F13 provided on the base frame 21 when the slide member 31 moves upward. It is configured such that, if the slide member 31 further moves upward after the contact, the inner cam 34 is rotated to the rotated attitude (K) while the shaft 341 of the base end is supported by the bearing portion provided on the base frame 21. That is, it is configured such that, after the punched hole P1 is formed in the sheet P, the inner cam 34 is rotated in the direction of the cutting blade 33 while pressing the cut-and-raised piece P5.

The blade unit 3 formed as above is configured to be moved upward through the link mechanism 6 accommodated in the base frame 21 by operating the operation lever 5.

<Operation Lever>

The operation lever 5 is formed of, as illustrated in FIGS. 1, 2, 8, 12, and 13, a lever plate 51 made of metal and a lever cover 52 made of resin to be attached to the outside of this lever plate 51. The lever plate 51 is made by bending a sheet metal material and has a bottom wall 511 and side walls 512 rising from the both side edges of this bottom wall 511.

<Link Mechanism>

The link mechanism 6 is provided with, as illustrated in FIGS. 8, 12, and 13, a first link member 61 whose distal end 61*a* is connected to the slide member 31 through the drive shaft 36 and a rear end 61*b* is connected to the base frame 21 through the upper support shaft 27 and second and third link members 62 and 63 for pushing up the first link member 61 using a lower support shaft 53 located below this first link member 61 and held on the base frame 21 as a shaft.

Here, the second and third link members 62 and 63 are arranged so as to perform a toggling servo action. That is, the second link member 62 has the base end 62*a* connected to the base frame 21 through the lower support shaft 53 and is rotated around the base end 62*a* when the operation lever 5 is rotated and operated upward. This second link member 62 is provided integrally with the operation lever 5 and uses the lower support shaft 53 common with the support shaft of the operation lever 5. Moreover, the third link member 63 connects a rotating end 62*b* of the second link member 62 and an intermediate 61*c* of the first link member 61 to each other. Specifically, this third link member 63 pivotally attaches one end 63*a* to the first link member 61 through a first connecting shaft 66 and pivotally attaches the other end 63*b* to the rotating end 62*b* of the second link member 62 through a second connecting shaft 67. Therefore, the second connecting shaft 67 is not directly provided on the core of the operation lever 5 substantially along the bottom wall 511 of the lever plate 51 but is provided at a position away from the core of the operation lever 5 through the second link member 62. That is, the positional relationship of the operation lever 5 and the third link member 63 is set so that the second connecting shaft 67 is located closer to the first link member 61 side than the core of the operation lever 5. In other words, it is set such that the second connecting shaft 67 is arranged between an axis connecting the lower support shaft 53 of the operation lever 5 and the rotating end 51*a* rotating around this support shaft 53 and an axis connecting the upper support shaft 27 of the first link member 61 and the distal end 61*a* which is a rotating end rotating around this support shaft 27.

The first link member 61 is made of metal and provided with a top wall 611 and right and left side walls 612 suspended from the both right and left side edges of this top wall 611 as illustrated in FIGS. 4, 8, 12, and 13. A spring holding portion 613 for arranging a coil spring S3 arranged between this top wall 611 and the top wall R2 of the rear housing R of the base frame 21 is provided on the top wall 611, and the first link member 61 is biased downward by this coil spring S3. On the front end portions of the right and left side walls 612, a long hole 614 for guiding the drive shaft 36 is provided.

The second link member 62 is integrally provided on the side wall 512 of the lever plate 51 as illustrated in FIGS. 8, 12, and 13. That is, the second link member 62 and the lever plate 51 of the operation lever 5 in this embodiment are an integral construction formed by a common sheet metal material and are provided with a common through hole 621 through which the lower support shaft 53 is penetrated.

The third link member 63 has, as illustrated in FIGS. 8, 12, and 13, a channel shape made of metal and provided with a bottom wall 631 and right and left side walls 632 rising from the both right and left side edges of this bottom wall 631.

<Punch Stand>

The punch stand 4 has, as illustrated in FIGS. 1 to 3, 12, and 13, blade through holes 411 and 422 through which the punching blade 32 and the cutting blade 33 can be inserted and a window 421 through which the sheet P can be visually recognized through these blade through holes 411 and 422. Specifically, this punch stand 4 is provided with a top case 42 having a flat box shape and a punch plate 41 on the lower part of this top case 42 for punching the punched hole P1 in the sheet P in collaboration with the punching blade 32. This top case 42 has the window 421 opened upward and forward. This top case 42 is made of resin and provided with a punching portion 423 through which the punching blade 32 passes and a passage hole 424 through which the cutting blade 33 passes, and a wall 425 for suppressing drop of chips of the sheet P from the blade through hole 422 is formed by rising from the edges of the punching portion 423 and the passage hole 424.

The wall 425 is continuously formed so as to form a bank shape along the edges of the punching portion 423 and the passage hole 424. In more detail, this wall 425 has a low wall provided on a front part and a high wall 426 provided on a rear part so as to have a height difference. This high wall 426 also plays a role of preventing or suppressing the finger of a user from accidentally entering the upper part of the blade through hole 422 and touching the punching blade 32 and the cutting blade 33 when a window cover 43 which will be described later is opened to a certain position. Moreover, the rear side of the wall 425 of the top case 42 is fitted so as to cover the outer side of the rear housing R of the base frame 21.

The punch plate 41 is made of metal and is provided with a punching portion 412 for punching the punched hole P1 in the sheet P in collaboration with the punching blade 32 and a passage hole 413 through which the cutting blade 33 passes, as illustrated in FIGS. 7, 12, and 13, and is attached to the base frame 21 by using a screw and a positioning pin, not shown, in a state overlapped with the lower surface of the top case 42. In this embodiment, on a portion located closer to the sheet insertion side than the blade through hole 411 in the downward surface 414 of the punch plate 41, a raised portion 415 for sandwiching the joined portion P13 from the upper side is provided.

Figure 3:
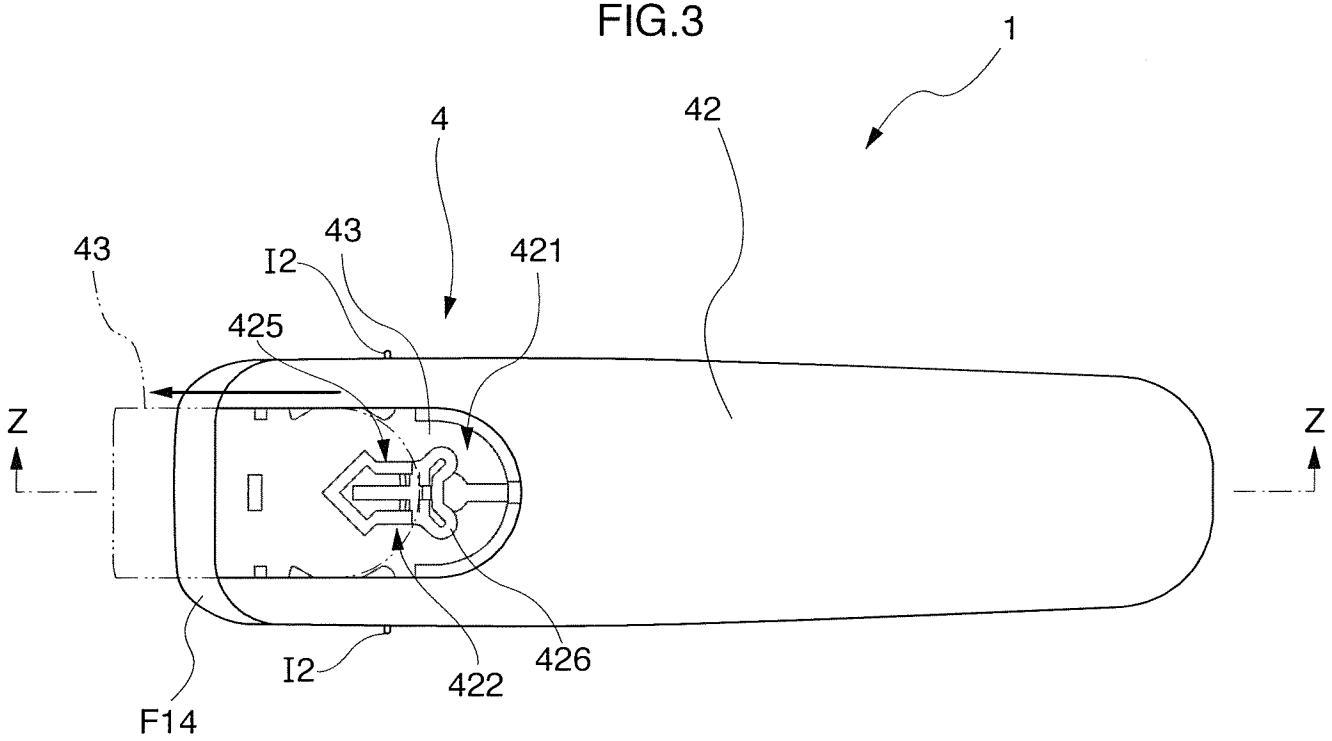
FIG. 3 is a plan view of the binding machine of the embodiment.

The window 421 is, as illustrated in FIGS. 3, 12, and 13, covered by the transparent window cover 43. This window cover 43 is attached capable of being opened/closed in order to remove paper chips collecting in the top case 42 to the outside. Moreover, this window cover 43 is set to stop at a certain position so that the hand of the user does not reach the punching blade 32 and the cutting blade 33 when the window cover is opened. Specifically, as indicated by a two-dot chain line in FIGS. 2 and 3, the window cover covers the upper parts of the punching portions 412 and 423 of the punch plate 41 and the top case 42 and also can be opened to such a position that the upper parts of the passage holes 413 and 424 are exposed. That is, this window cover 43 is provided above the wall 425 of the top case 42 covers the upper side of the low wall and can be opened to the position that the upper part of the high wall 426 is exposed.

In the binding machine 1 as above, as illustrated in FIGS. 4, 12, and 13, a positioning portion I1 is formed for positioning the sheet P by bringing the corner portion P4 of the sheet P into contact with the portion with which the sheet P inserted into the gap 35 for sheet insertion is brought into contact, that is, the locking wall I3 arranged in the depth of the gap 35. The locking wall I3 regulates an insertion amount when one side of the sheet P is inserted. This locking wall I3 has a function as a punch plate mounting seat provided on the front end of the rear housing R of the base portion 2, and the punch plate 41 of the punch stand 4 is attached to the upper surface of this locking wall I3. At the center part of the locking wall I3, the positioning portion I1 formed by cutting the locking wall I3 into a shape of an isosceles right triangle on plan view is provided. Moreover, on the both side faces of the binding machine 1, as illustrated in FIGS. 1 to 4, a mark I2 for checking the positioned state of the sheet P positioned by the positioning portion I1 is provided. Specifically, on the outer surface of the top case 42 of the punch stand 4, the mark I2 for suggesting the attitude of the sheet P when it is accurately positioned by the positioning portion I1 is provided. This mark I2 is a vertical strip-shaped protrusion provided on a portion corresponding to an intersection between the side of the sheet P and the outer surface of the top case 42 on plan view.

The blade driving mechanism 7 in this embodiment is, as illustrated in FIGS. 14 to 17, provided on the base portion 2 and operates the punching blade 32 and the cutting blade 33 in the vertical direction by using an operation force applied to the operation lever 5 and in more detail, is mainly composed of the slide member 31 holding the punching blade 32 and the cutting blade 33 and capable of elevation in the vertical direction with respect to the base portion 2, a blade striking mechanism 8 for operating this slide member 31 upward to a punched position (C) where the punching blade 32 and the cutting blade 33 penetrate the sheet P by the operation force applied to the operation lever 5 and a blade withdrawing mechanism 9 for returning the slide member 31 to the standby position (N) where the punching blade 32 and the cutting blade 33 are withdrawn from the sheet P.

In more detail, the blade striking mechanism 8 moves the slide member 31 holding the punching blade 32 and the cutting blade 33 upward by using the operation force applied to the operation lever 5 and has the punching blade 32 and the cutting blade 33 penetrate into the sheet P set in the gap 35 on the upward surface F14 side of the base frame 21 as illustrated in FIG. 8 and is mainly composed of the link mechanism 6 disposed between the operation lever 5 and the slide member 31.

Figure 16:
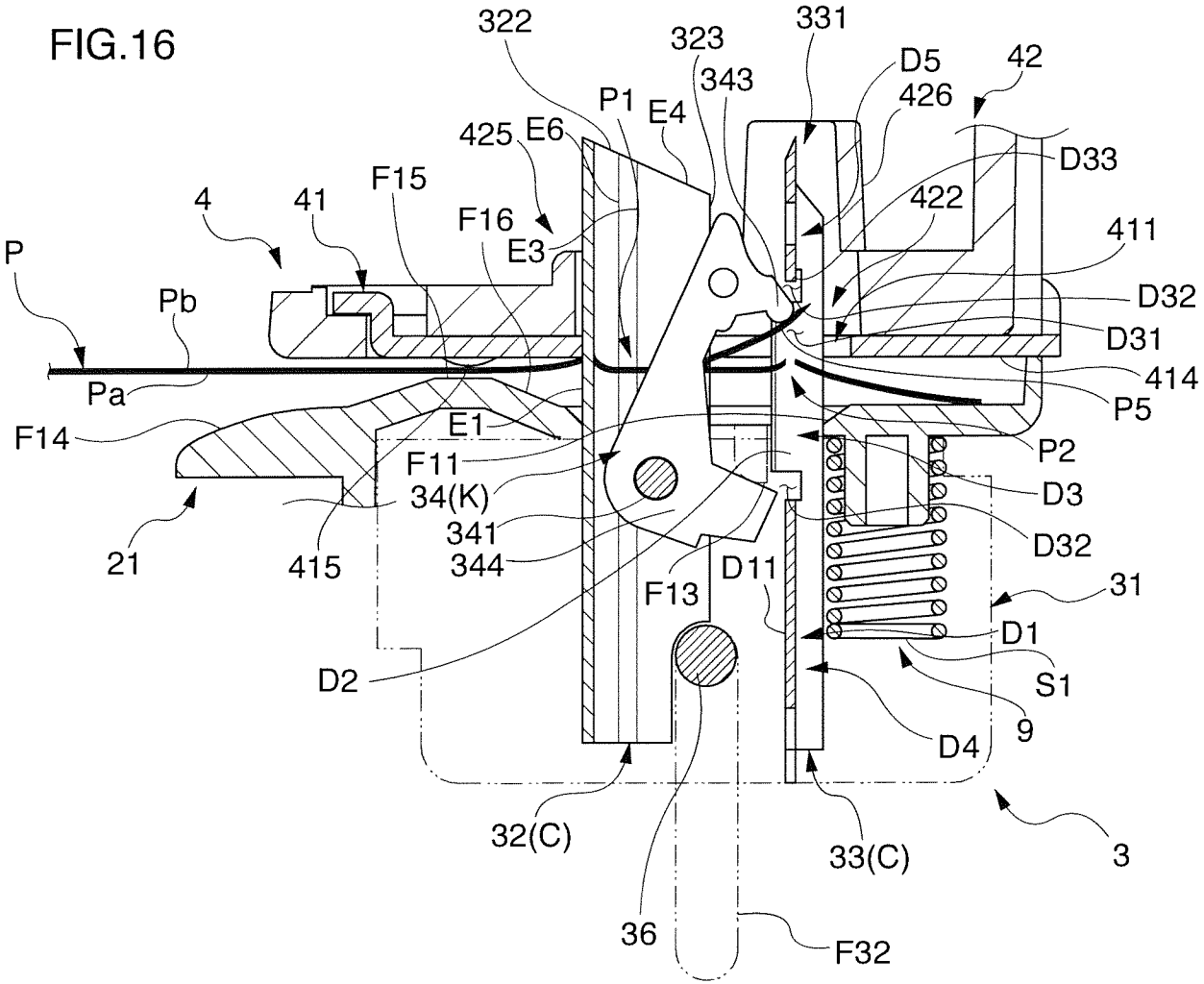
FIG. 16 is a schematic diagram illustrating an operation of the binding machine of the embodiment.

Moreover, the blade withdrawing mechanism 9 in this embodiment is mainly composed of, as illustrated in FIG. 16, the coil spring S1 which is an elastic body for biasing the slide member 31 holding the punching blade 32 and the cutting blade 33 downward by using the base frame 21 as a footing and the coil spring S3 which is an elastic body for biasing the first link member 61 downward by using the base frame 21 as a footing.

By connecting the slide member 31 and the operation lever 5 by the link mechanism 6 as in this embodiment, the performances of the blade withdrawing mechanism 9 can be further improved. That is, even if the number of sheets P is large and the cut-and-raised piece P5 cannot be withdrawn to the one surface Pa side of the sheet P only by the forces of the coil spring S1 and coil spring S3, by applying a downward operation force to the operation lever 5, the withdrawal can be completed.

<Operation Explanation>

Subsequently, an operation of this binding machine 1 will be described.

Figure 14:
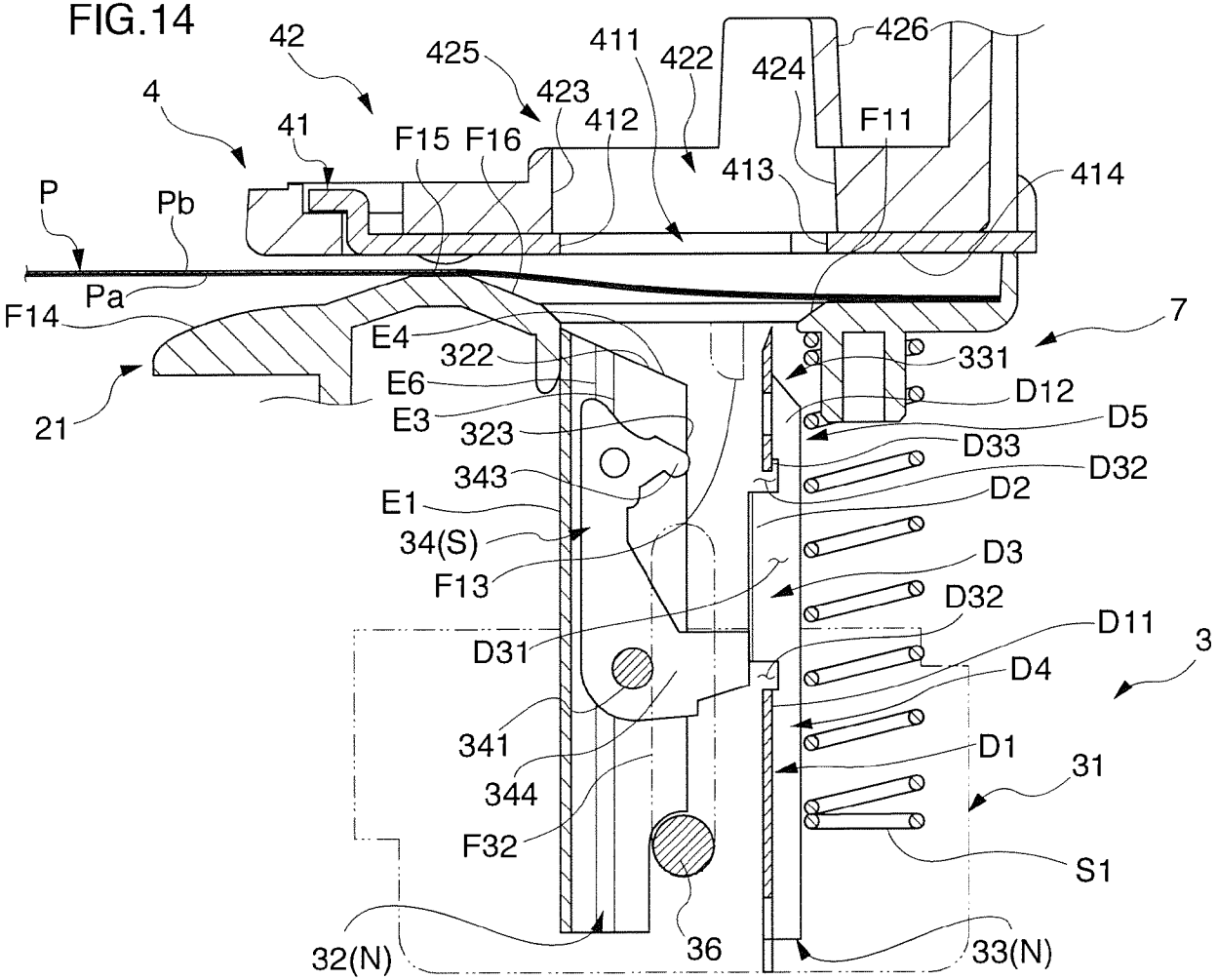
FIG. 14 is a schematic diagram illustrating an operation of the binding machine of the embodiment.
Figure 15:
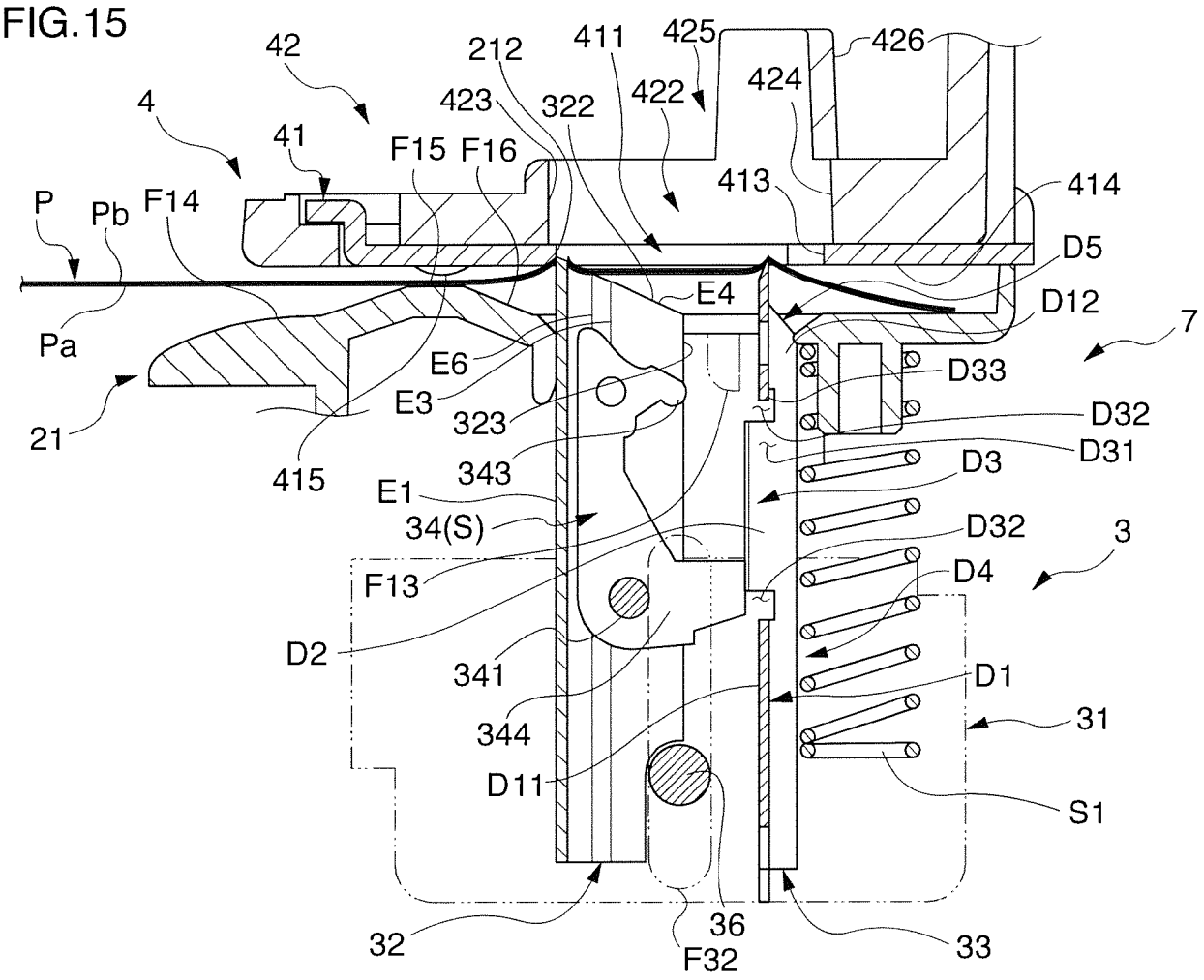
FIG. 15 is a schematic diagram illustrating an operation of the binding machine of the embodiment.

While the operation lever 5 is not operated, as illustrated in FIG. 14, the slide member 31 is held at a lower-limit position, and the initial attitude (S) in which the inner cam 34 is accommodated in the punching blade 32 is kept. In this state, the stacked plurality of sheets P are inserted into the depth of the gap 35 formed between the upward surface F14 of the base frame 21 and the downward surface 414 of the punch plate 41. Then, from above the window cover 43, the positions of the punched hole P1 and the cut hole P2 punched in the sheets P through the blade through holes 411 and 422 are checked. Moreover, from the side face side of the binding machine 1, by using the mark I2, the positioned state of the sheets P positioned by the positioning portion I1 is checked. Then, by operating the operation lever 5 upward, the force applied to this operation lever 5 is converted to the upward movement of the slide member 31 and is transmitted through the link mechanism 6.

In more detail, by operating the operation lever 5 upward, the lever plate 51 of this operation lever 5 is rotated and operated around the lower support shaft 53 and the second link member 62 provided integrally with this lever plate 51 is also rotated and operated upward around the lower support shaft 53. As a result, the second connecting shaft 67 provided on the rotating end side of this second link member 62 is moved in the direction of the first link member 61, that is, upward and front direction. The third link member 63 connected through the second connecting shaft 67 pushes up the first link member 61 while standing with the rotational operation of the second link member 62. That is, the first connecting shaft 66 provided on the rotating end side of the third link member 63 moves in a direction to push the center 61*c* for the first link member 61 upward against the biasing force of the coil spring S3. As a result, the first link member 61 rotates and operates around the upper support shaft 27, and thus, its front end portion 61*a* moves upward.

As described above, the force which operated the operation lever 5 upward is transmitted to the drive shaft 36 through the second link member 62, the third link member 63, and the first link member 61. As a result, the slide member 31 is moved upward.

When the slide member 31 begins to move upward, first, the coil spring S1 disposed between the bottom wall of the slide member 31 and the top wall F1 of the front housing F of the base frame 21 is compressed, and the slide member 31 rises against the biasing force of this coil spring S1. After that, the distal ends of the punching blade 32 and the cutting blade 33 attached to this slide member 31 are brought into contact with the one surface Pa of the sheets P and pushed up to a position where the sheets P are pressed onto the punch plate 41. Then, by further operating the operation lever 5 upward from this position, keeping a state where the sheets P are pressed onto the punch plate 41 by the blade main bodies 322 and 331 of the punching blade 32 and the cutting blade 33, going through the state illustrated in FIG. 15, the punching blade 32 and the cutting blade 33 penetrate the sheets P, and the punched hole P1 and the cut hole P2 are punched in the sheets P. After the punching, if the punching blade 32 and the cutting blade 33 further rise, as illustrated in FIG. 16, the arm 344 of the inner cam 34 disposed in the punching blade 32 is brought into contact with the locking wall F13 and the inner cam 34 is rotated to the rotated attitude (K) against the biasing force of the coil spring S2 disposed between the inner cam 34 and the slide member 31. As a result, the distal end P51 side of the cut-and-raised piece P5 cut and raised to the other surface Pb side of the sheets P from the punched hole P1 is inserted into the window D3 of the cutting blade 33.

Figure 17:
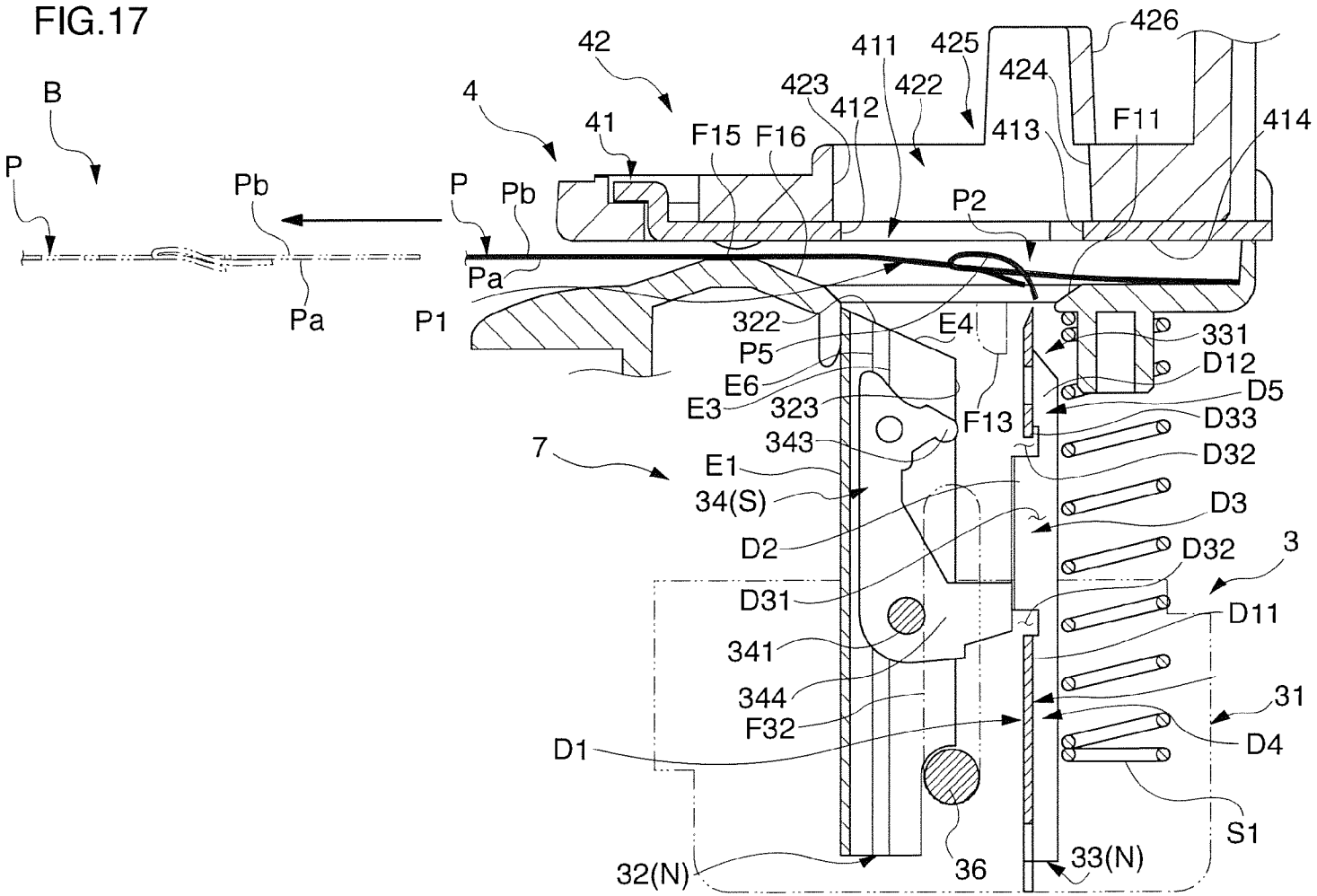
FIG. 17 is a schematic diagram illustrating an operation of the binding machine of the embodiment.

Subsequently, if the operation to the operation lever 5 is released, the inner cam 34 returns to the initial attitude (S) from the rotated attitude (K) by the biasing of the coil spring S2. Then, the punching blade 32 and the cutting blade 33 move downward on the sinking-in side by biasing of the coil spring 51 and the coil spring S3, and as illustrated in FIG. 17, the punching blade 32 and the cutting blade 33 are withdrawn from the sheets P while the sheets P are separated away from the punch plate 41. At this time, the cut-and-raised piece P5 inserted into the window D3 of the cutting blade 33 passes through the cut hole P2 and is withdrawn to the one surface Pa side of the sheets P, so that the plurality of sheets P are joined by this cutting blade 33. By withdrawing the sheets P from the binding machine 1 in this state, in the middle of the process, they are forcedly guided by the guiding action of the inclined surface F16 into the narrow gap formed between the raised portion F15 of the base frame 21 and the raised portion 415 of the punch plate 41, the joined portion P3 of the sheets P is compressed and deformed in the thickness direction, and as indicated by a two-dot chain line in FIG. 17, the above-described booklet B is completed. If the punching blade 32 and the cutting blade 33 cannot be withdrawn to the one surface Pa side of the sheets P only by the elastic forces of the coil spring S1 and the coil spring S3, it is only necessary to aid the withdrawal by operating the operation lever 5 downward.

Subsequently, by using FIGS. 18 to 32, engagement between the cut-and-raised piece P5 and the cut hole P2 will be described in detail. In the following, FIGS. 18 to 32 schematically depict only the sheets P and the cutting blade 33 among the elements constituting the blade driving mechanism 7 in order to explain the engagement. Also regarding the cutting blade 33, unlike the cutting blade 33 in the above-described embodiment but that with the linear first slit L1, that is, the blade in which the main slit L11 and the sub slit L12 are linear will be used for the convenience of explanation.

Figure 18:
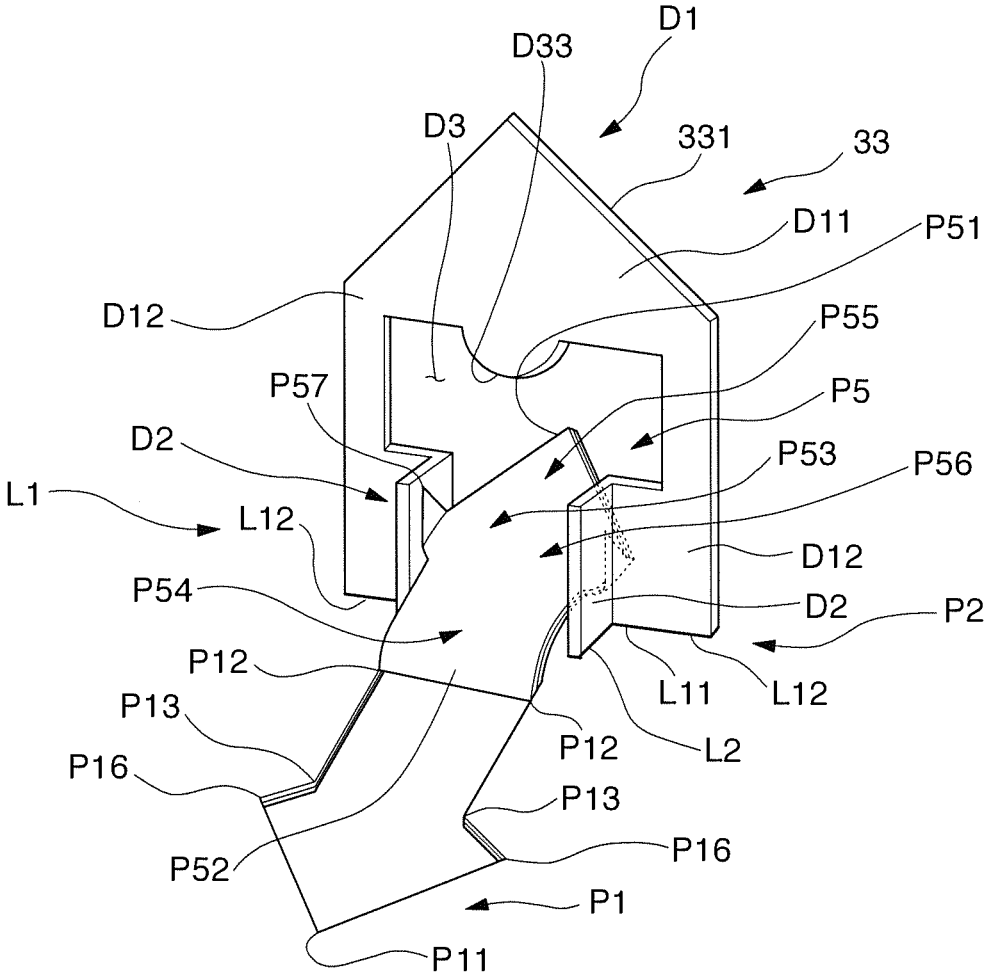
FIG. 18 is an explanatory diagram illustrating an operation of the essential part in the binding machine of the embodiment.
Figure 19:
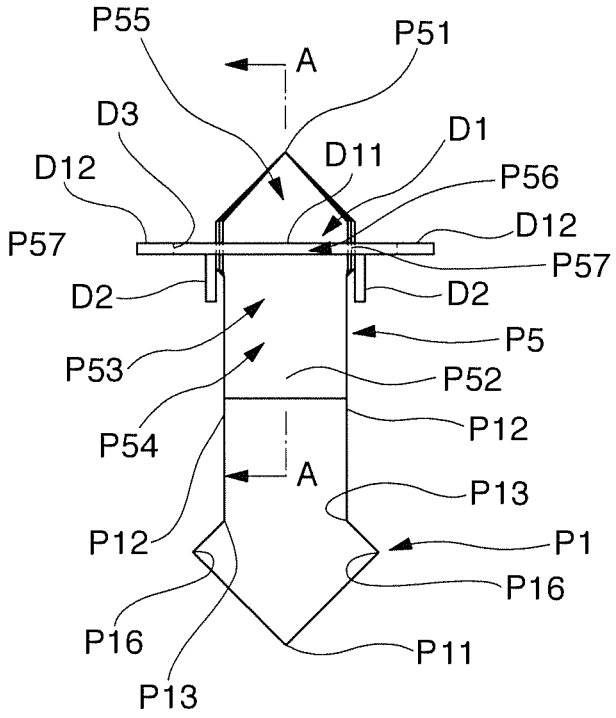
FIG. 19 is an explanatory diagram illustrating an operation of the essential part in the binding machine of the embodiment on a plane.
Figure 20:
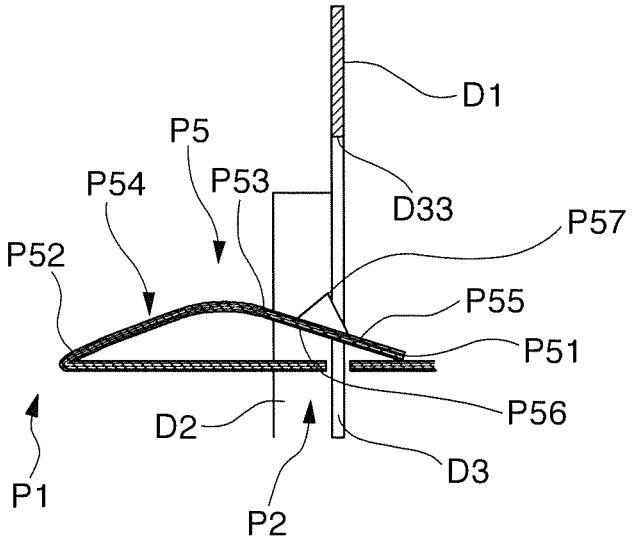
FIG. 20 is an explanatory sectional diagram taken along the line A-A illustrating an operation of the essential part in the binding machine of the embodiment.

First, if the cutting blade 33 is at the punched position (C), as illustrated in FIGS. 18 to 20, the distal end P51 side of the cut-and-raised piece P5 cut and raised to the other surface Pb side of the sheets P from the punched hole P1 is inserted into the window D3 of the cutting blade 33. In more detail, when the cutting blade 33 has reached the uppermost movable end, the inner cam 34 enters the rotated attitude (K), and the cut-and-raised piece P5 is inserted into the window D3 of the cutting blade 33, while the inner cam 34 itself is also inserted into the window D3. At that time, the distal end region P55 of the cut-and-raised piece P5 passes through the wide width portion D32 of the window D3 and then, reaches the reduced width portion D31 provided adjacently to this wide width portion D32. Since the cut-and-raised piece P5 pushed into this reduced width portion D31 has the both right and left end sides of the distal end region P55 with the width dimension W3 larger than the reduced width portion D31, it is in a folded state along the second blades D2 provided on the side edges of the reduced width portion D31.

Figure 21:
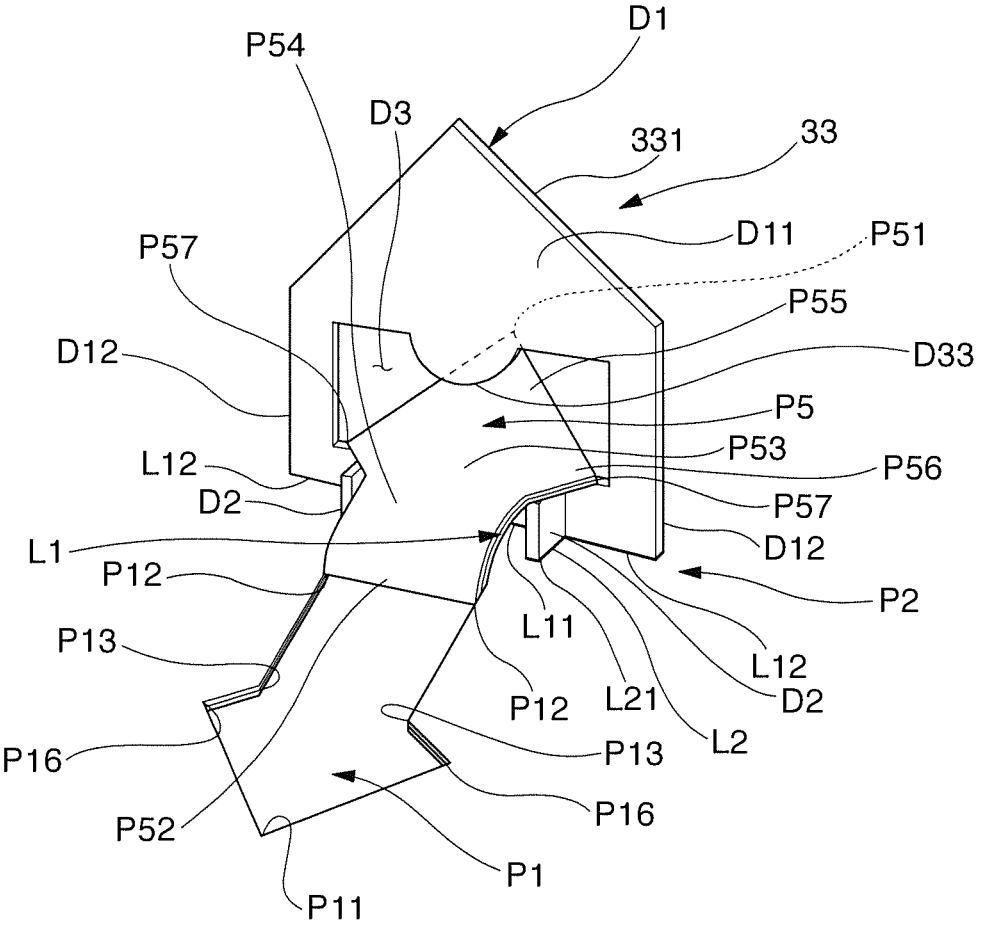
FIG. 21 is an explanatory diagram illustrating an operation of the essential part in the binding machine of the embodiment.
Figure 22:
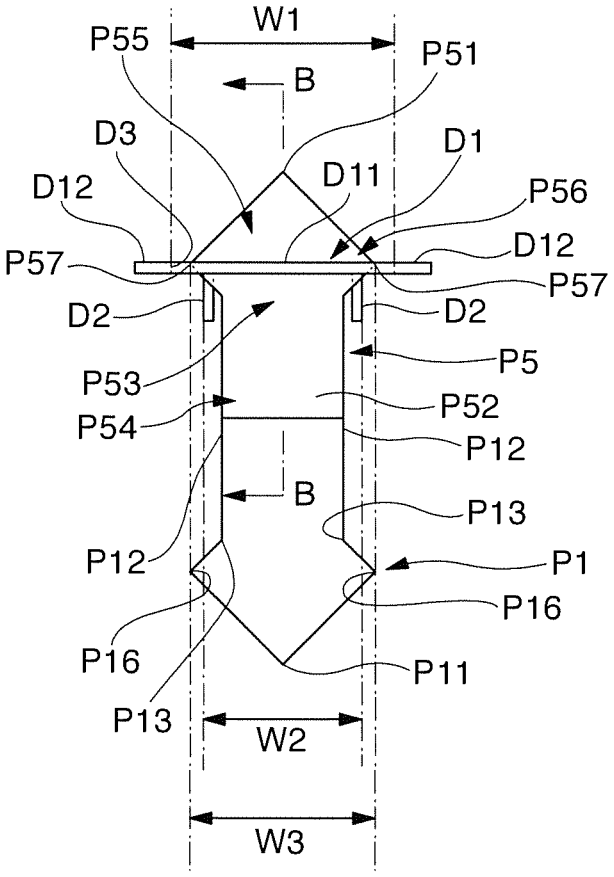
FIG. 22 is an explanatory diagram illustrating an operation of the essential part in the binding machine of the embodiment on a plane.
Figure 23:
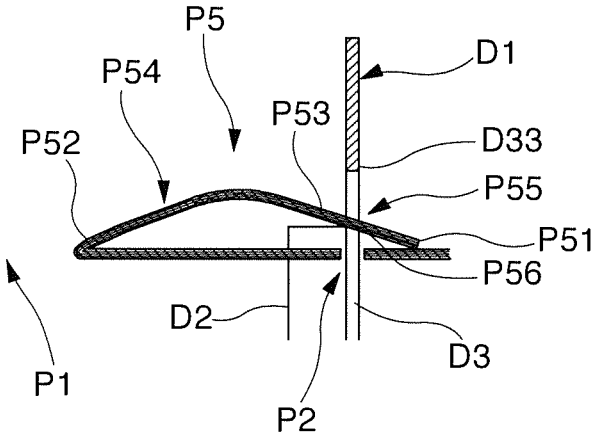
FIG. 23 is an explanatory sectional diagram taken along the line B-B illustrating an operation of the essential part in the binding machine of the embodiment.

Subsequently, if the operation to the operation lever 5 is released and the cutting blade 33 begins to be withdrawn from the sheets P, as illustrated in FIGS. 21 to 23, the distal end region P55 of the cut-and-raised piece P5 relatively rises with respect to the window D3 of the cutting blade 33, and the cut-and-raised piece P5 released from the reduced width portion D31 is accommodated in the enlarged width portion D32 provided adjacently to the upper part of this reduced width portion D31. That is, as the second blade D2 of the cutting blade 33 sinks into the sheets P2 side, the both right and left end portions of the distal end region P55 are released from the second blade D2 and thus, move to the enlarged width portion D32 side. The wide width portion P56 of the cut-and-raised piece P5 having been moved to the enlarged width portion D32 side is located on the side farther away from the punched hole P1 than the distal end L21 of the second slit L2. Furthermore, since the shape and dimension of the punching blade 32, the shape and dimension of the cutting blade 33, and the relative positions of the punching blade 32 and the cutting blade 33 are set so that the width dimension W3 of the wide width portion P56 becomes larger than the outer dimension W2 of the reduced width portion D31 of the window D3, the outer end P57 of the wide width portion P56 is located on the outer side of the second slit L2.

Figure 24:
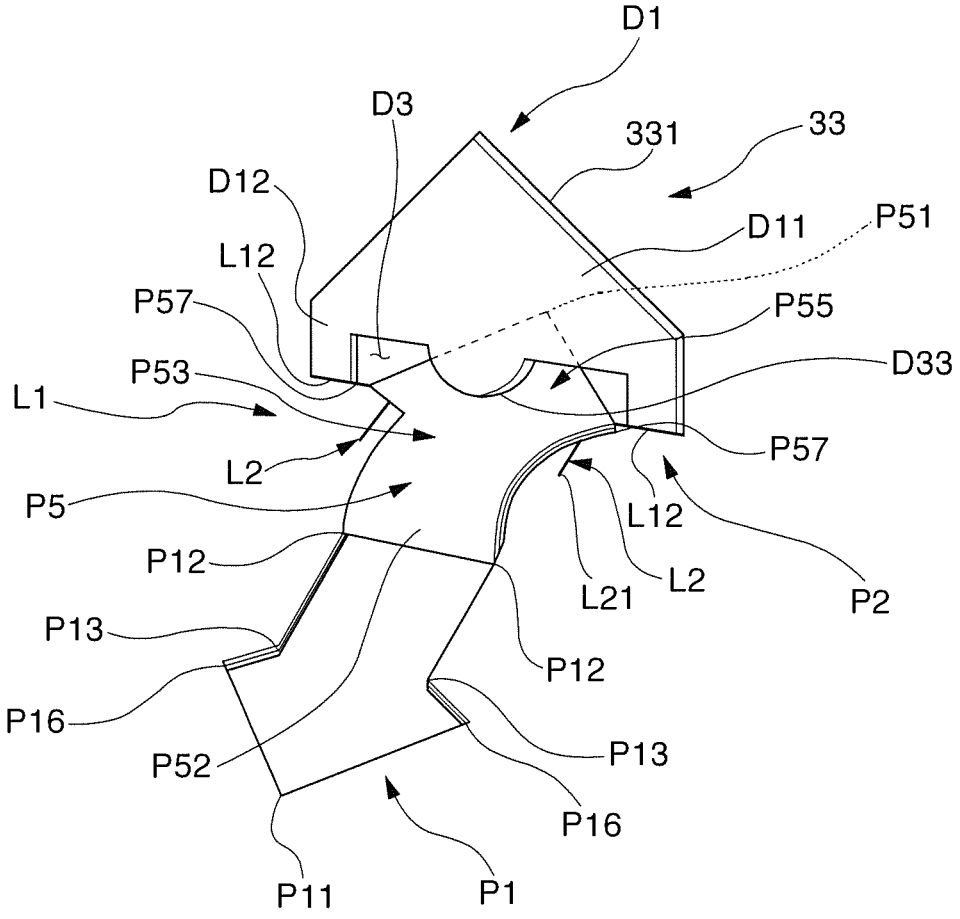
FIG. 24 is an explanatory diagram illustrating an operation of the essential part in the binding machine of the embodiment.
Figure 25:
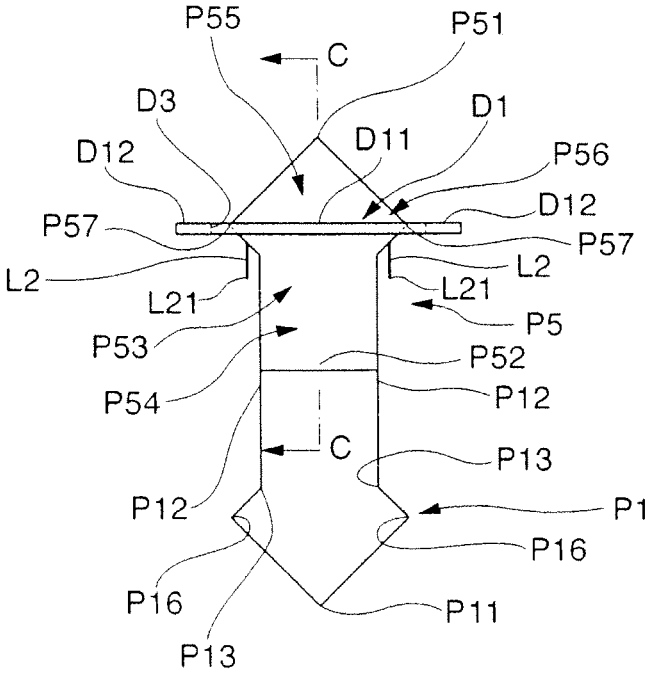
FIG. 25 is an explanatory diagram illustrating an operation of the essential part in the binding machine of the embodiment on a plane.
Figure 26:
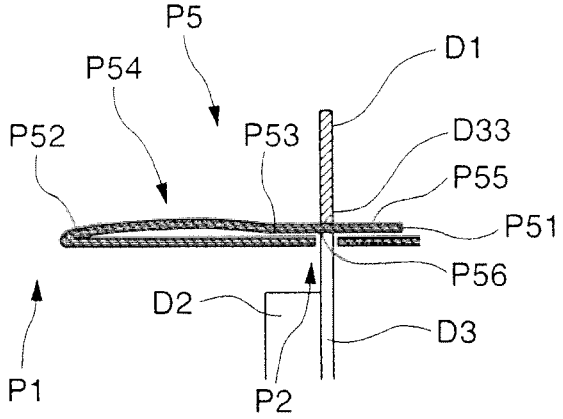
FIG. 26 is an explanatory sectional diagram taken along the line C-C illustrating an operation of the essential part in the binding machine of the embodiment.

Furthermore, as illustrated in FIGS. 24 to 26, as the distal end region P55 of the cut-and-raised piece P5 relatively rises with respect to the window D3 of the cutting blade 33, and the enlarged width portion D32 of the cutting blade 33 sinks into the sheets P side, the projection D33 provided on the upper edge of the window D3 begins to be brought into contact with the distal end region P55 of the cut-and-raised piece P5.

Figure 27:
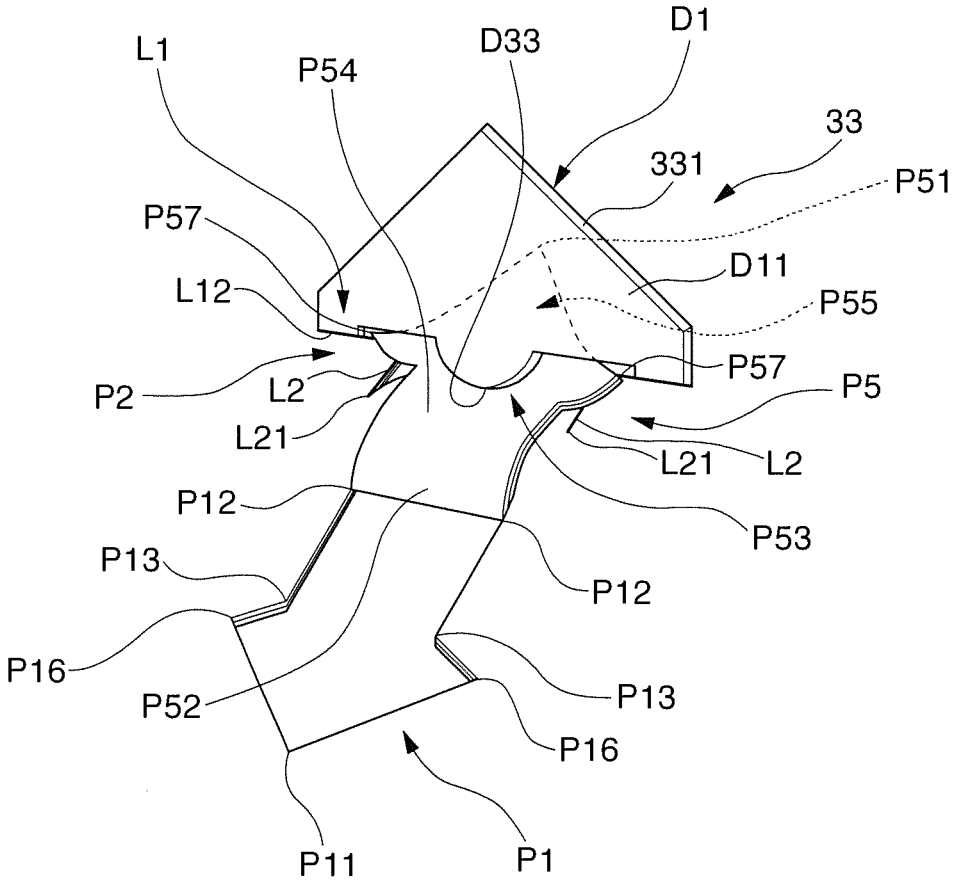
FIG. 27 is an explanatory diagram illustrating an operation of the essential part in the binding machine of the embodiment.
Figure 28:
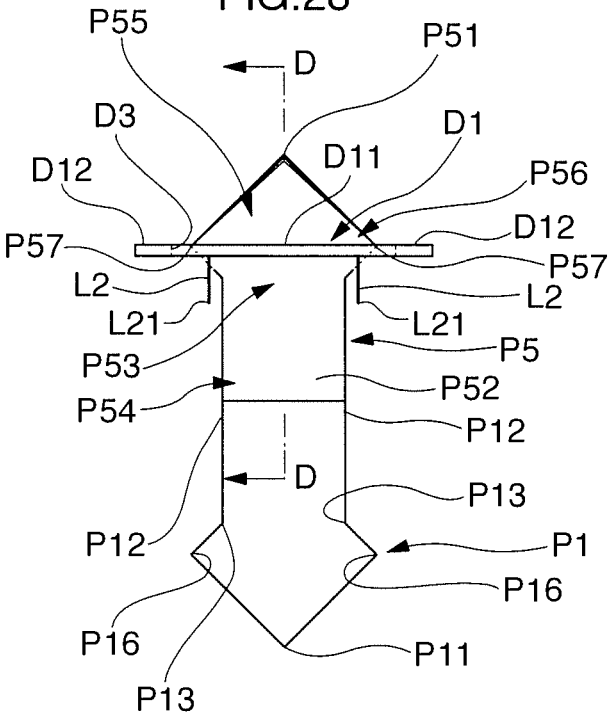
FIG. 28 is an explanatory diagram illustrating an operation of the essential part in the binding machine of the embodiment on a plane.
Figure 29:
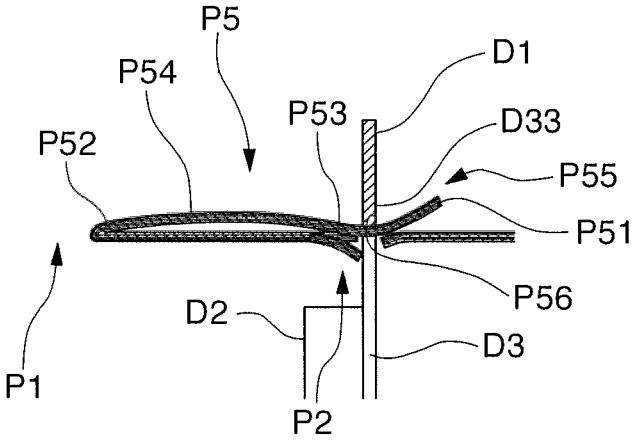
FIG. 29 is an explanatory sectional diagram taken along the line D-D illustrating an operation of the essential part in the binding machine of the embodiment.

Then, as illustrated in FIGS. 27 to 29, the cut-and-raised piece P5 is pushed from the other surface Pb side to the one surface Pa side of the sheets P. That is, since a force is applied so that a part of the distal end region P55 of the cut-and-raised piece P5 is inserted into the cut hole P2, the distal end region P55 is curved. At that time, the projection D33 presses the distal end region P55 of the cut-and-raised piece P5.

Figure 30:
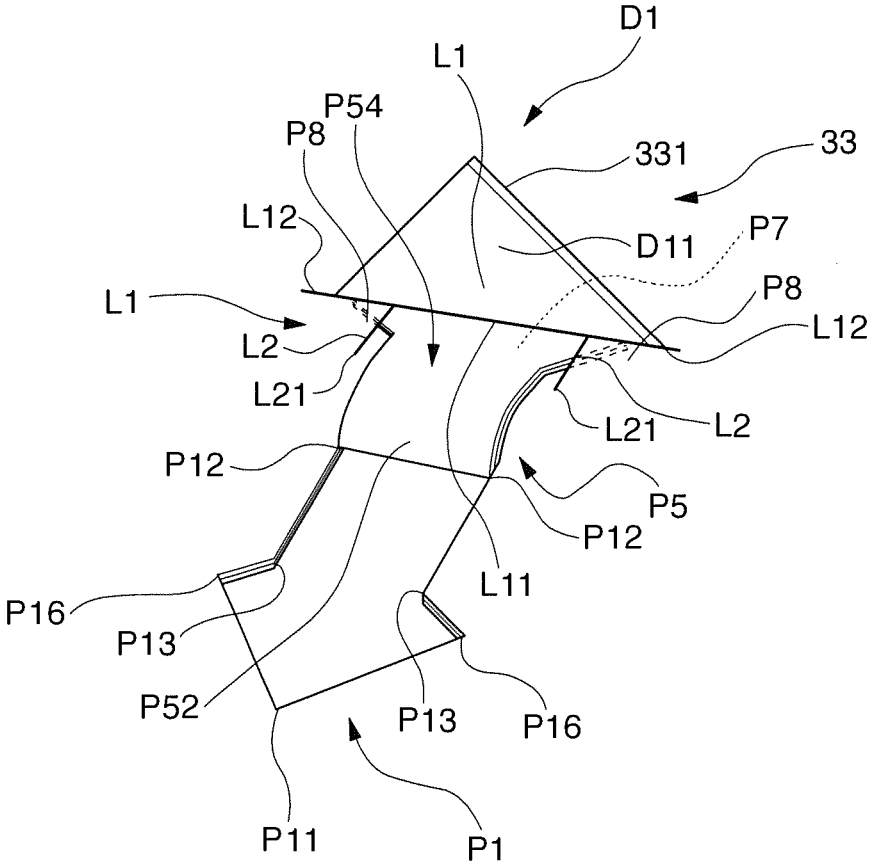
FIG. 30 is an explanatory diagram illustrating an operation of the essential part in the binding machine of the embodiment.
Figure 31:
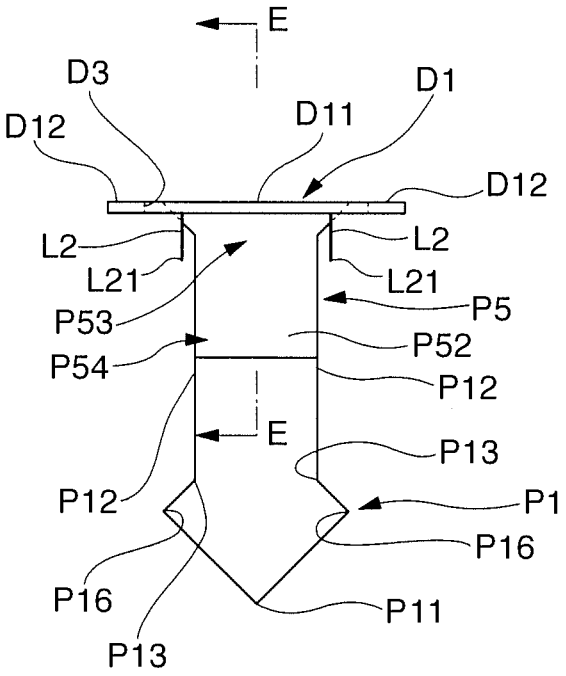
FIG. 31 is an explanatory diagram illustrating an operation of the essential part in the binding machine of the embodiment on a plane.
Figure 32:
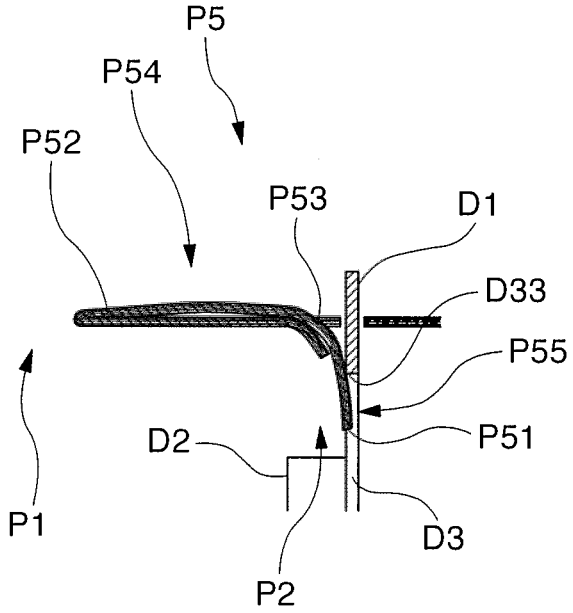
FIG. 32 is an explanatory sectional diagram taken along the line E-E illustrating an operation of the essential part in the binding machine of the embodiment.

Furthermore, as illustrated in FIGS. 30 to 32, the cantilever pieces P7 and P8 of the sheets P in the cantilever state by the first slit L1 cut by the first blade D1 and the second slit L2 cut by the second blade D2 are rolled back like a double door. Then, when the free end sides of the cantilever pieces P7 and P8 are displaced in the vertical direction, the cut-and-raised piece P5 is penetrated into the cut hole P2. In more detail, in the state illustrated in FIG. 30, the portion on the side opposite to the punched hole P1 sandwiching the first slit L1 in the distal end region P55 of the cut-and-raised piece P5 is engaged with the first slit L1, and the portion on the outer side of the second slit L2 in the distal end region P55 of the cut-and-raised piece P5 is engaged with the second slit L2. In more detail, the edge from the wide width portion P56 to the distal end P51 of the cut-and-raised piece P5 is engaged with the first slit L1, and the edge from the wide width portion P56 to the boundary portion P53 is engaged with the second slit L2.

When the cutting blade 33 has further moved in a sinking direction, that is, downward from the state illustrated in FIGS. 30 to 32, the distal end region P55 of the cut-and-raised piece P5 having been pulled downward by the first blade D1 of the cutting blade 33 in FIG. 32 tries to return to the original position. Therefore, if the cutting blade 33 has fully separated from the sheets P, the distal end P51 side of the cut-and-raised piece P5 follows along the one surface Pa side of the sheets P.

<Effects of First Embodiment>

As described above, in the binding machine 1 according to this embodiment, the cutting blade 33 is provided with the first blade D1 having the window D3 for engaging the cut-and-raised piece P5 and forming the first slit L1 and the second blade D2 for forming the second slit L2 extending from the middle of the first slit L1 in the direction of the punched hole P1 and is configured so that the edge from the wide width portion P56 to the base end P52 of the cut-and-raised piece P5 can be engaged with the second slit L2. Thus, the cut-and-raised piece P5 is engaged not only with the first slit L1 but also with the second slit L2, and the joined state between the cut-and-raised piece P5 and the cut hole P2 can be made more reliable.

That is, in the prior-art machine, since the cut-and-raised piece is engaged only with the first slit, if some force is applied to the booklet and the first slit is largely opened in the vertical direction, there is a problem that engagement between the cut-and-raised piece and the cut hole is released. However, in the machine as in this embodiment, since the cut-and-raised piece P5 is engaged also with the second slit L2, even if the first slit L1 is largely opened in the vertical direction, the engagement between the cut-and-raised piece P5 and the second slit L2 is not released, but the engaged state is maintained. Therefore, the joined state between the cut-and-raised piece P5 and the cut hole P2 can be made better than the prior-art one.

Particularly, even if a large number of sheets made of a material with relatively less friction resistance on the surface such as plastic sheets and the like are to be bound, since the edge from the wide width portion P56 to the boundary portion P53 of the cut-and-raised piece P5 is engaged with the second slit L2, a state in which a part of the distal end region P55 of the cut-and-raised piece P5 is made to fold into the lower surface side of the cantilever piece P8 can be formed. Therefore, the engagement between the cut-and-raised piece P5 and the second slit L2 is not released but the engagement state is maintained, and the joined state between the cut-and-raised piece P5 and the cut hole P2 can be maintained.

Since the shape and dimension of the punching blade 32, the shape and dimension of the cutting blade 33, and the relative positions of the punching blade 32 and the cutting blade 33 are set so that the wide width portion P56 is located on the side farther away from the punched hole P1 than the distal end L21 of the second slit L2, the edge from the wide width portion P56 to the base end P52 of the cut-and-raised piece P5 can be engaged with the second slit L2. That is, if the wide width portion P56 is closer to the punched hole P1 side than the distal end L21 of the second slit L2, the edge from the wide width portion P56 to the base end P52 of the cut-and-raised piece P5 is not engaged with the second slit L2 and the joined state between the cut-and-raised piece P5 and the cut hole P2 is released relatively easily. However, in combination with the setting such that the width dimension W3 of the wide width portion P56 is larger than the outer dimension W2 of the reduced width portion D31 of the window D3, the engaged state between the cut-and-raised piece P5 and the second slit L2 can be maintained. That is, the cut-and-raised piece P5 is engaged not only with the first slit L1 but also with the second slit L2 extending from the middle of this first slit L1, engagement is made easier than the engagement only of the first slit L1 with substantially linear cut hole.

Furthermore, in this embodiment, the shape and dimension of the punching blade 32, the shape and dimension of the cutting blade 33, and the relative positions of the punching blade 32 and the cutting blade 33 are set so that the wide width portion P56 substantially matches the first slit L1, but the shape and dimension of the punching blade 32, the shape and dimension of the cutting blade 33, and the relative positions of the punching blade 32 and the cutting blade 33 are preferably set so that the wide width portion P56 is located closer to the punched hole P1 side than the first slit L1. In this way, since the portion where the second slit L2 and the cut-and-raised piece P5 are engaged with each other increases, the joined state between the cut-and-raised piece P5 and the cut hole P2 can be made more reliable. In other words, since an area of the cut-and-raised piece P5 located on the one surface side of the cantilever piece P8 becomes relatively large, the edge from the wide width portion P56 to the base end P52 of the cut-and-raised piece P5 can be engaged with the second slit L2 more reliably.

Moreover, since the shape and dimension of the punching blade 32, the shape and dimension of the cutting blade 33, and the relative positions of the punching blade 32 and the cutting blade 33 are set so that the outer end P57 of the wide width portion P56 is located on the outer side of the second slit L2, or in other words, the width dimension W3 of the wide width portion P56 becomes larger than the outer dimension W2 of the reduced width portion D31 of the window D3, the edge from the wide width portion P56 to the base end P52 of the cut-and-raised piece P5 can be engaged with the second slit L2. That is, by protruding the outer end P57 of the wide width portion P56 reliably to the one surface Pa side, the cut-and-raised piece P5 can be brought into the state caught by the second slit L2 portion.

Furthermore, since the shape and dimension of the punching blade 32, the shape and dimension of the cutting blade 33, and the relative positions of the punching blade 32 and the cutting blade 33 are set so that the width dimension W3 of the wide width portion P56 becomes smaller than the inner dimension W1 of the enlarged width portion D32 of the window D3, a concern that the both right and left ends of the wide width portion P56 are caught by the both right and left side frames of the window D3 is suppressed, and the cut-and-raised piece P5 can be reliably inserted into the window D3. Therefore, the cut-and-raised piece P5 and the cut hole P2 can be smoothly engaged.

Since the window D3 is provided with the projection D33 for pushing the cut-and-raised piece P5 into the cut hole P2, the distal end region P54 of the cut-and-raised piece P5 can be actively inserted into the cut hole P2. Particularly, since the projection D33 has a semicircular shape, the distal end region P54 can be pushed by the curved portion at the distal end, so that there is less concern that the cut-and-raised piece P5 is damaged. Moreover, since the projection D33 is provided substantially at the center in the width direction of the cutting blade 33, the center portion in the width direction in the distal end region P54 of the cut-and-raised piece P5 can be pressed. Moreover, the projection D33 is located on the same plane as the main slit L11 and its thickness dimension is the same as the thickness dimension of the main slit L1. Thus, the distal end P51 side of the cut-and-raised piece P5 can be reliably protruded to the one surface Pa side of the sheet P by this projection D33. Furthermore, by the momentum when the distal end P51 side of the cut-and-raised piece P5 is protruded to the one surface Pa side, the both right and left end portions in the distal end region P55 of the cut-and-raised piece P5 located above the cantilever piece P8, that is, on the other surface Pb side of the sheets P, before the engagement can be located below the cantilever piece P8, that is, on the one surface Pa side of the sheets P. That is, since the cantilever pieces P7 and P8 are rolled back in the thickness direction of the sheets P, the cut-and-raised piece P5 can be engaged with the cut hole P2 on the second slit L2 portion where this cantilever piece P7 and the cantilever piece P8 adjoin.

Moreover, since the cutting blade 33 has the second blade D2 formed on the both side edges of the window D3 and the second blade D2 is cut and raised integrally from the window D3, the strength of the second blade D2 can be maintained and can be easily molded.

Moreover, this binding machine 1 is configured such that the plurality of sheets P can be bound together by forming the punched hole P1 and the cut hole P2 in the plurality of sheets P and by inserting the cut-and-raised piece P5 cut and raised from the punched hole P1 into the cut hole P2. It is provided with the punching blade 32 and the cutting blade 33 for forming the punched hole P1 and the cut hole P2 by temporarily moving upward, the base portion 2 for accommodating the punching blade 32 and the cutting blade 33 at the standby position (N), and the punch stand 4 disposed on the upward surface F14 side of this base portion 2 through the gap 35 for inserting the sheets P. Since the punch stand 4 has the blade through holes 411 and 422 into which the punching blade 32 and the cutting blade 33 can be inserted and the window 421 through which the sheets P can be visually recognized through the blade through holes 411 and 422, the sheets P can be visually recognized through the blade through holes 411 and 422 through the window 421, so that in what portion of the sheets P the punched hole P1 is to be punched can be visually grasped. Thus, the punched hole P1 can be punched at a desired position in the sheets P only by adjusting the position of the sheets P with respect to the blade through holes 411 and 422. According to the present invention, at least the position where the punched hole P1 is opened can be grasped, but since it can be also visually recognized through the window 421 in the upper part of the cutting blade 33 as in this embodiment, the cutting blade 33 can be formed at a desired position of the sheets P.

Moreover, since a user of this binding machine 1 can visually check how the sheets P are bound, a comfortable sense of use can be given when the binding machine 1 is used.

Particularly, in this embodiment, the window 42 is attached with the window cover 43, whereby the window 42 is covered. However, since this window cover 43 is transparent, the blade through holes 411 and 422 and the sheets P can be visually checked through the window cover 43.

Furthermore, since the positioning portion I1 for positioning the sheets P by bringing the corner portion P4 of the sheets P into contact is formed on the locking wall I3 with which the sheets P inserted into the gap 35 for sheet insertion are brought into contact, the punched hole P1 and the cut hole P2 can be punched at appropriate positions on the corner portion P4 of the sheets P only by setting the sheets P on this positioning portion I1.

Particularly, in this embodiment, since the positioning portion I1 is formed by cutting the locking wall I3 into a shape of a substantially isosceles right triangle on plan view, the corner portion P4 of the sheets P can be easily set. Furthermore, whether the sheets P set in this way are set at an accurate position or not can be checked by using the mark I2.

Moreover, since the wall 425 is provided on the top case 42 of the punch stand 4, drop of chips of the sheets P from the blade through holes 411 and 422 can be suppressed. Furthermore, even if the window cover 43 is opened, since the high wall 426 is installed upright at the position where the window cover 43 is opened and the hand of the user can reach, the hand of the user can be prevented or suppressed from directly touching the cutting blade 33 and the punching blade 34.

Moreover, since the joined portion P3 of the booklet B is compressed and deformed in the thickness direction, the plurality of sheets P are joined by the cut-and-raised piece P5 cut and raised from the punched hole P1, and since the cut-and-raised piece P5 playing a role of a staple and the sheets P are made of paper of the same quality, there is no more need to remove the staple when discarding. Thus, a complicated work for removing needles made of metal and the like from the sheets P is no longer required, and even if a large number of sheets P are to be discarded, they can be discarded without requiring a lot of labor and time.

Furthermore, since the joined portion P3 by the cut-and-raised piece P5 is compressed, and the joined portion P3 is compressed and deformed to the state where it does not return to the form immediately after the joining by elasticity of the sheets P, the joined portion P3 can be suppressed from becoming bulky.

Moreover, when the user performs the series of operations of grasping and releasing the operation lever 5 provided in the binding machine 1 as above, the punched hole P1 is formed in the plurality of sheets P and the plurality of sheets P are joined to each other by using the cut-and-raised piece P5 cut and raised from the punched hole P1, thereby the booklet B with the joined portion P3 compressed and deformed can be made.

Moreover, since the punch plate 41 is fixed to the base frame 21, rigidity of the entire binding machine 1 can be improved, and stable operation is made possible.

Since this cutting blade 33 is formed such that the second blade D2 and the sub blade D12 are bent at the both sides of the window D3 as boundaries, the dimension of the main slit L11 and the width dimension of the cut-and-raised piece P5 punched from the sheets P can be set to substantially the same dimension. Therefore, as compared with the linear cut hole P2, the main slit L11 can be set to be small. Furthermore, lateral shifting of the cut-and-raised piece P5 and breakage of the sheet P in the vicinity of the cut hole P2 caused by the shifting and the like when the cut-and-raised piece P5 is bound through the cut hole P2 can be also suppressed.

Moreover, even if the sheet P has a relatively large thickness or the number of the sheets P is large, since the portion surrounded by the first slit L1 and the second slit L2 is deformed in the thickness direction of the sheets P when the cutting blade 33 is withdrawn, the operation lever 5 can be pulled up with a lighter operation force. That is, there is no need to use a strong coil spring which gives a repulsive force to the operation lever 5.

Since this punching blade 32 has the blade main body 323 not only on the distal end side but also on the side end side, the shape of the punched hole P1 can be made clean. That is, since the blade main body 323 on the side end side of the punching blade 32 is provided in the punching direction of the sheets P, in the punched hole P1 formed by such punching blade 32, shaping of the end portion of the punched hole P1 can be performed more precisely than the punched hole P1 formed by the punching blade 32 not having the blade main body 323 on the side end side. Therefore, generation of breakage from the base end of the punched hole P1 can be suppressed or prevented. Moreover, occurrence of nonconformity that when the inner cam 34 presses the cut-and-raised piece P5, the cut-and-raised piece P5 becomes too long that it cannot pass through the window D3 of the cutting blade 33 can be effectively suppressed or prevented, and fracture of the base end P52 of the cut-and-raised piece P5 can be suppressed or prevented.

Second Embodiment

Subsequently, a second embodiment of the present invention will be described by referring to FIGS. 40 to 47. The portions which are the same or correspond to those in the first embodiment will be given the same reference numerals and the description will be omitted.

This binding machine 1 has a projecting portion 11 for bringing the sheets P close to the punch stand 4 side which is an anvil provided on the base portion 2.

The projecting portion 11 is disposed on a depth side region 351 of the gap 35 for sheet insertion. Specifically, the projecting portion 11 has a rib shape, and two projecting portions 11 forming a pair are disposed substantially in parallel forming a pair on the both sides of the cutting blade 33. These projecting portions 11 are formed integrally on the base frame 21. Each of the projecting portions 11 is provided with an inclined portion 11*a* for guiding on the front end side, and the rear end side is located in front of the locking wall I3. A gap 352 between these projecting portions 11 and the punch stand 4 is set in accordance with the thickness of the expected maximum number of the sheets P. A flat groove 12 recessed in a direction away from the punch stand 4 is formed in the center part in the right-and-left direction of the upward surface F14 of the base frame 21 and each of the projecting portions 11 is disposed on the both sides of this groove 12.

Moreover, this binding machine 1 has a projecting portion 13 provided on the punch stand 4 which is an anvil for separating the sheets P from the punch stand 4 side.

The projecting portion 13 is disposed closer to the front side than the depth side region 351 of the gap 35 for sheet insertion. Specifically, the projecting portion 13 has a substantially semispherical shape and the two projecting portions 13 forming a pair are disposed forming a pair on the both sides of the punching blade 32. More specifically, the projecting portions 13 are arranged so as to sandwich the distal end region forming portion of the punching blade 32. These projecting portions 13 are formed integrally on the punch plate 41 of the punch stand 4. The gap 353 between these projecting portions 13 and the upward surface F14 of the base portion 2 is set in accordance with the thickness of the expected maximum number of the sheets P. The flat groove 12 recessed in the direction away from the punch stand 4 is formed in the center part in the right-and-left direction of the upward surface F14 of the base frame 21, and each of the projecting portions 13 is provided oppositely to a sheet receiving portion 14 extending in the right-and-left direction from the both edges of this groove 12. The upward surface F14 of the base portion 2 in this embodiment is provided with a bottom surface 12*a* of the groove 12 and the sheet receiving portion 14 located on the both sides of the groove 12. In the portion close to the side edges of the right and left sheet receiving portions 14, a recess portion 14*a* recessed in the direction away from the punch stand 4 is provided.

<Operation Explanation>

Subsequently, the operation of this binding machine 1 will be described as follows.

Figure 43:
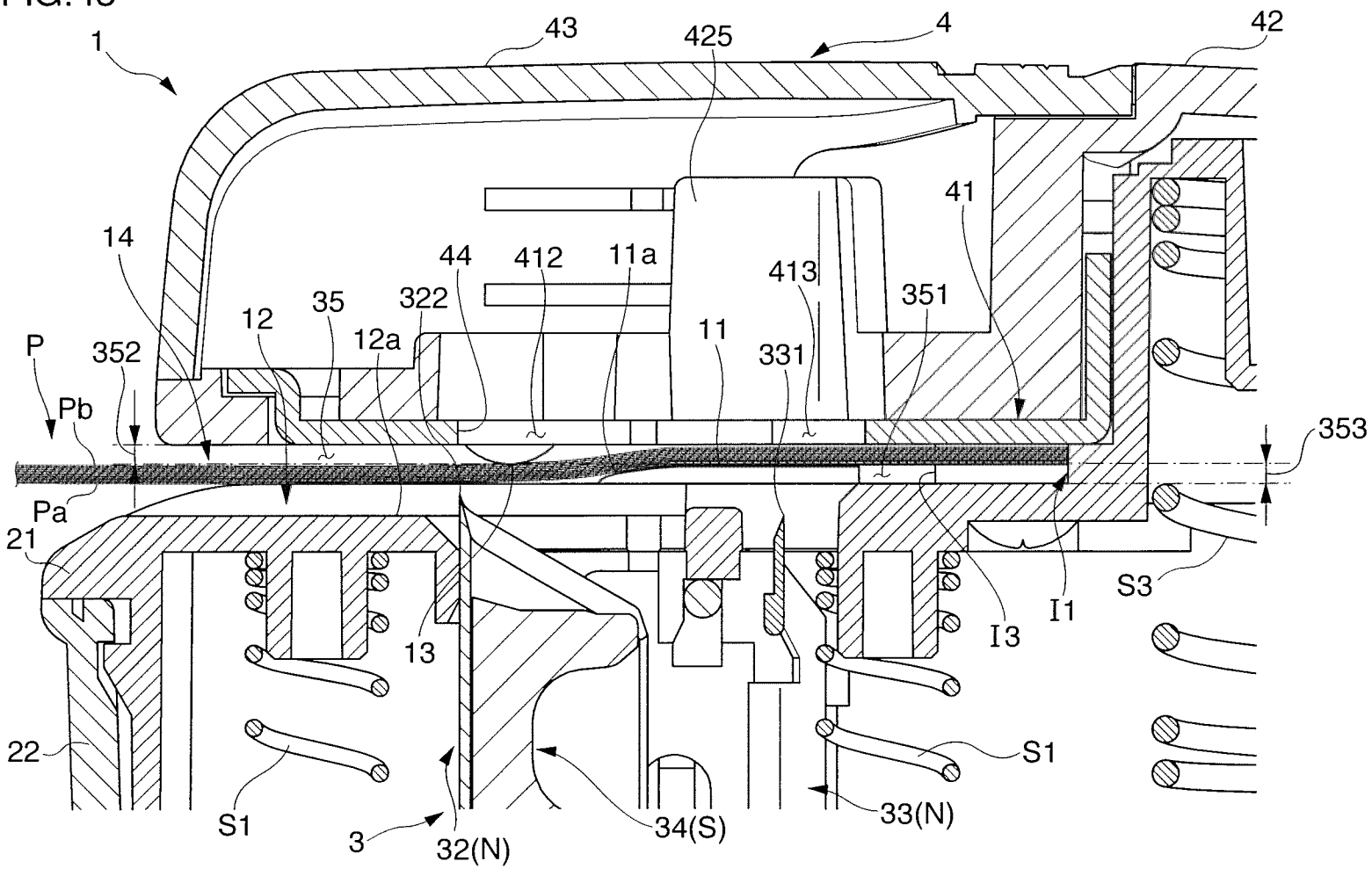
FIG. 43 is an outline diagram illustrating an operation of the binding machine of the second embodiment.
Figure 44:
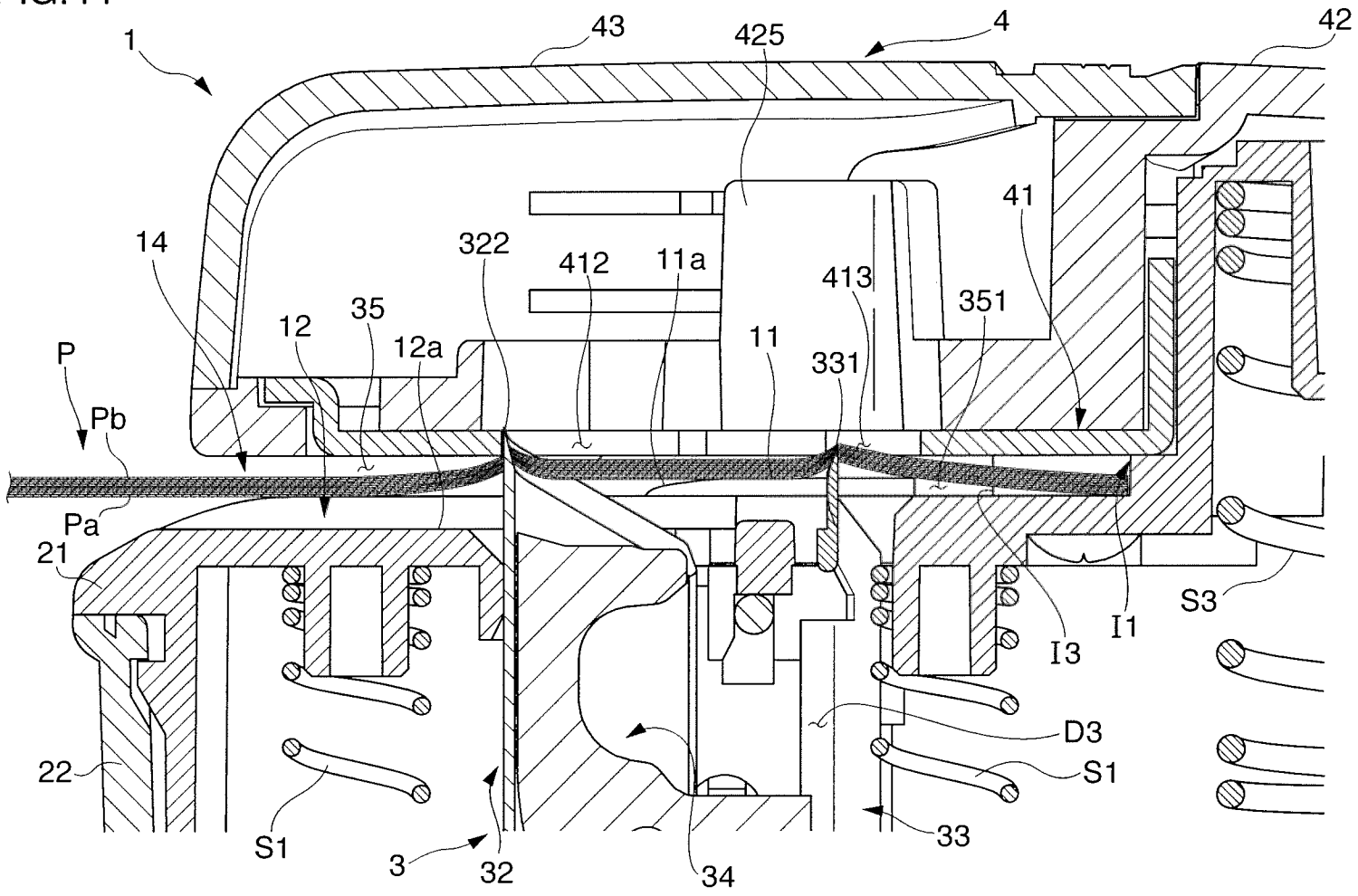
FIG. 44 is an outline diagram illustrating an operation of the binding machine of the second embodiment.
Figure 45:
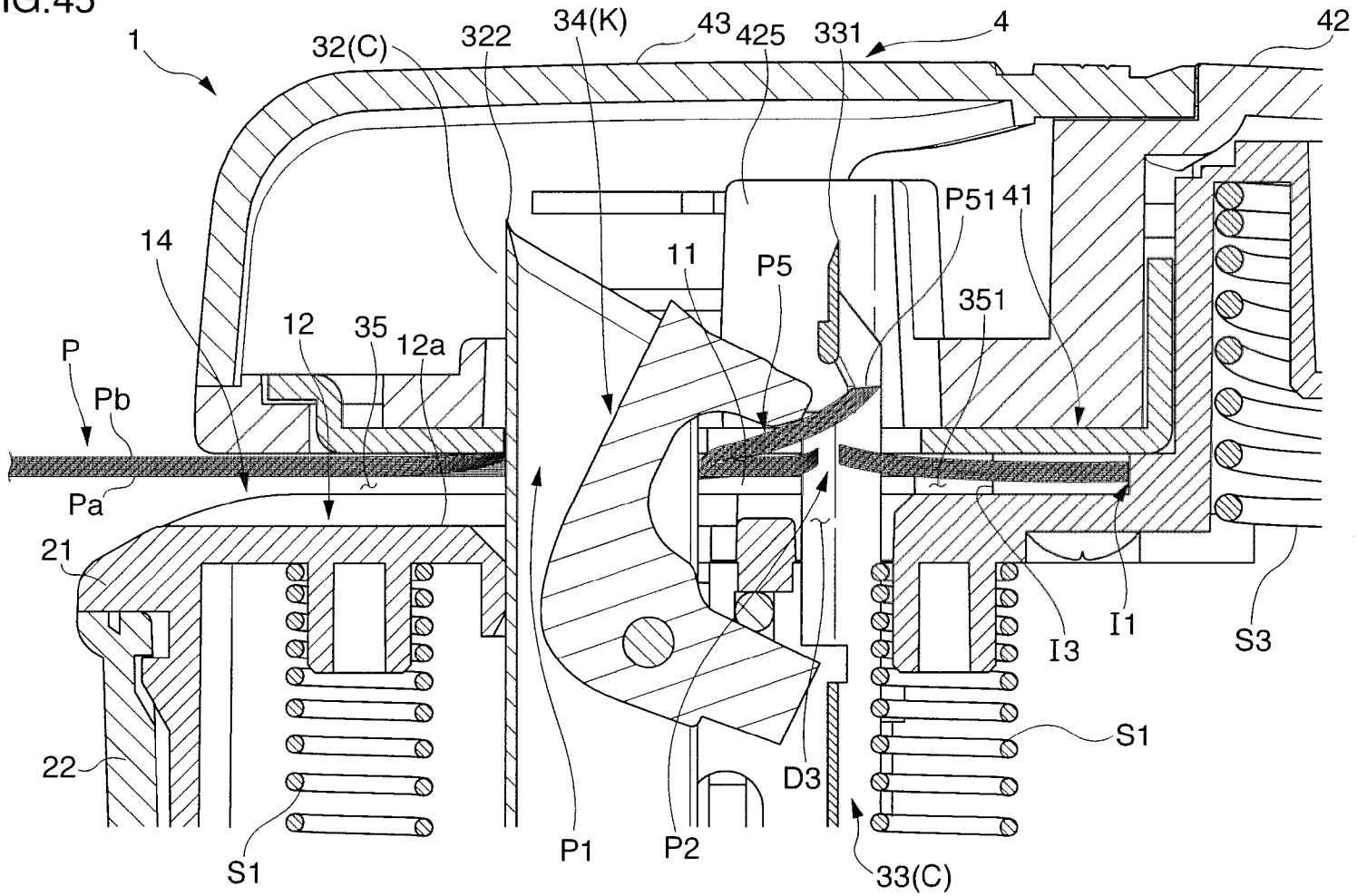
FIG. 45 is an outline diagram illustrating an operation of the binding machine of the second embodiment.
Figure 46:
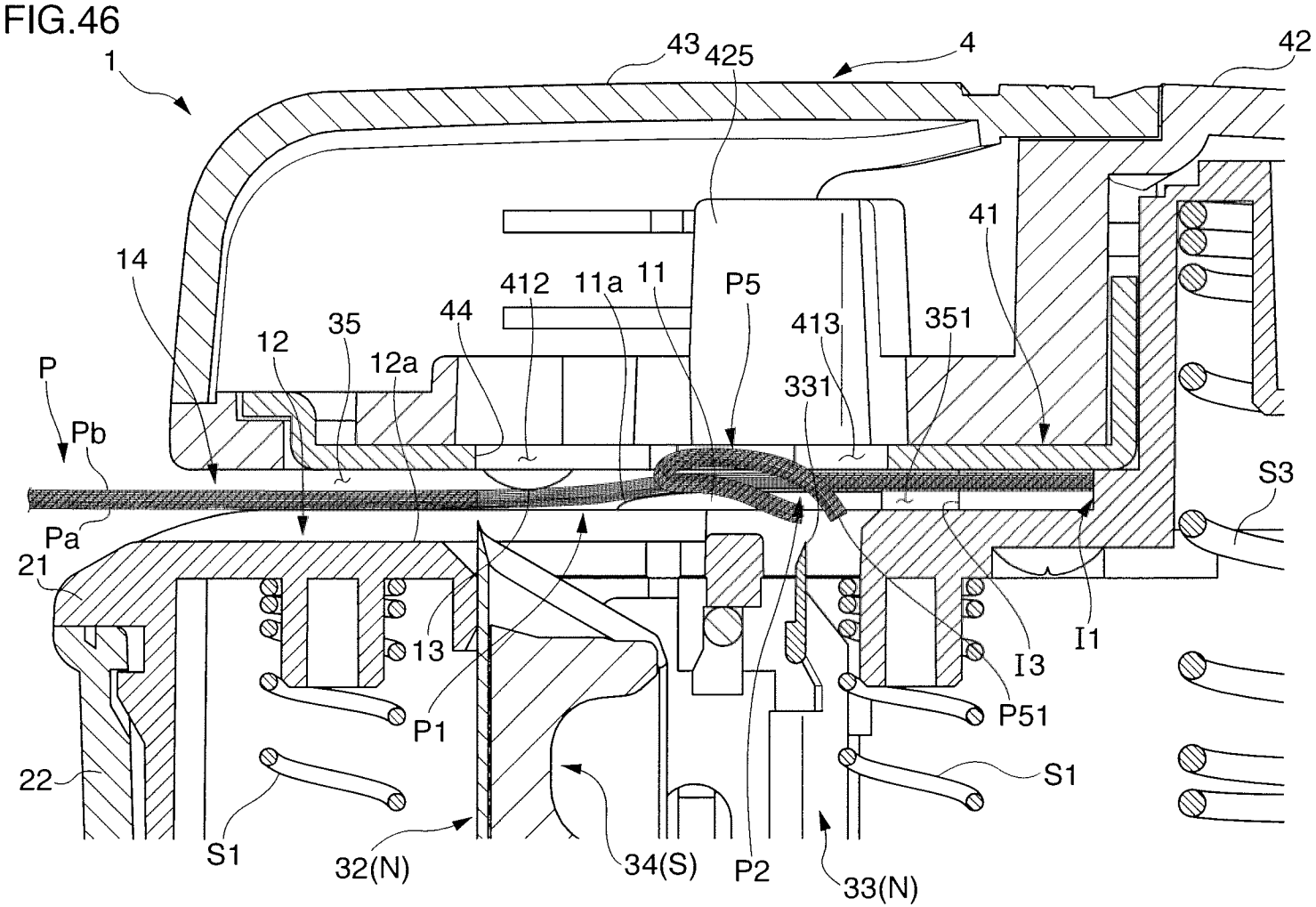
FIG. 46 is an outline diagram illustrating an operation of the binding machine of the second embodiment.
Figure 47:
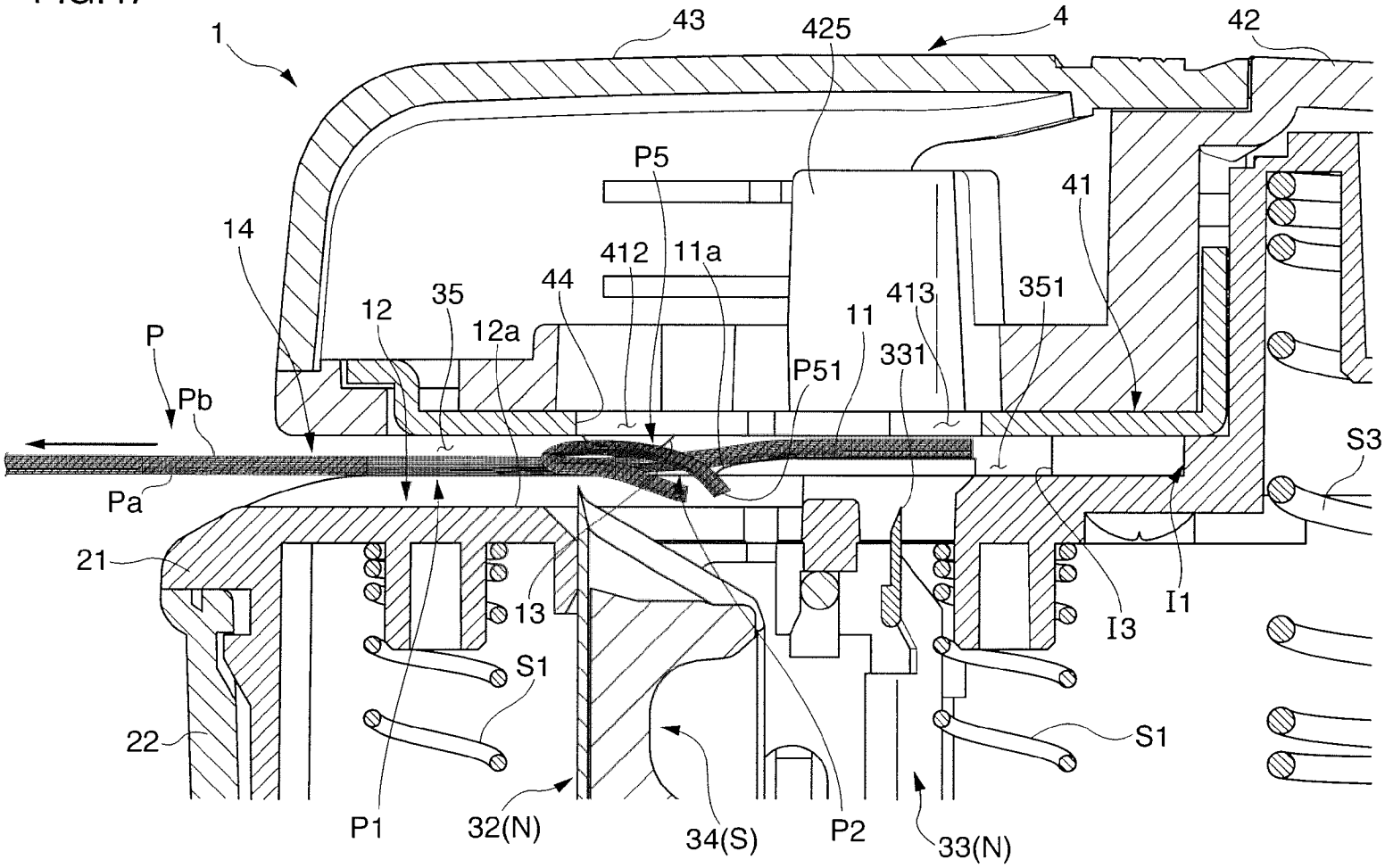
FIG. 47 is an outline diagram illustrating an operation of the binding machine of the second embodiment.

FIGS. 43 to 46 illustrate an action according to the binding machine 1 of this second embodiment. FIG. 43 corresponds to FIG. 14 in the first embodiment and illustrates a state where the sheets P are inserted. At this time, the sheets P are lifted up so as to approach the punch stand 4 by the projecting portions 11 on the base portion 2 side in the depth side region 351 of the gap 35. FIG. 44 corresponds to FIG. 15 in the first embodiment and illustrates a state where the punching blade 32 and the cutting blade 33 are to penetrate the sheets P. At this time, an amount displaced in the thickness direction of the sheets P can be made smaller than the case without this projecting portion 11. FIG. 45 corresponds to FIG. 16 in the first embodiment and illustrates a state where the punching blade 32 and the cutting blade 33 have penetrated the sheets P. FIG. 46 corresponds to FIG. 17 in the first embodiment and illustrates a state where the punching blade 32 and the cutting blade 33 have been withdrawn from the sheets P. At this time, the sheets P are pressed down so as to be separated from the punch stand 4 by the projecting portions 13 on the punch stand 4 side. Therefore, as illustrated in FIG. 47, when the binding operation is finished and the sheets P are to be withdrawn, a portion protruding from the sheets P of the cut-and-raised piece P5 to the upper surface, that is, to the other surface Pb side can be prevented or suppressed from being caught by the edge 44 of the punch plate 41. Moreover, at that time, since strong contact of the distal end P51 of the cut-and-raised piece P5 with the base portion 2 can be prevented by presence of the groove 12, smoother withdrawal is made possible. In the depth side region 351 of the gap 35, the sheets P are kept closer to the punch stand 4 side by the projecting portions 11 on the base portion 2 side, and thus, violent movement of the sheets P in the thickness direction during the binding operation can be effectively suppressed.

<Effects of Second Embodiment>

By configuring as above, the following working effects can be obtained in addition to the effects that can be exerted by those in the above-described first embodiment.

Conventionally, in this type of binding machines in which a large number of sheets are bound, when the punching blade and the cutting blade which serve as blades penetrate the sheets, a sheet presser for pressing the sheets in the punch stand direction has been provided in many cases. However, since such sheet presser has a movable component, there is a problem that its construction becomes complicated. On the other hand, in the machine in this embodiment, when the sheets P are inserted into the gap 35, the sheets P are brought closer to the punch stand 4 side by presence of the projecting portions 11 in the depth side region 351 of the gap 35. Thus, in the binding operation from penetration of the punching blade 32 and the cutting blade 33 into the sheets P to withdrawal thereof, violent movement of the sheets P in the thickness direction can be suppressed, so that the effect similar to that obtained by the prior-art machine provided with the sheet presser can be obtained. Therefore, the sheets P can be pressed without using a movable component, and clean punched hole P1 and cut hole P2 can be formed.

When attention is paid only to suppression of the violent movement of the sheets P during the binding operation, the entire gap 35 can be made small, but only by making it small causes a problem when the sheets P are withdrawn from the gap 35 after the binding operation. That is, in this type of binding method, the cut-and-raised piece P5 cut and raised from the sheets P protrudes to the punch stand 4 side. Therefore, if the gap 35 is smaller over the entire depth direction, the cut-and-raised piece P5 is caught by the edge 44 of the punch plate 41, and nonconformity that the sheets P cannot be smoothly withdrawn from the binding machine 1 can easily occur.

On the other hand, according to the configuration of this embodiment, when the sheets P are to be withdrawn, the sheets Pare separated from the punch stand 4 by the projecting portion 13 provided on the punch stand 4 side. Thus, possibilities that the cut-and-raised piece P5 or the joined portion P3 is broken due to the cut-and-raised piece P5 having been cut and raised is caught by the edge 44 of the punch plate 41, or a smooth work is obstructed can be reduced.

In this embodiment, since the groove 12 is provided in the base portion 2, when the sheets P are separated from the punch stand 4 by the projecting portion 13 on the punch stand 4 side, interference of the distal end P51 side of the cut-and-raised piece P5 protruding to the lower surface of the sheets P, that is, to the one surface Pa side with the upward surface F14 of the base portion 2 can be prevented, and the sheets P can be withdrawn more smoothly.

As described above, according to the binding machine 1 of this embodiment, violent movement of the sheets P can be prevented or suppressed without narrowing the entire gap 35, and a smooth work can be performed while catching during withdrawal is prevented or suppressed. The shapes and/or numbers of the projecting portion 11, the groove 12, the projecting portion 13, the recess portion 14*a* and other parts illustrated in this second embodiment are not limited to the exemplification and are capable of various changes.

The present invention is not limited to the above-described embodiments.

<Variation of Binding Machine>

The binding machine may be provided with a plurality of cutting blades or may be provided with a plurality of punching blades. For example, the binding machine may be provided with a single punching blade for forming a plurality of cut-and-raised pieces and cutting blades in number corresponding to the plurality of the cut-and-raised pieces, may be provided with a plurality of punching blades for forming a plurality of cut-and-raised pieces and a single cutting blade for forming a cut hole which can lock the plurality of cut-and-raised pieces or may be provided with a plurality of punching blades for forming a plurality of cut-and-raised pieces and cutting blades in number corresponding to the plurality of the cut-and-raised pieces.

The shape of the cutting blade and the shape of the cut hole formed by this cutting blade are not limited to those in the above-described embodiments. Moreover, the shape of the punching blade, the shape of the punched hole formed by the punching blade, and the shape of the cut-and-raised piece are not limited to those in the above-described embodiments, either. As other modes of them, those illustrated in FIGS. 33 to 39 can be considered, for example. Here, in FIGS. 33 to 39, the shape of the cut hole and the shape of the punched hole are indicated by solid lines, and the shape of the cut-and-raised piece in the state engaged with this cut hole is indicated by two-dot chain lines. The cutting blade and the punching blade have, though not shown, blade main bodies each having a shape corresponding to the shape of the illustrated cut hole and the shape of the punching blade. Furthermore, it is needless to say that, regarding the shape of the cut hole and the shape of the punched hole illustrated in the following embodiments (and the shapes of the cutting blade, the punching blade, and the cut-and-raised piece corresponding to them), the cut hole and the punched hole may be used in combination with those in the other embodiments. In the following embodiments, the constituent elements corresponding to the above-described embodiments are indicated by the similar reference numerals attached with "A", "B", "C", "D", "E", "F" or "G" at the beginning, and specific explanation will be omitted.

<Variation (FIG. 33)>

First, an embodiment illustrated in FIG. 33 will be described.

Figure 33:
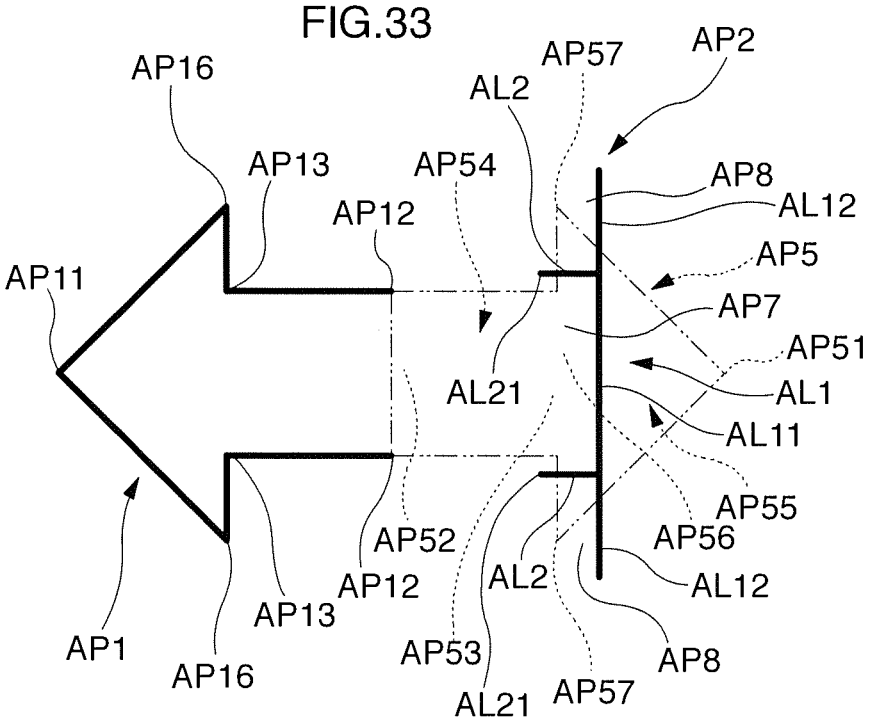
FIG. 33 is a plan view schematically illustrating the punched hole, the cut hole, and a cut-and-raised piece of another embodiment of the present invention.

FIG. 33 schematically illustrates a cut-and-raised piece AP5 provided with an arrow shape at a distal end AP51, a punched hole AP1 having a shape corresponding to this cut-and-raised piece AP5, and a cut hole AP2 having a clog shape to be engaged with the cut-and-raised piece AP5.

This cut-and-raised piece AP5 is provided with a base end region AP54 on the base end AP52 side sandwiching a boundary portion AP53 and is provided with a distal end region AP55 on the distal end AP51 side as indicated by the two-dot chain lines in FIG. 33. The base end region AP54 has a substantially rectangular shape and is set to have substantially the same width dimension from the base end AP52 to the boundary portion AP53 of the cut-and-raised piece AP5. The distal end region AP55 is integrally formed from the boundary portion AP53 side of the base end region AP54 and has an arrow shape having a sharpened distal end AP51. This distal end region AP54 is provided with a wide width portion AP56 having the width dimension W3 larger than the boundary portion AP53 and the distal end AP51 from the boundary portion AP53 to the distal end AP51 of the cut-and-raised piece AP5. In this embodiment, the boundary portion AP53 is overlapped with the wide width portion AP56, and the boundary portion AP53 is present on a virtual straight line connecting outer ends AP57 of the wide width portion AP56 to each other. The punched hole AP1 has a size and a shape corresponding to this cut-and-raised piece AP5.

On the other hand, the cut hole AP2 is composed of a first slit AL1 to be engaged mainly with the distal end region AP55 of the cut-and-raised piece AP5 and second slits AL2 bent and extending in the direction of the punched hole AP1 from the middle of this first slit AL1 and forming a pair in the right-and-left direction. The first slit AL1 is substantially in parallel with the virtual straight line connecting the outer ends AP57 of the wide width portion AP56 to each other in the cut-and-raised piece AP5 and is provided with a linear main slit AL11 and a sub slit AL12 extending from the both ends of this main slit AL11 in a direction forming a straight line with the main slit AL11. The second slit AL2 extends from a boundary portion between the main slit AL11 and the sub slit AL12. In this cut hole AP2, the first slit AL1 and the second slit AL2 form a certain angle, that is, approximately 90 degrees. In this embodiment, the length of the first slit AL1 is set longer than the length of the second slit AL2, and the lengths of the second slits AL2 forming a pair are set to substantially the same. Moreover, the second slits AL2 forming a pair are formed by being spaced away from each other by the width dimension W2 substantially equal to or slightly larger than the width dimension of the base end region AP54 of the cut-and-raised piece AP5.

In a state where the cut-and-raised piece AP5 is penetrated into the cut hole AP2 and sheets AP are bound, as indicated by the two-dot chain line in FIG. 33, the edge from the wide width portion AP56 to the base end AP52 of the cut-and-raised piece AP5 is engaged with the second slit AL2. More specifically, the edge from the wide width portion AP56 to the distal end AP51 of the cut-and-raised piece AP5 is engaged with the sub slit AL12 of the first slit AL1 and the edge from the wide width portion AP56 to the boundary portion AP53 is engaged with the second slit AL2. Moreover, the wide width portion AP56 is located on the side farther away from the punched hole AP1 than the distal end AL21 of the second slit AL2 and its width dimension is set smaller than the inner dimension of a window AD3. Furthermore, the outer end AP57 of the wide width portion AP56 is located on the outer side of the second slit AL2 and the wide width portion AP56 is located closer to the punched hole AP1 side than the first slit AL1.

<Variation (FIG. 34)>

Subsequently, an embodiment illustrated in FIG. 34 will be described.

Figure 34:
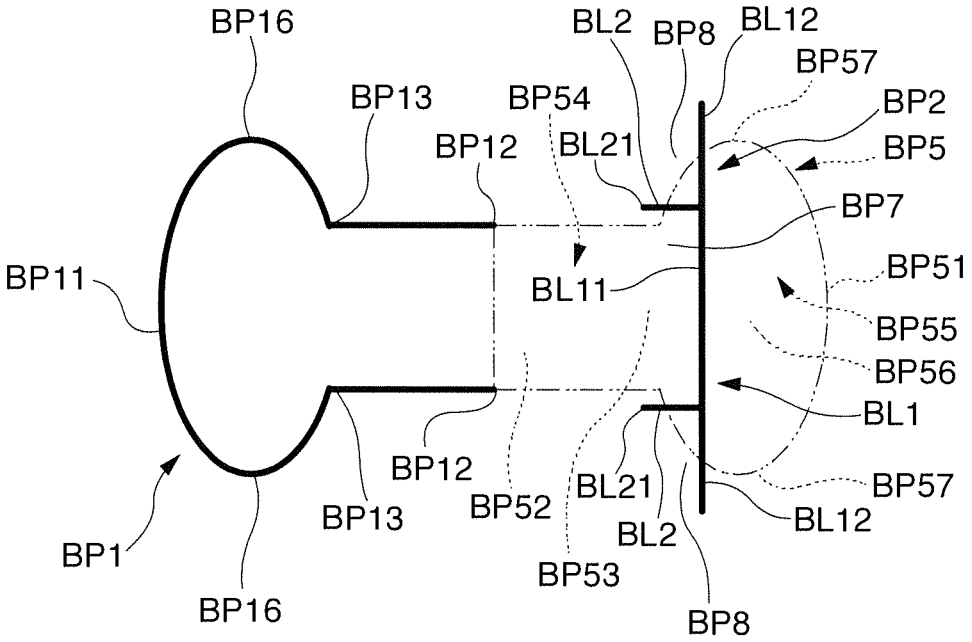
FIG. 34 is a plan view schematically illustrating the punched hole, the cut hole, and a cut-and-raised piece of another embodiment of the present invention.

FIG. 34 is a diagram schematically illustrating a cut-and-raised piece BP5 provided with an elliptic shape at a distal end BP51, a punched hole BP1 having a shape corresponding to this cut-and-raised piece BP5, and a cut hole BP2 having a clog shape to be engaged with the cut-and-raised piece BP5.

This cut-and-raised piece BP5 is, as indicated by a two-dot chain line in FIG. 34, provided with a base end region BP54 on the base end BP52 side sandwiching a boundary portion BP53 and is provided with a distal end region BP55 on the distal end BP51 side. The base end region BP54 has a substantially rectangular shape and is set to have substantially the same width dimension from the base end BP52 to the boundary portion BP53 of the cut-and-raised piece BP5. The distal end region BP55 is integrally formed from the boundary portion BP53 side of the base end region BP54 and has an elliptic shape having a smooth arc on the distal end BP51. This distal end region BP55 is provided with a wide width portion BP56 having the width dimension larger than the boundary portion BP53 and the distal end BP51 from the boundary portion BP53 to the distal end BP51 of the cut-and-raised piece BP5. The punched hole BP1 has a size and a shape corresponding to this cut-and-raised piece BP5. The shape of the distal end region BP55 may be circular, a shape combining a straight line and a curved line and the like other than the elliptic shape.

On the other hand, since the cut hole BP2 is the same as that illustrated in FIG. 33 as illustrated in FIG. 34, the detailed description will be omitted.

In a state where the cut-and-raised piece BP5 is penetrated into the cut hole BP2 and sheets BP are bound, as indicated by the two-dot chain line in FIG. 34 and similarly to that illustrated in FIG. 33, the edge from the wide width portion BP56 to the base end BP52 of the cut-and-raised piece BP5 is engaged with the second slit BL2. More specifically, the edge from the wide width portion BP56 to the boundary portion BP53 of the cut-and-raised piece BP5 is engaged with a sub slit BL12 of a first slit BL1 and with a second slit BL2. Moreover, the wide width portion BP56 is located on the side farther away from the punched hole BP1 than the distal end BL21 of the second slit BL2 and its width dimension is set smaller than the inner dimension of a window BD3. Furthermore, outer end BP57 of the wide width portion BP56 is located on the outer side of the second slit BL2 and the wide width portion BP56 is located closer to the punched hole BP1 side than the first slit BL1.

<Variation (FIG. 35)>

Subsequently, an embodiment illustrated in FIG. 35 will be described.

Figure 35:
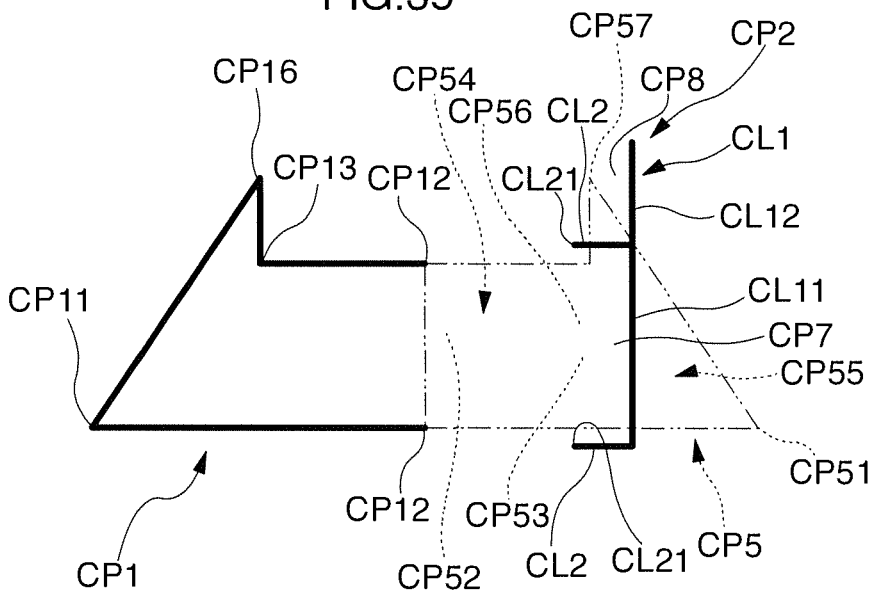
FIG. 35 is a plan view schematically illustrating the punched hole, the cut hole, and a cut-and-raised piece of another embodiment of the present invention.

FIG. 35 is a diagram schematically illustrating a cut-and-raised piece CP5 provided with an arrow shape at a distal end CP51, a punched hole CP1 having a shape corresponding to this cut-and-raised piece CP5, and a cut hole CP2 to be engaged with the cut-and-raised piece CP5.

This cut-and-raised piece CP5, as indicated by two-dot chain line in FIG. 35, provided with a base end region CP54 on the base end CP52 side sandwiching a boundary portion CP53 and is provided with a distal end region CP55 on the distal end CP51 side. The base end region CP54 has a substantially rectangular shape and is set to have substantially the same width dimension from the base end CP52 to the boundary portion CP53 of the cut-and-raised piece CP5. The distal end region CP55 is integrally formed from the boundary portion CP53 side of the base end region CP54 and has an arrow shape having a sharpened distal end CP51. This distal end region CP55 is provided with a wide width portion CP56 having the width dimension larger than the boundary portion CP53 and the distal end CP51 from the boundary portion CP53 to the distal end CP51 of the cut-and-raised piece CP5. In this embodiment, the boundary portion CP53 is overlapped with the wide width portion CP56, and the boundary portion CP53 is present on a virtual straight line connecting outer ends CP57 of the wide width portion CP56 to each other. The punched hole CP1 has a size and a shape corresponding to this cut-and-raised piece CP5.

On the other hand, the cut hole CP2 is, as illustrated in FIG. 35, similar to that illustrated in FIG. 33 and is provided with a linear main slit CL11 and a sub slit CL12 extending from one end of this main slit CL11 in a direction forming a linear shape along with the main slit CL11.

In a state where the cut-and-raised piece CP5 is penetrated into the cut hole CP2 and sheets CP are bound, as indicated by the two-dot chain line in FIG. 35 and similarly to that illustrated in FIG. 33, the edge from the wide width portion CP56 to the base end CP52 of the cut-and-raised piece CP5 is engaged with the second slit CL2. More specifically, the edge from the wide width portion CP56 to the distal end CP51 of the cut-and-raised piece CP5 is engaged with the sub slit CL12 of the first slit CL1 and the edge from the wide width portion CP56 to the boundary portion CP53 is engaged with the second slit CL2. In this embodiment, one of the edges from the wide width portion CP56 to the base end CP52 of the cut-and-raised piece CP5 is engaged with the second slit CL2 on the side where the sub slit CL12 is formed. That is, the other edge from the wide width portion CP56 to the base end CP52 of the cut-and-raised piece CP5 is not engaged with the second slit CL2. Moreover, the wide width portion CP56 is located on the side farther away from the punched hole CP1 than the distal end CL21 of the second slit CL2 and its width dimension is set smaller than the inner dimension of a window CD3. Furthermore, the outer end CP57 of the wide width portion CP56 is located on the outer side of the second slit CL2 and the wide width portion CP56 is located closer to the punched hole CP1 side than the first slit CL1.

<Variation (FIG. 36)>

Subsequently, an embodiment illustrated in FIG. 36 will be described.

FIG. 36 is a diagram schematically illustrating a cut-and-raised piece DP5 provided with an arrow shape at a distal end DP51, a punched hole DP1 having a shape corresponding to this cut-and-raised piece DP5, and a cut hole DP2 having a clog shape to be engaged with the cut-and-raised piece DP5.

Since this cut-and-raised piece DP5 is the same as that illustrated in FIG. 10 of the above-described embodiment as indicated by a two-dot chain line in FIG. 36, the detailed description will be omitted.

On the other hand, the cut hole DP2 is, as illustrated in FIG. 36, composed of a first slit DL1 to be engaged mainly with the distal end region DP55 of the cut-and-raised piece DP5 and second slits DL2 bent and extending in the direction of the punched hole DP1 from the middle of this first slit DL1 and forming a pair in the right-and-left direction. The first slit DL1 is provided with a linear main slit DL11 and a sub slit DL12 extending from the both ends of this main slit DL11 in a direction forming a straight line with the main slit DL11. The second slit DL2 extends from a boundary portion between the main slit DL11 and the sub slit DL12. In this cut hole DP2, an angle $\phi$ formed by the first slit DL1 and the second slit DL2 is set smaller than 90 degrees. That is, the lengths of the second slits DL2 forming a pair are set to substantially equal, and each of the second slits DL2 is directed in a direction where the distal ends DL21 sides are separated away from each other. Moreover, the base end sides of the second slits DL2 forming a pair are spaced away by a width dimension substantially equal to or slightly larger than the width dimension of the base end region DP54 of the cut-and-raised piece DP5.

In a state where the cut-and-raised piece DP5 is penetrated into the cut hole DP2 and sheets DP are bound, as indicated by the two-dot chain line in FIG. 36, the edge from a wide width portion DP56 to the base end DP51 of the cut-and-raised piece DP5 is engaged with the second slit DL2. More specifically, a portion corresponding to an outer end DP57 of the wide width portion DP56 of the cut-and-raised piece DP5 is engaged with the sub slit DL12 of the first slit DL1, and the edge from the wide width portion DP56 to the boundary portion DP53 is engaged with the second slit DL2. Moreover, the wide width portion DP56 is located on the side farther away from the punched hole DP1 than the distal end DL21 of the second slit DL2 and its width dimension is set smaller than the inner dimension of a window DD3. Furthermore, the outer end DP57 of the wide width portion DP56 is located on the outer side of the second slit DL2.

<Variation (FIG. 37)>

Subsequently, an embodiment illustrated in FIG. 37 will be described.

Figure 37:
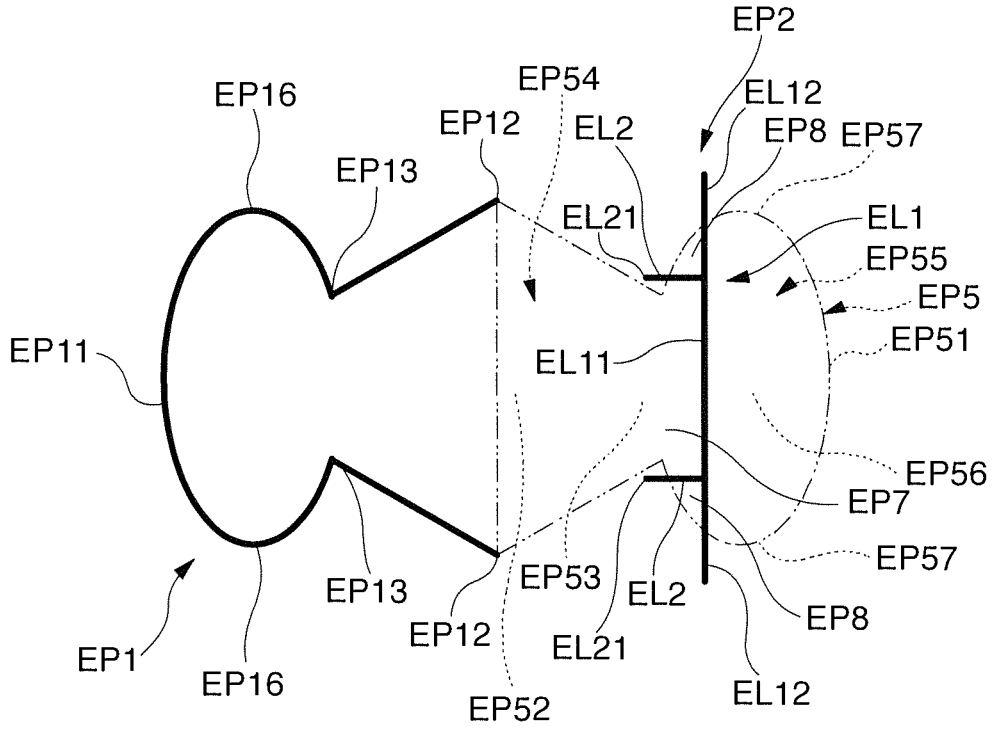
FIG. 37 is a plan view schematically illustrating the punched hole, the cut hole, and a cut-and-raised piece of another embodiment of the present invention.

FIG. 37 is a diagram schematically illustrating a cut-and-raised piece EP5 provided with an elliptic shape at a distal end EP51, a punched hole EP1 having a shape corresponding to this cut-and-raised piece EP5, and a cut hole EP2 having a clog shape to be engaged with the cut-and-raised piece EP5.

This cut-and-raised piece EP5 is, as indicated by a two-dot chain line in FIG. 37, provided with a base end region EP54 on the base end EP52 side sandwiching a boundary portion EP53 and is provided with a distal end region EP55 on the distal end EP51 side. The base end region EP54 has a substantially trapezoidal shape and is set such that the width dimension of the boundary portion EP53 is smaller than the width dimension of the base end EP52 of the cut-and-raised piece EP5. The distal end region EP55 is integrally formed from the boundary portion EP53 side of the base end region EP54 and has an elliptic shape having a smooth arc on the distal end EP51. This distal end region EP55 is provided with a wide width portion EP56 having the width dimension larger than the boundary portion EP53 and the distal end EP51 from the boundary portion EP53 to the distal end EP51 of the cut-and-raised piece EP5. The punched hole EP1 has a size and a shape corresponding to this cut-and-raised piece EP5. The shape of the distal end region EP55 may be circular, a shape combining a straight line and a curved line and the like other than the elliptic shape.

On the other hand, since the cut hole EP2 is the same as that illustrated in FIG. 33 as illustrated in FIG. 37, the detailed description will be omitted.

In a state where the cut-and-raised piece EP5 is penetrated into the cut hole EP2 and sheets EP are bound, as indicated by the two-dot chain line in FIG. 37 and similarly to that illustrated in FIG. 33, the edge from the wide width portion EP56 to the base end EP52 of the cut-and-raised piece EP5 is engaged with the second slit EL2. More specifically, the edge from the wide width portion EP56 to the boundary portion EP53 of the cut-and-raised piece EP5 is engaged with a sub slit EL12 of a first slit EL1 and with a second slit EL2. Moreover, the wide width portion EP56 is located on the side farther away from the punched hole EP1 than the distal end EL21 of the second slit EL2 and its width dimension is set smaller than the inner dimension of a window ED3. Furthermore, outer end EP57 of the wide width portion EP56 is located on the outer side of the second slit EL2 and the wide width portion EP56 is located closer to the punched hole EP1 side than the first slit EL1.

<Variation (FIGS. 38 and 39)>

Figure 38:
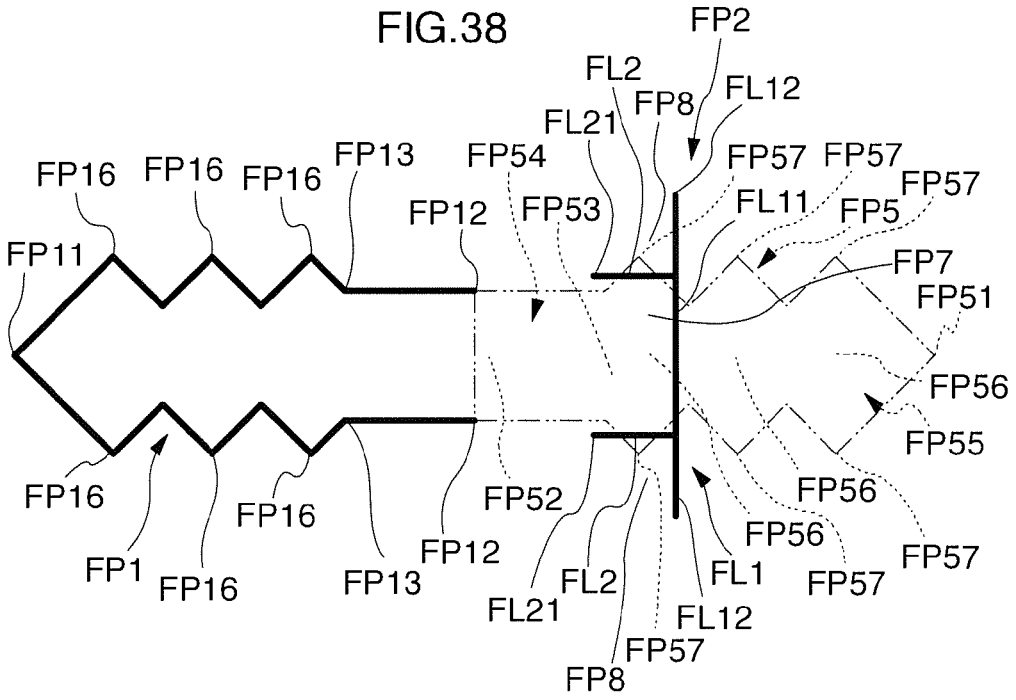
FIG. 38 is a plan view schematically illustrating the punched hole, the cut hole, and a cut-and-raised piece of another embodiment of the present invention.
Figure 39:
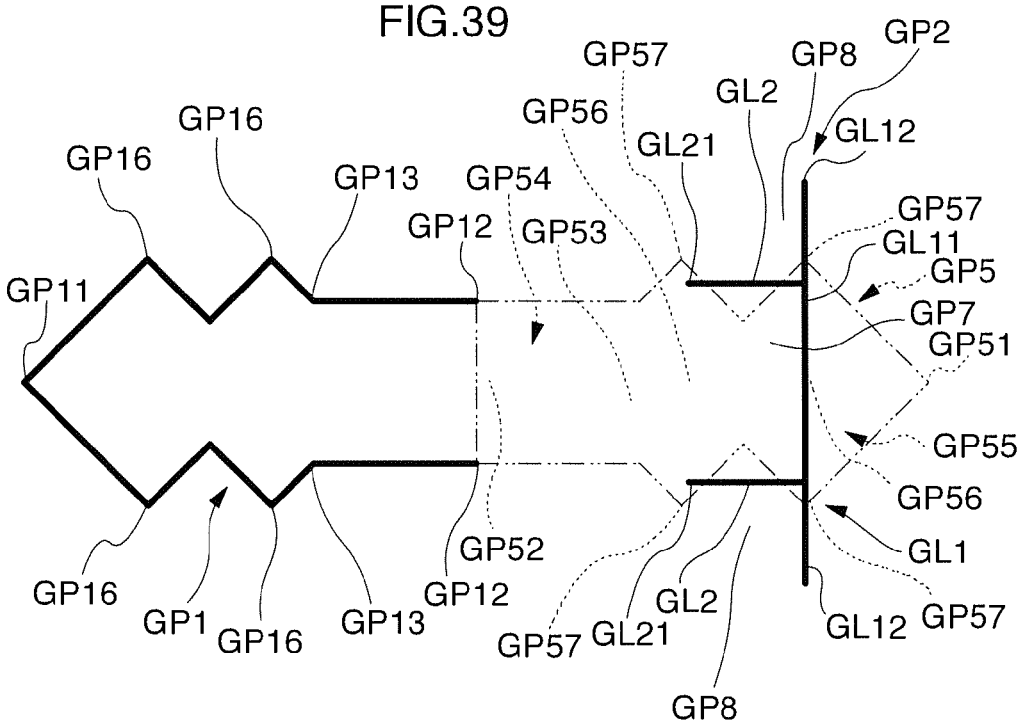
FIG. 39 is a plan view schematically illustrating the punched hole, the cut hole, and a cut-and-raised piece of another embodiment of the present invention.
Figure 40:
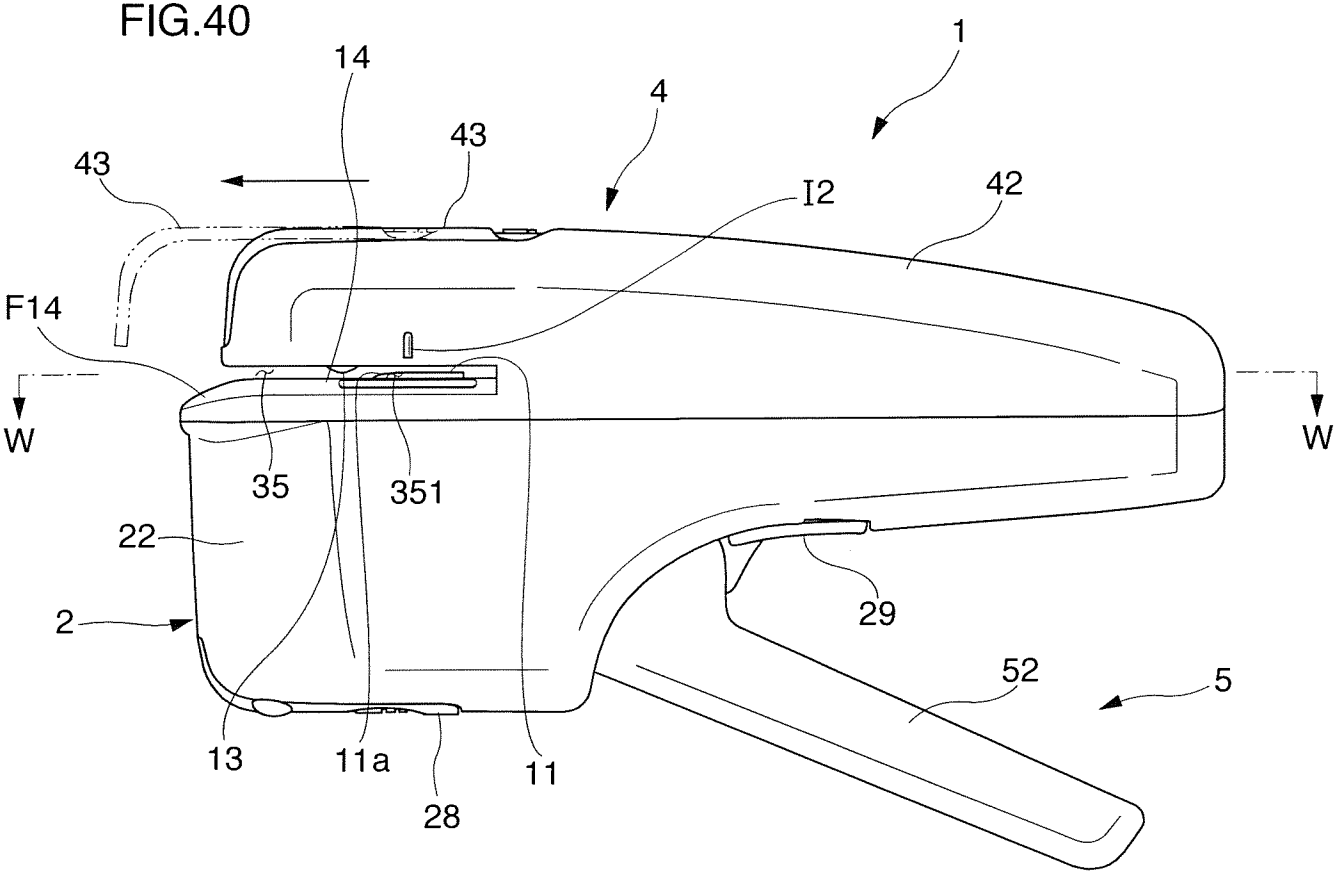
FIG. 40 is a side view of the binding machine illustrating a second embodiment of the present invention.
Figure 41:
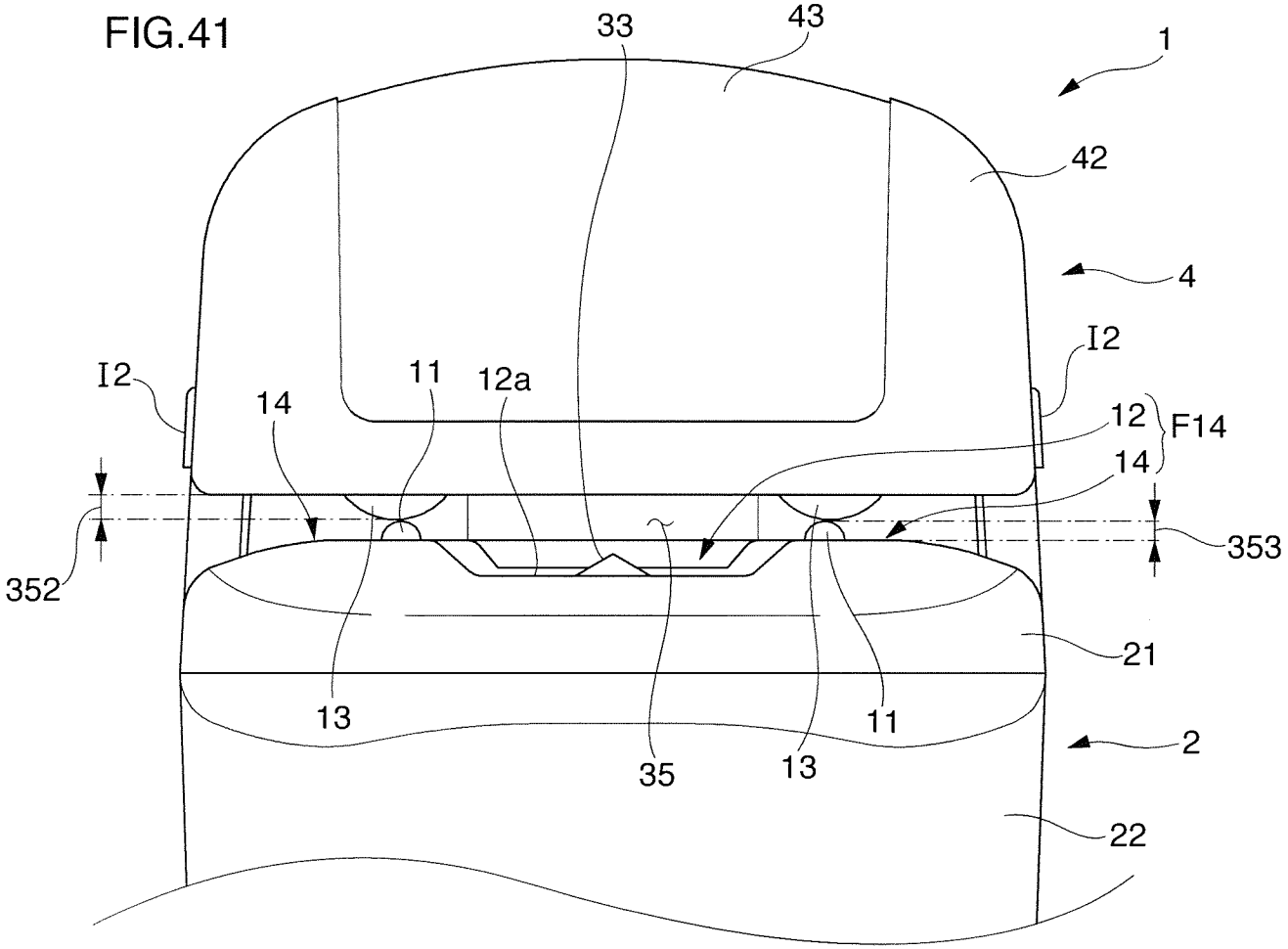
FIG. 41 is a front view of the binding machine of the second embodiment.
Figure 42:
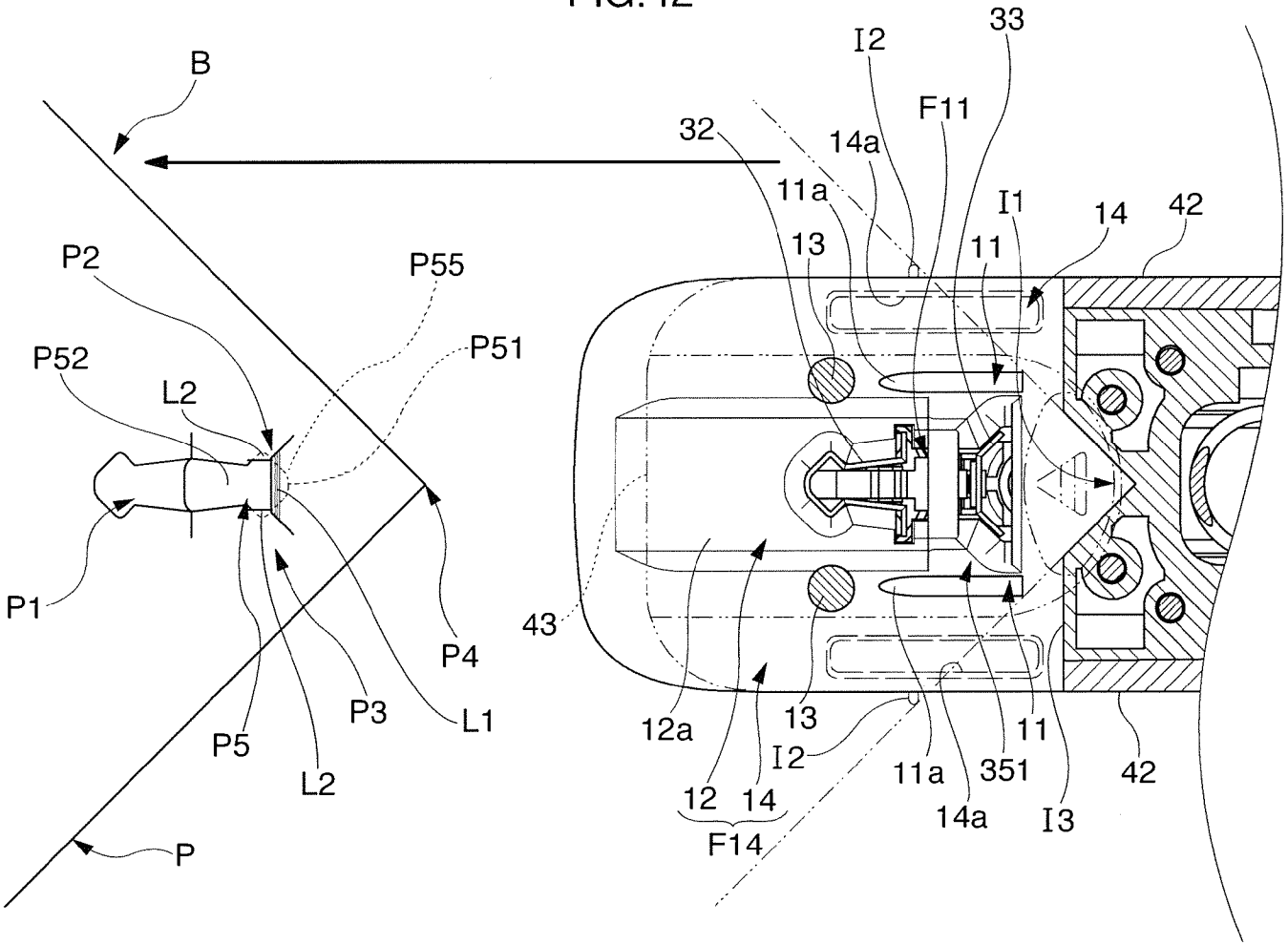
FIG. 42 is an enlarged sectional view taken along the line W-W in FIG. 40.

Moreover, the binding machine may be such as those illustrated in FIGS. 38 and 39. That is, cut-and-raised pieces FP5 and GP5 illustrated in FIGS. 38 and 39 are provided with a plurality of outer ends FP57 and GP57 of wide width portions FP56 and GP56 each having a sharp shape at each of distal end regions FP55 and GP55, and when a plurality of sheets FP and GP are bound, at least one of these outer ends FP57 and GP57 is caught by second slits FL2 and GL2.

As described above, if the cut-and-raised pieces FP5 and GP5 are provided with the plurality of wide width portions FP56 and GP56, since the edge from at least one of the wide width portions FP56 and GP56 to boundary portions FP53 and GP53 is engaged with the second slits FL2 and GL2, the cut-and-raised pieces FP5 and GP5 can be firmly engaged with the cut holes FP2 and GP2. The distal end region is not limited to the shape illustrated in the illustrated embodiment but may be changed to those in which the width dimensions of the plurality of wide width portions are made different from each other, the shape of the outer end of the wide width portion is formed having a sharp shape or an arc shape or a combination of those shapes and the like.

The second blade is not limited to those integrally cut and raised from the window as explained in the above-described embodiments but may be such that a separate body is attached. Moreover, the second blade is not limited to those disposed on the both sides of the window but may be provided on only one side of the window.

Moreover, the projection provided on the window does not have to be provided. That is, if the projection is not provided, it is only necessary that the cut-and-raised piece is pushed out from the other surface side to the one surface side by the upper edge of the window.

Furthermore, as illustrated in FIGS. 33 and 35, the wide width portion is preferably located closer to the punched hole side than the first slit (first mode), but as illustrated in FIGS. 10 and 36, it may be configured such that the wide width portion and the first slit are provided at overlapped positions (second mode), or as illustrated in FIGS. 34 and 37, the wide width portion may be located on the side opposite to the punched hole with respect to the first slit (third mode). That is, in the first mode, regardless of the number of sheets to be bound or the material of the sheets, the effect of the second slit is fully exerted, but even in the second and third modes, by appropriately selecting the number of sheets to be bound or the material of the sheets, reliability of the engagement between the cut-and-raised piece and the cut hole can be improved.

In the above-described embodiments, the cut-and-raised piece is engaged with the second slit on the edge from the wide width portion to the boundary portion in the edge from the wide width portion to the base end of the cut-and-raised piece, but not limited to that, the cut-and-raised piece may be engaged with the second slit on the edge from the boundary portion to the base end. Moreover, the spot of engagement may be single or plural.

Moreover, in this embodiment, the shape and dimension of the punching blade, the shape and dimension of the cutting blade and the relative positions of the punching blade and the cutting blade are set so that the width dimension of the wide width portion is smaller than the inner dimension of the enlarged width portion, but embodiment is possible without being limited by such setting if the operation speed of the blade driving mechanism is slowed down or the number of sheets to be bound is reduced.

The blade main body of the cutting blade, that is, the blade formed on each of the first blade and the second blade may have a so-called single-edged structure as illustrated in this embodiment but may have a double-edged structure having an edge at the center in the thickness direction of the material. Moreover, even in the single-edged structure, it may be an outer edge structure in which the blade main body of the cutting blade, that is, the blade formed on each of the first blade and the second blade has an edge only on the outside in the thickness direction of the material or an inner edge structure in which the edge is provided only on the inner side in the thickness direction of the material. In the outer edge structure, since the cut edge of the cut hole can be made continuous even in the case of bending into the U-shape or the H-shape, appearance of the cut edge can be improved. However, since the entire length distance of the edge becomes long in the outer edge structure, there is a problem that resistance becomes larger when the cutting blade penetrates the sheets. On the other hand, by forming the cutting edge having the inner edge structure, the problem that the resistance becomes larger when the cutting edge penetrates the sheets can be solved. However, discontinuity is caused in the cut hole with the inner edge structure, and not only that appearance of the cut edge of the cut hole becomes poor but also a problem is caused that the distance between the main slit and the second slit of the cut hole becomes smaller by the thickness of the cutting blade with respect to the front-and-rear separation distance between the main blade of the first blade and the second blade. Thus, by employing a double-edged structure in which the edge is provided at the center in the thickness direction of the material, the above-described problems can be all solved and a problem of warping of the edge which can easily occur in those having an edge only on one side as in the outer edge structure and the inner edge structure can be also suppressed.

Sheets are capable of various changes to those made of paper, plastic and the like as long as they are in a sheet state. Moreover, by binding a plurality of sheet bodies made of a material of the same quality, labor in sorting and discarding can be made less.

Moreover, the projecting/sinking directions of the cutting blade and the punching blade are not limited to the projecting sides of the cutting blade and the punching blade on the upper side and the sinking sides on the lower side as illustrated in the first and second embodiments, but it is possible to reverse the vertical direction and use them with the projecting sides of the cutting blade and the punching blade on the lower side and the sinking sides on the upper side. Furthermore, the binding machine illustrated in this embodiment is for forming the punched hole and the cut hole by temporary upward movements of the punching blade and the cutting blade, but the moving directions of the punching blade and the cutting blade may be such that the punched hole and the cut hole are formed by temporary downward movement, or the punched hole and the cut hole are formed by movement in the right-and-left direction or in the diagonal direction. For example, a specification in which the upper side and the lower side are made opposite to those in the above-described first and second embodiments can be considered. The binding machine of this specification has a structure in which the "above", "below", "up", "down", "upper surface", "lower surface", "upper side", "lower side", "upper blade portion", and "lower blade portion" in the above-described embodiment shall read "below", "above", "down", "up", "lower surface", "upper surface", "lower side", "upper side", "lower blade portion", and "upper blade portion", respectively.

Moreover, the positions where the punched hole and the cut hole are provided in the sheets are not limited to the corner portion but may be a position along the side of the sheets. Furthermore, the numbers of the punched hole and the cut hole are not limited to one in a booklet but a plurality of the punched holes and cut holes may be provided, but if only one punched hole is to be provided as illustrated in this embodiment, it is particularly effective since nonconformity that the joined state between the cut-and-raised piece and the cut hole is released and the cut-and-raised piece is removed from the cut hole and lateral shifting of the cut-and-raised piece can easily occur. If a plurality of the punched holes and the cut holes are to be provided, by forming the two punched holes in correspondence with the pitch of a binding rod of a binding tool of a file or the like for example, the punched holes can be used as a binding hole for binding a booklet in a file having two binding rods. Moreover, the sizes and the shapes of the punched hole and the cut hole can be changed in various ways.

The blade unit may have not only a 3-piece structure of the cutting blade, the punching blade, and the inner cam but also a 2-piece structure of the cutting blade and the punching blade. At this time, the punching blade is preferably provided rotatably from the punching attitude to the rotated attitude and capable of forming a punched hole in the punching attitude. That is, it is only necessary that the punching blade is provided with a punching mechanism for allowing the punching blade to penetrate sheets disposed on the lower surface side of the punch stand from the one surface side and a blade withdrawing mechanism for rotating the punching blade penetrating the sheets to the rotated attitude and allowing the cutting blade, which holds the cut-and-raised piece cut and raised from the punched hole, to be withdrawn to the other surface side to the one surface side of the sheets along with the cut-and-raised piece. With the 3-piece structure, since the inner cam is used for the application for pushing in the cut-and-raised piece, freedom in design of the punching blade can be improved as compared with those having the 2-piece structure and thus, the punching blade having the blade main body on the side end edge as illustrated in this embodiment can be used or the like, for example.

The positioning portion is not limited to those provided on the base frame and its locking wall but the shape is capable of various changes. For example, the positioning portion may be provided on the base cover, the punch plate, the top case and the like of the base portion. Moreover, the positioning portion may be provided with a dent or the like capable of matching the corner portion of the sheets without providing the locking wall.

In the above-described embodiments, the compression mechanism is composed mainly of the raised portion of the base frame and the raised portion of the punch plate, but if the number of sheets to be bound is relatively small, such compression mechanism does not have to be provided. That is, the present invention can exert the effect even if the compression mechanism for compressing and deforming the joined portion formed by penetrating the cut-and-raised piece into the cut hole for raising in the thickness direction is not provided, but if the above-described compression mechanism is further provided, the joined portion of the booklet can be suppressed from becoming bulky.

The blade striking mechanism may be anything where a link mechanism is not used or anything as long as the punching blade and the cutting blade are operated in the vertical direction by using the operation force applied to the operation lever in the base portion.

Moreover, the blade withdrawing mechanism may be composed mainly of the coil spring S3 only. That is, even if the coil spring S1 is not disposed, it is only necessary that the first link member 61 is rotated downward by the downward biasing force of the coil spring S3, the drive shaft 36 is pressed down by this rotating operation, and as a result, the blade unit 3 retreats to the standby position.

The inner cam is not limited to those in which an arm is directly brought into contact with the locking wall but may have a shaft-shaped projection provided on the distal end of the arm. In this case, it is only necessary that the rod-shaped projection is configured such that the inner cam rotates from the initial attitude to the rotated attitude on the lower surface of the locking wall.

The second link member and the lever plate may be provided as separate bodies, respectively, or further, the support shaft on the lower side of the second link member and the support shaft of the lever plate are not limited to those sharing the support shaft as long as they are pivotally and rotatably supported on the base portion, respectively.

The window cover is set so that the upper side of the cutting blade is open in this embodiment, but if the bank-shaped wall is relatively low, it is preferably set such that the cutting blade is open only to a position covering the upper side of the cutting blade in order to ensure safety of a user.

Moreover, the projecting/sinking direction of the slide member is not limited to the vertical direction illustrated in this embodiment but the vertical directions may be reversed such that the projecting sides of the punching blade and the cutting blade are directed downward and the sinking sides directed upward in use, for example.

Other various changes are possible within a range not departing from the gist of the present invention.

REFERENCE SIGNS LIST

While the invention has been particularly shown and described with reference to a preferred embodiment thereof, it will be understood by those skilled in the art that various other changes in the form and details may be made without departing from the spirit and scope of the invention.

P sheet
P1 punched hole
P2 cut hole
L1 first slit
L2 second slit
P5 cut-and-raised piece
P51 distal end
P52 base end
P55 distal end region
P56 wide width portion
P57 outer end
1 binding machine
2 base portion
32 punching blade
33 cutting blade
35 gap
4 punch stand
D1 first blade
D2 second blade
D3 window
D31 reduced width portion
D32 enlarged width portion
D33 projection A presently preferred embodiment of the present invention and many of its improvements have been described with a degree of particularity. It should be understood that this description has been made by way of example, and that the invention is defined by the scope of the following claims.

The invention claimed is:

1. A binding machine comprising:

a punching blade for punching a punched hole while forming a cut-and-raised piece in a plurality of sheets;

a cutting blade provided adjacently to this punching blade and punching a cut hole for locking a distal end side of the cut-and-raised piece;

a base portion for holding the punching blade and the cutting blade; and a punch stand disposed on this base portion defining a gap for sheet insertion;

by performing a punching operation so that the punching blade and the cutting blade held on the base portion penetrate a sheet inserted in the gap for sheet insertion and protrude to a punch stand side, the punched hole and the cut hole are formed in the sheet;

and by performing a withdrawing operation so that the cutting blade and the punching blade are returned to a base portion side in a state where the distal end side of the cut-and-raised piece is cut and raised from the punched hole to the punch stand side and is engaged with the cutting blade, the cut-and-raised piece penetrates the cut hole and the sheets are bound;

the cutting blade comprising:

a first blade having a window with which the cut-and-raised piece is engaged and forming a first slit; and a second blade for forming a second slit extending in a direction of the punched hole from a midstream of the first slit;

also configured such that an edge from a wide width portion of the cut-and-raised piece to a base end of the cut-and-raised piece can be engaged with the second slit, wherein a shape and a dimension of the punching blade, a shape and a dimension of the cutting blade, and the relative positions of the punching blade and the cutting blade are set so that an outer end of the wide width portion is located on an outer side of the second slit, and wherein the window is formed of a reduced width portion provided with the second blade for forming the second slit at least on one edge of the window and an enlarged width portion provided adjacently to this reduced width portion, the shape and the dimension of the punching blade, the shape and the dimension of the cutting blade, and the relative positions of the punching blade and the cutting blade are set so that a width dimension of the wide width portion is smaller than an inner dimension of the enlarged width portion.

2. The binding machine according to claim 1, wherein the shape and the dimension of the punching blade, the shape and the dimension of the cutting blade, and relative positions of the punching blade and the cutting blade are set so that the wide width portion is located on a side farther away from the punched hole than a distal end of the second slit.

3. The binding machine according to claim 2, wherein the shape and the dimension of the punching blade, the shape and the dimension of the cutting blade, and the relative positions of the punching blade and the cutting blade are set so that the wide width portion is located closer to a punched hole side than the first slit.

4. The binding machine according to claim 3, wherein the window is provided with a projection for pushing the cut-and-raised piece into the cut hole.

5. The binding machine according to claim 3, wherein the second blade is formed with two blade portions on first and second side edges of the window.

6. The binding machine according to claim 2, wherein the shape and the dimension of the punching blade, the shape and the dimension of the cutting blade, and the relative positions of the punching blade and the cutting blade are set so that the outer end of the wide width portion is located on the outer side of the second slit.

7. The binding machine according to claim 2, wherein the window is provided with a projection for pushing the cut-and-raised piece into the cut hole.

8. The binding machine according to claim 2, wherein the second blade is formed with two blade portions on first and second side edges of the window.

9. The binding machine according to claim 1, wherein the window is provided with a projection for pushing the cut-and-raised piece into the cut hole.

10. The binding machine according to claim 9, wherein the second blade is formed with two blade portions on first and second side edges of the window.

11. The binding machine according to claim 1 wherein the second blade is formed on first and second side edges of the window.

12. The binding machine according to claim 11, wherein the second blade is integrally cut and raised from the window of the first blade.

13. The binding machine according to claim 1, wherein the second blade is formed with two blade portions on first and second side edges of the window.

* * * * *